US010948850B2

(12) United States Patent
Hosokawa et al.

(10) Patent No.: US 10,948,850 B2
(45) Date of Patent: Mar. 16, 2021

(54) POWDER CONTAINER AND IMAGE FORMING APPARATUS

(71) Applicant: Ricoh Company, Ltd., Tokyo (JP)

(72) Inventors: Hiroshi Hosokawa, Kanagawa (JP); Tsukuru Kai, Kanagawa (JP); Junichi Matsumoto, Kanagawa (JP); Makoto Komatsu, Kanagawa (JP); Tadashi Hayakawa, Kanagawa (JP); Yuzuru Ozawa, Kanagawa (JP); Shinji Tamaki, Tokyo (JP); Kenji Kikuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/591,619

(22) Filed: Oct. 3, 2019

(65) Prior Publication Data

US 2020/0033758 A1 Jan. 30, 2020

Related U.S. Application Data

(60) Division of application No. 15/651,754, filed on Jul. 17, 2017, now Pat. No. 10,474,062, which is a (Continued)

(30) Foreign Application Priority Data

Jun. 3, 2012 (JP) ..... JP2012-126637
Jun. 3, 2012 (JP) ..... JP2012-126642
(Continued)

(51) Int. Cl.
*G03G 15/08* (2006.01)

(52) U.S. Cl.
CPC ..... *G03G 15/0886* (2013.01); *G03G 15/0867* (2013.01); *G03G 15/0868* (2013.01); *G03G 15/0872* (2013.01); *G03G 2215/0132* (2013.01)

(58) Field of Classification Search
CPC ..... G03G 15/0886; G03G 15/0867; G03G 15/0868; G03G 15/0872; G03G 2215/0132
See application file for complete search history.

(56) References Cited

U.S. PATENT DOCUMENTS 4,949,123 A 8/1990 Takashima
5,345,297 A 9/1994 Katakabe et al.
(Continued)

FOREIGN PATENT DOCUMENTS

CN 101639650 2/2010
EP 0604999 A2 6/1994
(Continued)

OTHER PUBLICATIONS

Office Action dated Jul. 7, 2015 in Japanese Patent Application No. 2013-116876.
(Continued)

*Primary Examiner* — Walter L Lindsay, Jr.
*Assistant Examiner* — Geoffrey T Evans
(74) *Attorney, Agent, or Firm* — XENSUS LLP

(57) ABSTRACT

The powder container includes a container body containing a powder for image formation, the powder being to be supplied to a powder replenishing device; a conveyor configured to convey the powder from one end in a longitudinal direction to the other end at which a cylindrical container opening is formed, the conveyor being provided inside the container body; a gear configured to rotate the conveyor with an external driving force; a container cover configured
(Continued)

to cover the gear, the container cover having a gear exposing hole for partially exposing a gear tooth; and a nozzle receiver configured to guide the conveying nozzle inside of the container body, the nozzle receiver being provided on the container opening. The container cover includes a container engaged portion provided outer than the tooth of the gear in a radial direction.

20 Claims, 40 Drawing Sheets

Related U.S. Application Data division of application No. 14/558,466, filed on Dec. 2, 2014, now Pat. No. 9,740,139, which is a continuation of application No. PCT/JP2013/065901, filed on Jun. 3, 2013.

(30) Foreign Application Priority Data

Apr. 25, 2013 (JP) ..... JP2013-092765
Apr. 25, 2013 (JP) ..... JP2013-092938

(56) References Cited

U.S. PATENT DOCUMENTS 5,455,662 A 10/1995 Ichikawa et al.
5,495,323 A 2/1996 Meetze, Jr.
5,500,719 A 3/1996 Ichikawa et al.
5,528,349 A 6/1996 Satake
5,576,816 A 11/1996 Staudt et al.
5,627,631 A 5/1997 Ichikawa et al.
5,648,840 A 7/1997 Ikunami et al.
5,822,663 A 10/1998 Ichikawa et al.
5,890,040 A 3/1999 Matsuoka et al.
5,918,090 A 6/1999 Ichikawa et al.
5,995,782 A 11/1999 Isobe et al.
6,075,963 A 6/2000 Ichikawa et al.
6,104,902 A 8/2000 Meyer et al.
6,118,951 A 9/2000 Kato et al.
6,169,864 B1 1/2001 Baxendell et al.
6,289,195 B1 9/2001 Ichikawa et al.
6,370,349 B2 4/2002 Tsuji et al.
6,405,011 B1 6/2002 Wang et al.
6,505,006 B1 1/2003 Solanki et al.
6,665,505 B2 12/2003 Meetze, Jr. et al.
6,898,405 B2 5/2005 Matsumoto et al.
7,065,313 B2 6/2006 Matsumoto et al.
7,079,788 B2 7/2006 Ban et al.
7,248,825 B2 7/2007 Nishitani et al.
7,321,744 B2 1/2008 Hosokawa et al.
7,480,476 B2 1/2009 Hosokawa et al.
7,519,317 B2 4/2009 Hosokawa et al.
7,697,870 B2 4/2010 Hosokawa et al.
7,702,262 B2 4/2010 Taguchi et al.
7,706,699 B2 4/2010 Taguchi et al.
7,751,737 B2 7/2010 Ishida et al.
7,822,371 B2 10/2010 Taguchi et al.
7,835,673 B2 11/2010 Hosokawa et al.
7,853,184 B2 12/2010 Taguchi et al.
7,991,334 B2 8/2011 Taguchi et al.
8,005,406 B2 8/2011 Hosokawa et al.
8,095,049 B2 1/2012 Ishiguro et al.
8,126,375 B2 2/2012 Taguchi et al.
8,195,070 B2 6/2012 Hosokawa et al.
2001/0008593 A1 7/2001 Tsuji et al.
2001/0021326 A1 9/2001 Yanigisawa et al.
2002/0001485 A1 1/2002 Ichikawa et al.
2002/0106215 A1 8/2002 Ban et al.
2002/0114646 A1 8/2002 Sudo et al.
2002/0122676 A1 9/2002 Yamada et al.
2003/0116923 A1 6/2003 Meetze, Jr. et al.
2003/0138273 A1 7/2003 Ichikawa et al.
2003/0170049 A1 9/2003 Itoh et al.
2004/0009006 A1 1/2004 Yamada et al.
2004/0131389 A1 7/2004 Tazawa
2004/0161267 A1 8/2004 Ichikawa et al.
2004/0223790 A1 11/2004 Hosokawa et al.
2004/0223791 A1 11/2004 Yamada et al.
2004/0247343 A1 12/2004 Matsumoto et al.
2005/0180782 A1 8/2005 Matsumoto et al.
2006/0008290 A1 1/2006 Yamada et al.
2006/0008291 A1 1/2006 Yamada et al.
2006/0034642 A1 2/2006 Taguchi et al.
2006/0228127 A1 10/2006 Miyaba et al.
2007/0007710 A1 4/2007 Suzuki et al.
2007/0077100 A1 4/2007 Suzuki et al.
2007/0086810 A1 4/2007 Yamada et al.
2007/0092304 A1 4/2007 Yamada et al.
2007/0098454 A1 5/2007 Yamada et al.
2007/0122205 A1 5/2007 Taguchi et al.
2007/0134021 A1 6/2007 Yamada et al.
2007/0147902 A1 6/2007 Taguchi et al.
2007/0154244 A1 7/2007 Taguchi et al.
2007/0160394 A1 7/2007 Taguchi et al.
2007/0177886 A1 8/2007 Taguchi et al.
2007/0177905 A1 8/2007 Hosokawa et al.
2007/0212119 A1 9/2007 Kurenuma et al.
2007/0242982 A1 10/2007 Sudo et al.
2008/0003021 A1 1/2008 Hosokawa et al.
2008/0124133 A1 5/2008 Yoshizawa et al.
2008/0286013 A1 11/2008 Hosokawa et al.
2009/0047037 A1 2/2009 Miyaba et al.
2009/0129813 A1 5/2009 Nagashima et al.
2009/0175660 A1 7/2009 Hosokawa et al.
2010/0158556 A1 6/2010 Miyaba et al.
2010/0189470 A1 7/2010 Yoshizawa et al.
2010/0278564 A1 11/2010 Nagashima et al.
2010/0296847 A1 11/2010 Kurenuma et al.
2011/0002713 A1 1/2011 Taguchi et al.
2011/0026973 A1 2/2011 Hosokawa et al.
2011/0044717 A1 2/2011 Miyaba et al.
2011/0058857 A1 3/2011 Hori
2011/0123232 A1 5/2011 Takashima et al.
2011/0249991 A1 10/2011 Hosokawa et al.
2012/0033998 A1 2/2012 Hori et al.
2012/0042504 A1 2/2012 Fowler
2012/0099887 A1 4/2012 Shokaku
2012/0134717 A1 5/2012 Nagashima et al.
2012/0134718 A1 5/2012 Nagashima et al.
2012/0134719 A1 5/2012 Nagashima et al.
2012/0134720 A1 5/2012 Nagashima et al.
2012/0141169 A1 6/2012 Yamane et al.
2012/0163877 A1 6/2012 Kikuchi et al.
2012/0177395 A1 7/2012 Miyaba et al.
2012/0177414 A1 7/2012 Ikeguchi et al.
2012/0020087 A1 8/2012 Takahashi
2012/0195645 A1 8/2012 Takami
2012/0200871 A1 8/2012 Takahashi
2012/0213555 A1 8/2012 Komatsu et al.
2012/0301188 A1 11/2012 Yamabe et al.
2013/0011166 A1 1/2013 Yamaguchi et al.
2013/0136505 A1 5/2013 Nagashima et al.
2013/0272750 A1 10/2013 Matsumoto et al.
2013/0336680 A1 12/2013 Nagashima et al.
2014/0050509 A1 2/2014 Kadota et al.
2014/0169836 A1 6/2014 Nagashima et al.
2014/0270859 A1 9/2014 Hosokawa et al.
2015/0338775 A1 11/2015 Hosokawa et al.
2016/0033901 A1 2/2016 Matsumoto et al.

FOREIGN PATENT DOCUMENTS

EP 1 229 402 A2 8/2002
EP 1 921 512 A2 5/2006
EP 1 927 898 A2 6/2006
EP 2783259 A1 10/2014
JP 61-162071 7/1986
JP 63-178271 7/1988
JP 01-130159 9/1989
JP 04-009061 1/1992
JP 04-168459 6/1992

(56) References Cited

FOREIGN PATENT DOCUMENTS

| | | | |
|---|---|---|---|
| JP | 04-368965 | | 12/1992 |
| JP | 05-249825 | | 9/1993 |
| JP | 05-075767 | | 10/1993 |
| JP | 06-059572 | | 3/1994 |
| JP | 07-020705 | | 1/1995 |
| JP | 07-181788 | | 7/1995 |
| JP | 07-199632 | | 8/1995 |
| JP | 07-261492 | | 10/1995 |
| JP | 10-020642 | | 1/1996 |
| JP | 08-220857 | | 8/1996 |
| JP | 10-260574 | | 9/1996 |
| JP | 8-95361 | A | 12/1996 |
| JP | 09-197783 | A | 7/1997 |
| JP | 09-197819 | | 7/1997 |
| JP | 09-211977 | | 8/1997 |
| JP | 10-153911 | | 6/1998 |
| JP | 10-171230 | | 6/1998 |
| JP | 10-198147 | | 7/1998 |
| JP | 10-254229 | | 9/1998 |
| JP | 10-260575 | | 9/1998 |
| JP | 2000-187382 | | 7/2000 |
| JP | 2000-267420 | | 9/2000 |
| JP | 2001-034053 | | 2/2001 |
| JP | 2001-083785 | | 3/2001 |
| JP | 2001-271912 | | 10/2001 |
| JP | 2001-272852 | A | 10/2001 |
| JP | 2001-312130 | | 11/2001 |
| JP | 2002-031943 | | 1/2002 |
| JP | 2002-196629 | | 7/2002 |
| JP | 2002-202656 | | 7/2002 |
| JP | 2002-244417 | | 8/2002 |
| JP | 3353194 | | 9/2002 |
| JP | 2002-302169 | | 10/2002 |
| JP | 2002-357946 | | 12/2002 |
| JP | 2003-57931 | | 2/2003 |
| JP | 2003-066703 | | 3/2003 |
| JP | 2003-066704 | | 3/2003 |
| JP | 2003-191497 | | 7/2003 |
| JP | 2003-195616 | | 7/2003 |
| JP | 2003-233247 | | 8/2003 |
| JP | 2003-241496 | | 8/2003 |
| JP | 2004-012687 | | 1/2004 |
| JP | 2004-280064 | | 10/2004 |
| JP | 2005-099434 | | 4/2005 |
| JP | 3665376 | | 4/2005 |
| JP | 2005-193575 | | 7/2005 |
| JP | 2005-221825 | | 8/2005 |
| JP | 2005-242185 | | 9/2005 |
| JP | 2005-331622 | | 12/2005 |
| JP | 2006-058698 | | 3/2006 |
| JP | 2006-072166 | | 3/2006 |
| JP | 2006-209060 | | 8/2006 |
| JP | 2006-235641 | | 9/2006 |
| JP | 2006-293003 | | 10/2006 |
| JP | 2006-309016 | | 11/2006 |
| JP | 2007-065271 | | 3/2007 |
| JP | 2007-065613 | | 3/2007 |
| JP | 2007-140433 | | 6/2007 |
| JP | 2007-148320 | A | 6/2007 |
| JP | 2007-178969 | | 7/2007 |
| JP | 2008-298907 | | 12/2008 |
| JP | 2009-008698 | | 1/2009 |
| JP | 2009-223351 | | 1/2009 |
| JP | 2009/069417 | | 4/2009 |
| JP | 2009-116120 | | 5/2009 |
| JP | 4342958 | | 7/2009 |
| JP | 2009-1 86554 | A | 8/2009 |
| JP | 2009-210615 | | 9/2009 |
| JP | 2009-223351 | | 10/2009 |
| JP | 2009-276659 | | 11/2009 |
| JP | 2010-014763 | | 1/2010 |
| JP | 2010-020343 | | 1/2010 |
| JP | 2010-262236 | A | 11/2010 |
| JP | 2011-107606 | | 6/2011 |
| JP | 2011-150121 | | 8/2011 |
| JP | 4794892 | | 8/2011 |
| JP | 2011-197159 | | 10/2011 |
| JP | 2011-215473 | | 10/2011 |
| JP | 2012-016377 | | 1/2012 |
| JP | 2012-058569 | | 3/2012 |
| JP | 4958325 | | 3/2012 |
| JP | 2012-093460 | | 5/2012 |
| JP | 2012-93736 | A | 5/2012 |
| JP | 2012-133349 | A1 | 7/2012 |
| JP | 2012-137740 | | 7/2012 |
| JP | 2013-113945 | | 6/2013 |
| RU | 2 398 257 | C2 | 3/2006 |
| RU | 2372635 | C2 | 11/2009 |
| TW | 201011480 | | 3/2010 |
| TW | 201113653 | A1 | 4/2011 |
| TW | 201205209 | A1 | 2/2012 |
| TW | 201232199 | A1 | 8/2012 |
| WO | 2006/132259 | | 12/2006 |
| WO | 2012/074139 | A1 | 6/2012 |
| WO | 2856265 | | 12/2013 |
| WO | 2014/142362 | | 9/2014 |

OTHER PUBLICATIONS

International Search Report and Written Opinion dated Jun. 17, 2014 in PCT/JP2014/057949 filed Mar. 14, 2014.

Extended European Search Report dated Apr. 1, 2015 in Patent Application No. 12851714,1.

International Search Report dated Jan. 8, 2013 in PCT/JP2012/081219 filed Nov. 26, 2012.

International Written Opinion dated Jan. 8, 2013 in PCT/JP2012/081219 filed Nov. 26, 2012.

Offiice Action dated Apr. 27, 2015 Russian Patent Application No. 2014106826/28 (with English translation).

Office Action dated Sep. 3, 2013 in Japanese Patent Application No. 2013-034830.

Office Action dated Apr. 21, 2015 in Japanese Patent Application No. 2011-197303.

Office Action dated Jan. 20, 2015 in Australian Patent Application No. 2011337578.

Office Action dated Jun. 26, 2014 in Russian Patent Application No. 2013130231/28 (with English translation).

Extended European Search Report dated Jun. 18, 2014 in Patent Application No. 11845366.1.

Office Action dated Jul. 23, 2013 in Japanese Patent Application No. 2011-262861.

Office Action dated Nov. 25, 2013 in Japanese Patent Application No. 2011-262861.

Office Action dated Apr. 25, 2014 in Taiwanese Patent Application No. 100144415.

Office Action dated Jan. 15, 2014 in Canadian Patent Application No. 2,795,123.

International Search Report dated Jan. 17, 2012 in PCT/JP2011/078626.

Office Action dated Sep. 10, 2013 in Japanese Patent Application No. 2013-110330.

Office Action dated Nov. 26. 2013 in Japanese Patent Application No. 2013-153815.

Office Action dated Apr. 22, 2014 in Japanese Patent Application No. 2013-153815.

International Search Report dated Aug. 13, 2013 in PCT/JP2013/065901 filed Jun. 3, 2013.

Taiwanese Office Action dated Jan. 26, 2016,Taiwanese Patent Application No. 103106106 (with English translation).

Office Action dated Mar. 21, 2017 in Japanese Patent Application No. 2013-092938 (computer generated English translation).

Office Action dated May 8, 2016 in related U.S. Appl. No. 15/041,232.

Office Action dated Apr. 26, 2016 for Taiwanese Application No. 103131631 and English translation thereof.

Office Action dated Jan. 6, 2016 in Korean Patent Application No. 10-2014-7032139 (with English language translation).

Decision on Grant dated Mar. 10, 2016 in Russian Patent Application No. 2014125562 (With English language translation).

(56) References Cited

OTHER PUBLICATIONS

European Search Report dated Apr. 1, 2015 in Patent Application No. 13800861.0.
Extended European Search Report dated Feb. 8, 2016 for European Patent Application No. 14762332.6.
Office Action and Search Report issued in Chinese Application 201710159880.0 dated Jul. 11, 2019.
Extended European Search Report dated Dec. 3, 2018 in Patent Application No. 18187780.4, citing documents AA-AT therein, 9 pages.
Examination Report dated Jul. 25, 2018 in Indian Patent Application No. 2550/KOLNP/2014 citing documents AO-AP therein, 7 pages.
Office Action dated Sep. 17, 2020 in corresponding Korean Patent Application No. 10-2020-7018639, 9 pages with English Translation.

(a)

(b)

POWDER CONTAINER AND IMAGE FORMING APPARATUS

CROSS REFERENCE TO RELATED APPLICATIONS

This application is a divisional of and claims the benefit under 35 U.S.C. 120 to U.S. application Ser. No. 15/651,754, Jul. 17, 2017, which is a divisional of U.S. application Ser. No. 14/558,466, filed Dec. 2, 2014 (now U.S. Pat. No. 9,740,139), which is a continuation of International Application No. PCT/JP2013/065901, filed Jun. 3, 2013, and claims the benefit of priority under 35 U.S.C. 119 from Japanese Patent Application Nos. 2012-126642 and 2012-126637, filed Jun. 3, 2012 and Japanese Patent Application Nos. 2013-092938 and 2013-092765, filed Apr. 25, 2013. The entire contents of each of the above are hereby incorporated herein by reference.

TECHNICAL FIELD

The present invention relates to a powder container that contains a powder such as a toner, and relates to an image forming apparatus in which the powder is conveyed from the powder container toward a conveying destination.

BACKGROUND ART

In an image forming apparatus such as a copier, a printer, or a facsimileing machine in which the electrophotographic process is implemented; a latent image formed on a photoreceptor is turned into a visible image using the toner present in a developing device. Hence, development of latent images results in the consumption of the toner. Because of that, it becomes necessary to replenish the developing device with the toner. There, a toner replenishing device, which functions as a powder supplying device installed in the main body of the image forming apparatus, conveys the toner from a toner container, which functions as a powder container, to the developing device. As a result, the developing device is replenished with the toner. Using a developing device that is replenished with the toner in the abovementioned manner, it becomes possible to develop images in a continual manner. Moreover, the toner container is attached to the toner replenishing device in a detachable manner. Hence, when the toner container runs out of the toner, it is replaced with a new toner container that contains the toner.

As toner containers that can be detachably attached to a toner replenishing device, some toner containers are known in which a spiral rib is formed on the inner surface of a cylindrical toner containing member that contains toner (see Japanese Patent Application Laid-open No. 2003-241496, Japanese Patent Application Laid-open No. 2005-221825, Japanese Patent No. 4342958, Japanese Patent Application Laid-open No. 2002-202656, and Japanese Patent Application Laid-open No. 2003-233247). In the condition in which such a toner container is attached to a toner replenishing device, the toner containing member is rotated so that the toner stored therein is conveyed from one end to the other end in the direction of the rotational axis. Then, from an opening formed at the other end of the toner containing member, the toner is discharged toward the main body of the toner replenishing device.

In Japanese Patent Application Laid-open No. 2009-276659 is disclosed the following configuration. Regarding a toner container in which a toner containing member is rotated so that the toner stored in the toner containing member is conveyed from one end to the other end, a conveying nozzle fixed to a toner replenishing device is inserted from an opening formed at the other end of the toner containing member. The conveying nozzle that is inserted in the toner container has a toner receiving opening formed in the neighborhood of the end portion at the front end in the direction of insertion of the conveying nozzle. Thus, when inserted in the toner container, the conveying nozzle receives the toner from the toner containing member through the toner receiving opening. Then, the conveying nozzle conveys the toner to the main body of the toner replenishing device. Moreover, in the toner container, inside the opening formed at the other end of the toner containing member, a nozzle insertion member is fixed that has a nozzle insertion opening for enabling insertion of the conveying nozzle. Furthermore, the toner container includes a container shutter that shuts the nozzle insertion opening when the conveying nozzle is not inserted, and opens the nozzle insertion opening at the time of insertion of the conveying nozzle.

In the toner container disclosed in Japanese Patent Application Laid-open No. 2009-276659, the nozzle insertion opening is kept shut until the conveying nozzle is inserted. With that, it becomes possible to prevent leakage or scattering of the toner before the toner container is attached to a toner replenishing device. Moreover, when the toner container is attached to a toner replenishing device, the conveying of toner from the toner container into the conveying nozzle of the toner replenishing device is done inside the toner container. As a result, as compared to the method in which the conveying of toner to the toner replenishing device is done on the outside of the toner container, the inside of the toner replenishing device as well as the outer surface of the toner container can be prevented from getting dirty with the scattered toner. For that reason, if the operator pulls out the toner container even after the start of image formation, the operator does not get dirty with the toner.

However, in Japanese Patent Application Laid-open No. 2009-276659, there is no disclosure of a holding mechanism that would enable fixing the toner container (toner cartridge) to a toner replenishing device against the restoring force of springs that press the shutter toward the outside. Beyond that, there is no disclosure of a specific configuration that would enable avoiding interference between gears, which are installed for conveying the toner present inside the toner container, and the holding mechanism. Unless a holding mechanism is present that would enable holding the toner container to a toner replenishing device without causing interference with the gears, it is not possible to convey the toner in a stable manner. And it is not possible to supply the toner to the toner replenishing device with preventing toner leakage from the nozzle insertion opening.

Therefore, there is a need to provide a powder container in which a conveying nozzle can be inserted, and the powder container can be held at a replenishable position inside a replenishing device in such a way that a powder can be conveyed from the powder container to the replenishing device in a stable manner; as well as to provide an image forming apparatus that includes the powder container.

DISCLOSURE OF INVENTION

It is an object of the present invention to at least partially solve the problems in the conventional technology.

According to an embodiment, there is provided a powder container attachable to a powder replenishing device in a horizontal longitudinal direction. The powder replenishing device includes a conveying nozzle for conveying a powder, a nozzle opening formed on the conveying nozzle to receive the powder from the powder container, and a replenishing device engaging member for holding the powder container by laterally biasing the powder container. The powder container includes a container body configured to contain a powder for image formation, the powder being to be supplied to the powder replenishing device; a conveyor configured to convey the powder from one end in the longitudinal direction to the other end at which a cylindrical container opening is formed, the conveyor being provided inside the container body; a gear configured to rotate the conveyor with an external driving force; a container cover configured to cover the gear, the container cover having a gear exposing hole for partially exposing a gear tooth; and a nozzle receiver configured to guide the conveying nozzle inside of the container body, the nozzle receiver being provided on the container opening. The container cover includes a container engaged portion that includes a sliding section configured to enable the replenishing device engaging member to slide, and an engaged hole with which the replenishing device engaging member engages. The container engaged portion is provided outer than the tooth of the gear in a radial direction.

The above and other objects, features, advantages and technical and industrial significance of this invention will be better understood by reading the following detailed description of presently preferred embodiments of the invention, when considered in connection with the accompanying drawings.

BEST MODE(S) FOR CONVEYING OUT THE INVENTION

First Embodiment

Given below is the explanation of exemplary embodiments of the present invention that is applied to a copier (hereinafter, referred to as a copier 500) which functions as an image forming apparatus.

Figure 2:
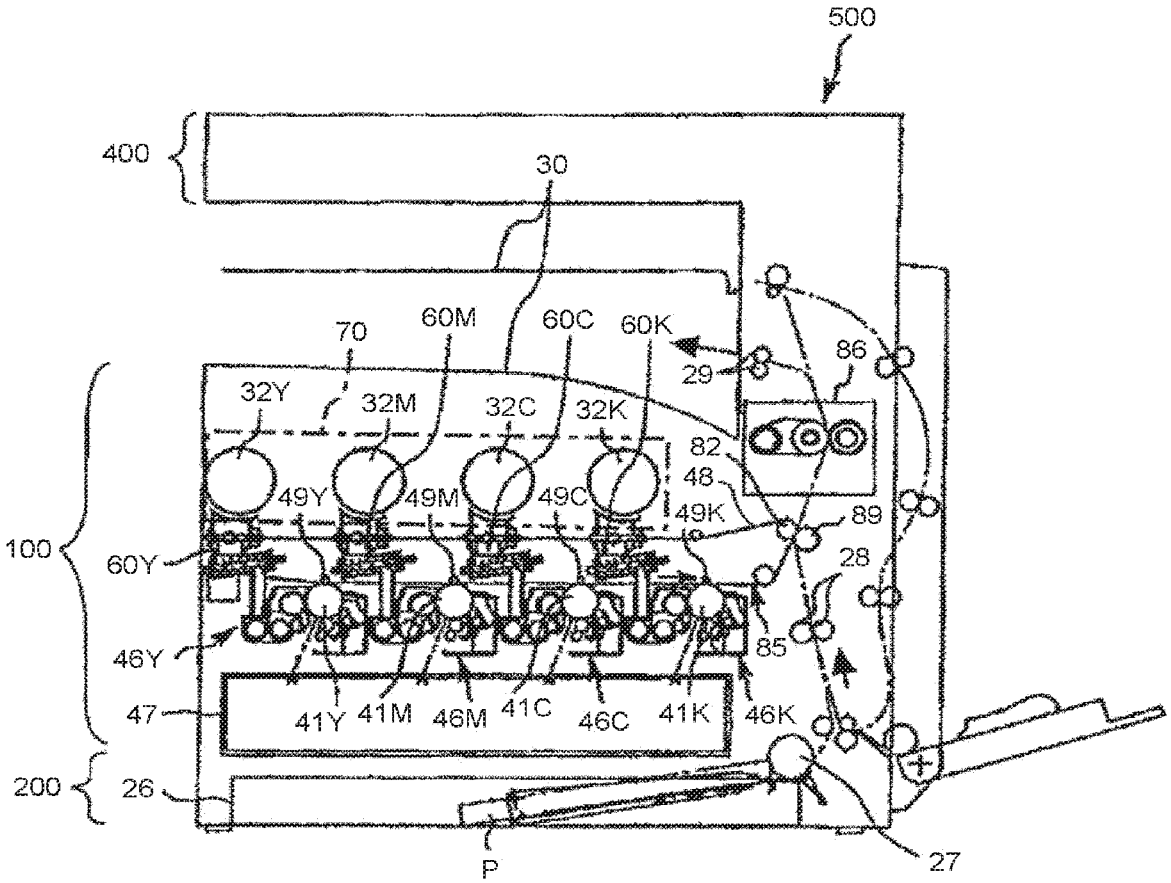
FIG. 2 is an overall configuration diagram of a copier according to all embodiments.

FIG. 2 is an overall configuration diagram of the copier 500 according to the embodiments. The copier 500 includes a copier body (hereinafter, referred to as a printer 100), a paper feeding table (hereinafter, referred to as a sheet feeder 200), and a scanner (hereinafter, referred to as a scanner 400) that is attached above the printer 100.

In a container holding section 70 that is disposed in the upper part of the printer 100, four toner containers 32 (32Y, 32M, 32C, and 32K) that function as powder containers corresponding to four colors (yellow, magenta, cyan, and black, respectively) are installed in a detachable manner (in a replaceable manner). On the lower side of the container holding section 70 is disposed an intermediate transfer unit 85.

The intermediate transfer unit 85 includes an intermediate transfer belt 48, four primary-transfer bias rollers 49 (49Y, 49M, 49C, and 49K), a secondary-transfer backup roller 82, a plurality of tension rollers, and an intermediate transfer cleaning device. The intermediate transfer belt 48 is wound around and supported by a plurality of rollers, and performs endless movement in the direction of arrows illustrated in FIG. 2 when rotary-driven by the secondary-transfer backup roller 82 that is one of the plurality of rollers.

In the printer 100, four image forming units 46 (46Y, 46M, 46C, and 46K) are arranged in parallel to each other and opposite to the intermediate transfer belt 48. On the lower side of the four toner containers 32 (32Y, 32M, 32C, and 32K), four toner replenishing devices 60 (60Y, 60M, 60C, and 60K) that function as powder replenishing devices are disposed respectively. Herein, each of the toner replenishing devices 60 (60Y, 60M, 60C, and 60K) supplies a toner, which is stored in the corresponding toner container 32 (32Y, 32M, 32C, or 32K), to a developing device (a powder using unit) of the image forming unit 46 (46Y, 46M, 46C, or 46K) of the corresponding color.

As illustrated in FIG. 2, on the lower side of the image forming units 46, the printer 100 includes an exposing device 47 that functions as a latent image forming unit. Based on image information of an original image read by the scanner 400 or based on image information that is input from an external device such as a personal computer, the exposing device 47 exposes the outer surfaces of photoreceptors 41 (described later) to light and forms electrostatic latent images on the outer surfaces of the photoreceptors 41. Herein, the exposing device 47 disposed in the printer 100 implements a laser beam scanning method with the use of laser diodes. However, alternatively, as the exposing unit, it is also possible to use other configurations such as a light emitting diode (LED) array.

Figure 3:
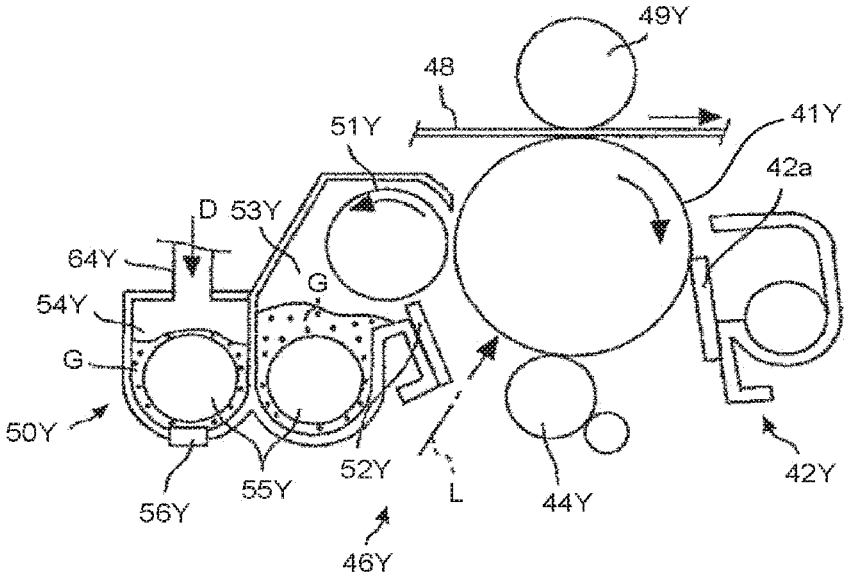
FIG. 3 is a schematic diagram illustrating an image forming unit of the copier according to the embodiments.

FIG. 3 is a schematic diagram illustrating an overall configuration of the image forming unit for yellow 46Y that corresponds to the yellow color.

The image forming unit for yellow 46Y includes the drum-shape photoreceptor 41Y that functions as a latent image bearer. Moreover, the image forming unit for yellow 46Y includes the following constituent elements disposed around the photoreceptor 41Y: a charging roller 44Y that functions as a charging unit; a developing device 50Y that functions as a developing unit; a photoreceptor cleaning device 42Y; and a discharging device. The photoreceptor 41Y is subjected to imaging processing (including a charging operation, an exposing operation, a developing operation, a transferring operation, and a cleaning operation). As a result, a yellow image is formed on the photoreceptor 41Y.

Meanwhile, regarding the other three image forming units 46 (46M, 46C, 46K), except for the point that the colors of the used toner are different, the configurations are substantially identical to the configuration of the image forming unit for yellow 46Y corresponding to the yellow color. Thus, on each of the photoreceptors 41M, 41C, and 41K; images of the color of the corresponding toner are formed. Hereinafter, the explanation of the three image forming units 46 (46M, 46C, 46K) is appropriately omitted, and only the image forming unit for yellow 46Y is explained.

The photoreceptor 41Y is rotary-driven by a driving motor in the clockwise direction with reference to FIG. 3. Then, the surface of the photoreceptor 41Y gets uniformly charged at the position opposite to the charging roller 44Y (the charging operation). Subsequently, the surface of the photoreceptor 41Y reaches an illumination position of a laser light L, which is emitted from the exposure device 47, and is subjected to exposure scanning at that illumination position. As a result, an electrostatic latent image corresponding to the yellow color is formed on the surface of the photoreceptor 41Y (the exposing operation). Then, the surface of the photoreceptor 41Y reaches the position opposite to the developing device 50Y. At that position, the electrostatic latent image corresponding to the yellow color is developed thereby resulting in the formation of a yellow toner image (the developing operation).

Each of the four primary-transfer bias rollers 49 (49Y, 49M, 49C, and 49K) of the intermediate transfer unit 85 forms a primary transfer nip by sandwiching the intermediate transfer belt 48 with the corresponding photoreceptor 41 (41Y, 41M, 41C, or 41K). Then, a transfer bias having opposite polarity to the polarity of the toner is applied to the primary-transfer bias rollers 49 (49Y, 49M, 49C, and 49K).

Following the formation of a yellow toner image on the surface of the photoreceptor 41Y during the developing operation, the surface of the photoreceptor 41Y reaches the primary transfer nip formed opposite to the primary-transfer bias roller 49Y. Then, at the primary transfer nip, the yellow toner image gets transferred from the photoreceptor 41Y onto the intermediate transfer belt 48 (a primary transfer operation). At that time, untransferred toner remains, albeit only slightly, on the photoreceptor 41Y. Once the yellow toner image is transferred onto the intermediate transfer belt 48 at the primary transfer nip, the outer surface of the photoreceptor 41Y reaches the position opposite to the photoreceptor cleaning device 42Y. At that position, the untransferred toner remaining on the photoreceptor 41Y is mechanically collected by a cleaning blade 42*a* (the cleaning operation). Finally, the outer surface of the photoreceptor 41Y reaches the position opposite to the discharging device. At that position, the residual potential on the photoreceptor 41Y is removed. That marks the end of a sequence of operations that are performed with respect to the photoreceptor 41Y during the imaging process.

With respect to the other image forming units 46 (46M, 46C, and 46K) too, the imaging process is performed in an identical manner to the imaging process performed with respect to the image forming unit for yellow 46Y. That is, the exposing device 47 that is disposed on the lower side of each image forming unit 46 (46M, 46C, or 46K) emits image-information-based laser light L toward the photoreceptor 41 (41M, 41C, or 41K) of each image forming unit 46 (46M, 46C, or 46K). More specifically, in the exposing device 47, the laser light L is emitted from a light source and, is scanned using a rotary-driven polygon mirror so that the laser light L falls on each photoreceptor 41 (41M, 41C, and 41K) via a plurality of optical elements. That is followed by the developing operation. Then, the toner image of each color is transferred from the corresponding photoreceptor 41 (41M, 41C, or 41K) onto the intermediate transfer belt 48.

At that time, the intermediate transfer belt 48 is moving in the direction of the arrows illustrated in FIG. 2 and sequentially passes through the primary transfer nip of each primary-transfer bias roller 49 (49Y, 49M, 49C, and 49K). As a result, the toner images of the fours colors are primary-transferred from the photoreceptors 41 (41Y, 41M, 41C, and 41K) onto the intermediate transfer belt 48 in a superimposed manner. That results in the formation of a color toner image on the intermediate transfer belt 48.

Then, the intermediate transfer belt 48, on which the color toner image has been formed by superimposed transfer of the toner images of all colors, reaches the position opposite to a secondary transfer roller 89. At that position, the secondary-transfer backup roller 82 forms a secondary transfer nip by sandwiching the intermediate transfer belt 48 with the secondary transfer roller 89. When a recording medium P such as a transfer paper sheet is conveyed to the position of the secondary transfer nip, the color toner image is transferred from the intermediate transfer belt 48 onto the recording medium P. At that time, untransferred toner that was not transferred onto the recording medium P remains on the intermediate transfer belt 48. After passing through the secondary transfer nip, the intermediate transfer belt 48 reaches the position of an intermediate transfer cleaning device, which collects the untransferred toner from the outer surface of the intermediate transfer belt 48. That marks the end of a sequence of operations performed with respect to the intermediate transfer belt 48.

Given below is the explanation regarding the recording medium P.

The recording medium P that is conveyed to the secondary transfer nip is conveyed from a feed tray 26 of the sheet feeder 200, which is disposed on the lower side of the printer 100, via a feed roller 27 and a registration roller pair 28. More specifically, in the feed tray 26 is housed a plurality of recording media P in a stacked manner. When the feed roller 27 is rotary-driven in the counterclockwise direction with reference to FIG. 2, the topmost recording medium P is conveyed toward a roller nip formed between the two rollers of the registration roller pair 28.

The recording medium P that is conveyed to the registration roller pair 28 temporarily stops at the position of the roller nip of the registration roller pair 28 that has been stopped from rotary-driving. Then, in synchronization with the timing at which the color toner image formed on the intermediate transfer belt 48 reaches the secondary transfer nip, the registration roller pair 28 is rotary-driven so that the recording medium P is conveyed toward the secondary transfer nip. As a result, the desired color toner image gets transferred onto the recording medium P.

Then, the recording medium P, on which the color toner image has been transferred at the secondary transfer nip, is conveyed to a fixing device 86. In the fixing device 86, due to the heat and pressure generated from a fixing belt and a pressure roller, the color toner image is fixed on the recording medium P. After passing through the fixing device 86, the recording medium P is discharged to the outside of the copier 500 through a discharge roller pair 29. Once the recording medium P is discharged to the outside of the copier 500 through the discharge roller pair 29, it is sequentially stacked as an output image in a stack section 30. That marks the end of a sequence of operations performed during an image forming process in the copier 500.

Given below is the more detailed explanation about the configuration and the operations of the developing device 50 disposed in each image forming unit 46. Herein, the explanation is given with reference to the image forming unit for yellow 46Y. However, the explanation is identical with reference to the image forming units 46M, 46C, and 46K corresponding to the other three colors.

As illustrated in FIG. 3, the developing device 50Y includes a developing roller 51Y, a doctor blade 52Y, two developer conveying screws 55Y, and a toner density sensor 56Y. The developing roller 51Y is positioned opposite to the photoreceptor 41Y, while the doctor blade 52Y is positioned opposite to the developing roller 51Y. The two developer conveying screws 55Y are disposed in two developing particle accommodating portions (53Y and 54Y). The developing roller 51Y includes an internally-fixed magnet roller and a sleeve that rotates around the magnet roller. And a developer G that is made of two components, namely, a carrier and a toner is housed in the first developing particle accommodating portion 53Y as well as in the second developing particle accommodating portion 54Y. The second developing particle accommodating portion 54Y has an opening formed on the upper side thereof and is communicated with a toner dropping passage 64Y through that opening. Meanwhile, the toner density sensor 56Y detects the toner density of the developer G that is housed in the second developing particle accommodating portion 54Y.

The developer G present inside the developing device 50 circulates between the first developing particle accommodating portion 53Y and the second developing particle accommodating portion 54Y while being stirred by the two developer conveying screws 55Y. While the developer G that is housed in the first developing particle accommodating portion 53Y is conveyed to one side of the developer conveying screws 55Y, it is supplied to and carried on the sleeve surface of the developing roller 51Y by means of a magnetic field formed by the magnet roller of the developing roller 51Y. The sleeve of the developing roller 51Y is rotary-driven in the counterclockwise direction as illustrated by an arrow in FIG. 3, and the developer G supported on the developing roller 51Y moves over the developing roller 51Y due to the rotation of the sleeve. At that time, due to the frictional charging between the carrier in the developer G, the toner in the developer G is charged to an electric potential having opposite polarity than the carrier and thus gets electrostatically adsorbed on the carrier. Then, along with the carrier that is drawn toward the magnetic field formed on the developing roller 51Y, the developer G is carried on the developing roller 51Y.

The developer G that is carried on the developing roller 51Y is then conveyed in the direction of the arrow illustrated in FIG. 3 and reaches a doctor portion at which the doctor blade 52Y and the developing roller 51Y are positioned opposite to each other. While passing through the doctor portion, the developer G on the developing roller 51Y is optimized in quantity and is conveyed to a developing area that points to the position opposite to the photoreceptor 41Y. In the developing area, due to a developing electric field formed between the developing roller 51Y and the photoreceptor 41Y, the toner in the developer G gets adsorbed on the latent image formed on the photoreceptor 41Y. Then, the residual developer G on the developing roller 51Y, which has passed through the developing area, reaches the upper side of the first developing particle accommodating portion 53Y due to the rotation of the sleeve of the developing roller 51Y. At that position, the developer G breaks away from the developing roller 51Y.

The developer G present inside the developing device 50Y is adjusted to have the toner density within a predetermined range. More specifically, depending on the amount of development-related consumption of the toner that is included in the developer G present inside the developing device 50Y, the toner stored in the toner container 32Y is supplied to the second developing particle accommodating portion 54Y via the toner replenishing device 60Y (described later).

Then, the toner that is supplied to the second developing particle accommodating portion 54Y circulates between the first developing particle accommodating portion 53Y and the second developing particle accommodating portion 54Y while being mixed with the developer G and being stirred by the two developer conveying screws 55Y.

Given below is the explanation regarding the toner replenishing devices 60 (60Y, 60M, 60C, and 60K).

Figure 4:
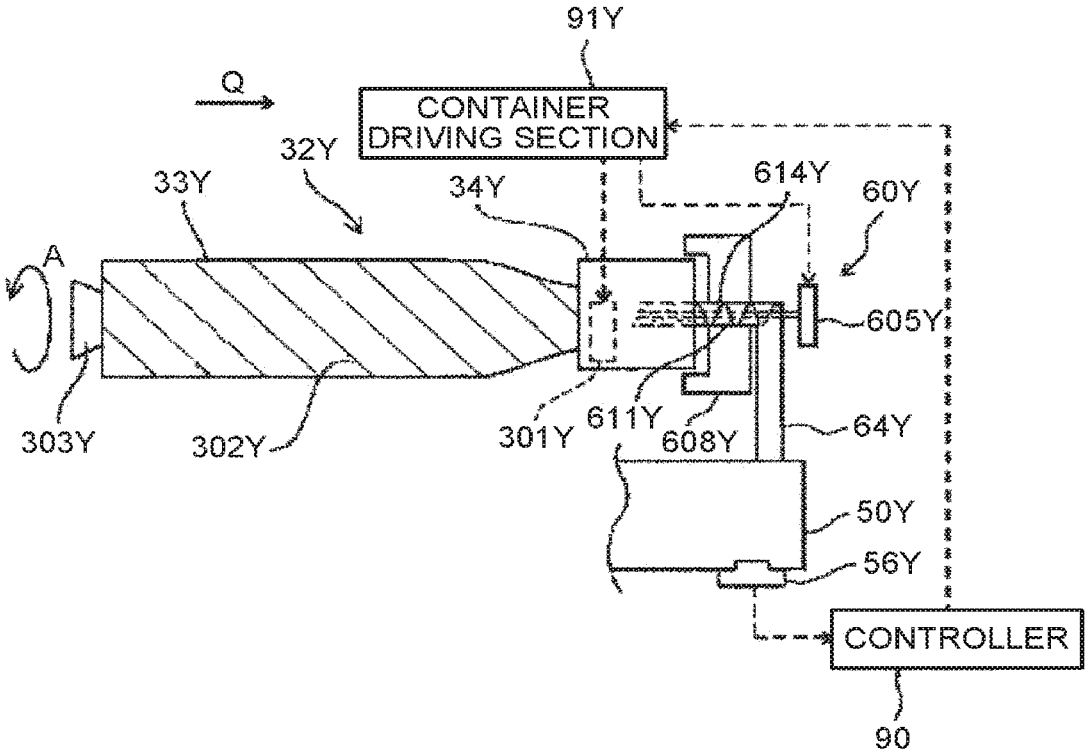
FIG. 4 is a schematic diagram illustrating a condition in which a toner container is held in a toner replenishing device of the copier according to the embodiments.
Figure 5:
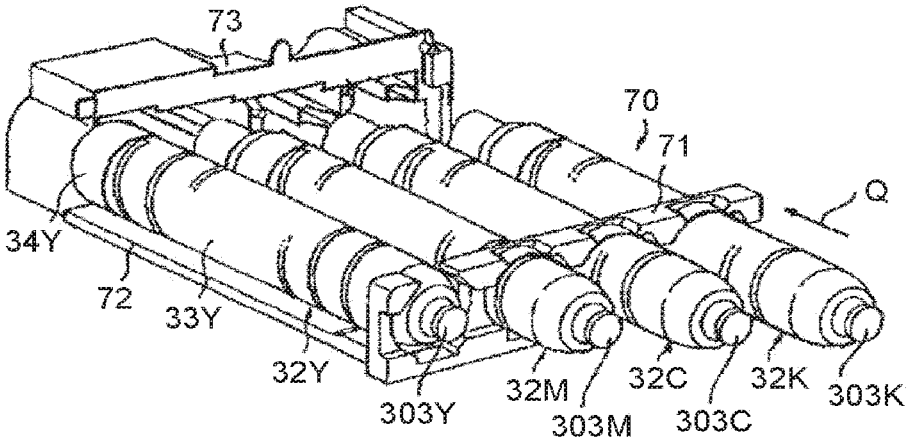
FIG. 5 is an overall perspective view illustrating a condition in which toner containers are held in a container holding section of the copier according to the embodiments.

FIG. 4 is a schematic diagram illustrating a condition in which the toner container 32 is held in the toner replenishing device 60Y. FIG. 5 is an overall perspective view illustrating a condition in which four toner containers 32 (32Y, 32M, 32C, and 32K) are held in the container holding section 70.

Depending on the amount of consumption of the toners in the developing devices 50 (50Y, 50M, 50C, and 50K), the respective toners are appropriately supplied to the developing devices 50 (50Y, 50M, 50C, and 50K) from the toner containers 32 (32Y, 32M, 32C, and 32K) that are installed in the container holding section 70. At that time, the toners in the toner containers 32 (32Y, 32M, 32C, and 32K) are supplied by the toner replenishing devices 60 (60Y, 60M, 60C, and 60K) that are installed on the basis of the toner colors. Meanwhile, regarding the four toner replenishing devices 60 (60Y, 60M, 60C, and 60K) or regarding the four toner containers 32 (32Y, 32M, 32C, and 32K), the configurations are substantially identical other than the point that the color of the toner used in the imaging process is different. For that reason, hereinafter, the explanation is given only regarding the toner replenishing device 60Y and the toner container 32Y corresponding to the yellow color, and the explanation of the other toner replenishing devices 60 (60M, 60C, and 60M) and the other toner containers 32 (32M, 32C, and 32K) corresponding to the other three colors is appropriately omitted.

Each toner replenishing device 60 (60Y, 60M, 60C, and 60K) includes the container holding section 70; a conveying nozzle 611 (611Y, 611M, 611C, and 611K); a conveying screw 614 (614Y, 614M, 614C, and 614K); the toner dropping passage 64 (64Y, 64M, 64C, and 64K); and a container driving section 91 (91Y, 91M, 91C, and 91K).

Consider the case when the toner container 32Y is moved in the direction of an arrow Q illustrated in FIGS. 4 and 5, and is attached to the container holding section 70 of the printer 100. Then, in tandem with the operation of fitting the toner container 32Y, the conveying nozzle 611Y of the toner replenishing device 60Y gets inserted from the container front end side of the toner container 32. As a result, the inside of the toner container 32 becomes communicated with the conveying nozzle 611Y. The detailed configuration for establishing communication in tandem with the fitting operation is described later.

In a first embodiment, the toner container 32Y is a toner bottle having a substantially cylindrical shape; and mainly includes a container front end cover 34Y, which serves as a container cover held in the container holding section 70 in a nonrotating manner, and a container body 33Y, with which a container gear 301Y serving as a gear is configured in an integrated manner. Moreover, the container body 33Y is held in a relatively-rotatable manner with respect to the container front end cover 34Y.

The container holding section 70 mainly includes a container cover receiving section 73, a container receiving section 72, and an insert hole portion 71. The container cover receiving section 73 is the portion for holding the container front end cover 34Y of the toner container 32Y. The container receiving section 72 is the portion for holding the container body 33Y of the toner container 32Y. The insert hole portion 71 is the portion in which an insertion opening is formed that is used during the fitting operation for fitting the toner container 32Y into the container receiving section 72. In the copier 500, when a main body cover disposed on the near side (i.e., on the near side in the vertical direction with reference to FIG. 2) is opened, the insert hole portion 71 of the container holding section 70 is revealed. Then, with the longitudinal direction of each toner container 32 (32Y, 32M, 32C, and 32K) maintained in the horizontal direction, each toner container 32 (32Y, 32M, 32C, and 32K) is attached or detached from the near side of the copier 500 (i.e., an attaching-detaching operation is performed with the longitudinal direction of the toner containers 32 as the attaching-detaching direction). Meanwhile, a setting cover 608Y illustrated in FIG. 4 is a part of the container cover receiving section 73 of the container holding section 70.

The container receiving section 72 is configured to have the length in the longitudinal direction substantially equal to the length in the longitudinal direction of the container body 33Y. The container cover receiving section 73 is disposed at the container front end side in the longitudinal direction (the attaching-detaching direction) of the container receiving section 72. The insert hole portion 71 is formed at one end in the longitudinal direction (the attaching-detaching direction) of the container receiving section 72. Hence, during the fitting operation for fitting the toner container 32Y; the container front end cover 34Y passes through the insert hole portion 71, slides over the container receiving section 72 for some distance, and then fits into the container cover receiving section 73.

In the condition in which the container front end cover 34Y is attached to the container cover receiving section 73; a rotary drive is input from the container driving section 91Y, which includes a driving motor and a driving gear, to the container gear 301Y, which is included in the container body 33Y, via a container driving gear 601Y. As a result, the container body 33Y gets rotary-driven in the direction of an arrow A illustrated in FIG. 4. As a result of the rotation of the container body 33Y; the toner stored inside the container body 33Y is conveyed from the left-hand side to the right-hand side with reference to FIG. 4 along the longitudinal direction of the container body 33Y by a spiral rib 302, which is formed in a helical manner on the inner surface of the container body 33Y. With that, the toner is supplied from the container front end side to the inside of the conveying nozzle 611Y.

Inside the conveying nozzle 611Y is disposed the conveying screw 614Y, which rotates in response to a rotary drive that is input from the container driving section 91Y to a conveying screw gear 605Y and which conveys the toner that has been supplied into the conveying nozzle 611Y. The downstream end in the conveying direction of the conveying nozzle 611Y is connected to the toner dropping passage 64Y. Thus, the toner conveyed by the conveying screw 614Y falls into the toner dropping passage 64Y due to its own weight and reaches the developing device 50Y (the second developing particle accommodating portion 54Y).

When any toner container 32 (32Y, 32M, 32C, or 32K) comes to the end of its product life (i.e., when the toner stored in any toner container 32 is almost completely consumed thereby leaving that toner container 32 empty), it is replaced with a new toner container 32. In the toner container 32 (32Y, 32M, 32C, or 32K), a gripper (handle) 303 is disposed at the opposite end portion of the container front end cover 34 in the longitudinal direction of that toner container 32. While replacing the toner container 32 (32Y, 32M, 32C, or 32K), the operator can hold the gripper 303 and pull out that toner container 32.

Meanwhile, there are times when a controller 90 calculates the amount of toner consumption based on the image information used in the exposing device 47 and accordingly determines to request the developing device 50Y to supply the toner. Alternatively, there are times when, based on the detection result of the toner density sensor 56Y, the controller 90 detects that the toner density has decreased in the developing device 50Y. In such cases, under the control of the controller 90, the container driving section 91Y is rotary-driven and the container body 33Y of the toner container 32Y and the conveying screw 614Y are rotated for a predetermined period of time so as to supply the toner to the developing device 50Y. Herein, the toner is supplied as a result of the rotation of the conveying screw 614Y that is disposed in the conveying nozzle 611. For that reason, if the number of rotations of the conveying screw 614Y is detected, then it also becomes possible to accurately calculate the amount of supplied toner from the toner container 32Y. When the cumulative amount of supplied toner that is calculated from the time of holding the toner container 32Y goes up to the amount of toner present in the toner container 32Y at the time of holding, then it is considered that there is no toner left in the toner container 32Y and a notification urging replacement of the toner container 32Y is displayed on a display unit of the copier 500.

Meanwhile, even if the operation of detecting a decrease in the toner density using the toner density sensor 56Y, the operation of performing a toner supplying operation, and the operation of determining whether or not the toner density is restored are repeated for a plurality of times; there are instances when the toner density sensor 56Y does not detect that the toner density is restored. In this case too, it is considered that there is no toner left in the toner container 32Y and a notification urging replacement of the toner container 32Y is displayed on the display unit of the copier 500.

Figure 7:
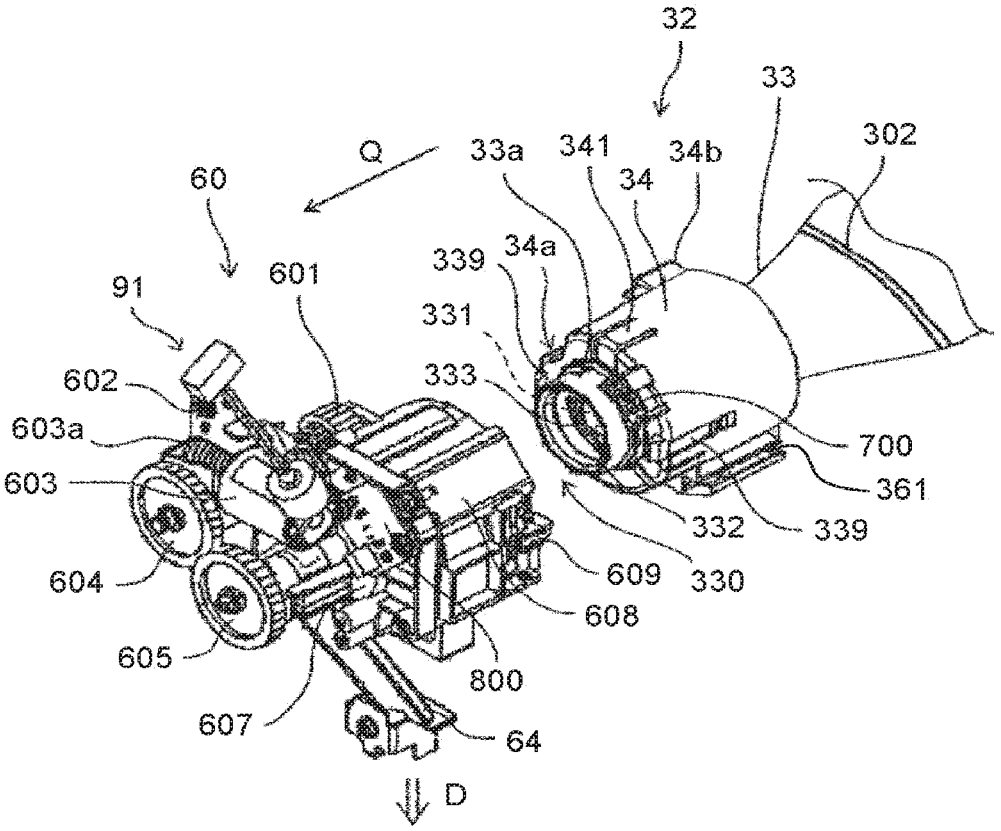
FIG. 7 is an explanatory perspective view of the toner replenishing device and the toner container according to the first embodiment before the toner container is attached to the toner replenishing device.

FIG. 7 is an explanatory perspective view of the toner replenishing device 60 before the toner container 32 is attached to it, and of the end portion at the container front end side of the toner container 32. As illustrated in FIG. 7, the toner replenishing device 60 includes a nozzle holder 607 that fixes the conveying nozzle 611 to a frame 602 of the main body of the copier 500. To the nozzle holder 607 is fixed the setting cover 608. Moreover, to the nozzle holder 607 is fixed the toner dropping passage 64 that is laid to enable communication with the inside of the conveying nozzle 611 from beneath the conveying nozzle 611.

Furthermore, to the frame 602 is fixed the container driving section 91 that includes a driving motor 603, the container driving gear 601, and a worm gear 603*a* which transmits the rotary drive of the driving motor 603 to the rotational axis of the container driving gear 601. Moreover, to the rotational axis of the container driving gear 601 is fixed a drive transmitting gear 604 that engages with the conveying screw gear 605 fixed to the rotational axis of the conveying screw 614. With such a configuration, by rotary-driving the driving motor 603, it becomes possible to rotate the toner container 32 via the container driving gear 601 and the container gear 301. Moreover, along with rotating the toner container 32, it becomes possible to rotate the conveying screw 614 via the drive transmitting gear 604 and the conveying screw gear 605.

Given below is the explanation of the conveying nozzle 611 of the toner replenishing device 60.

Figure 18:
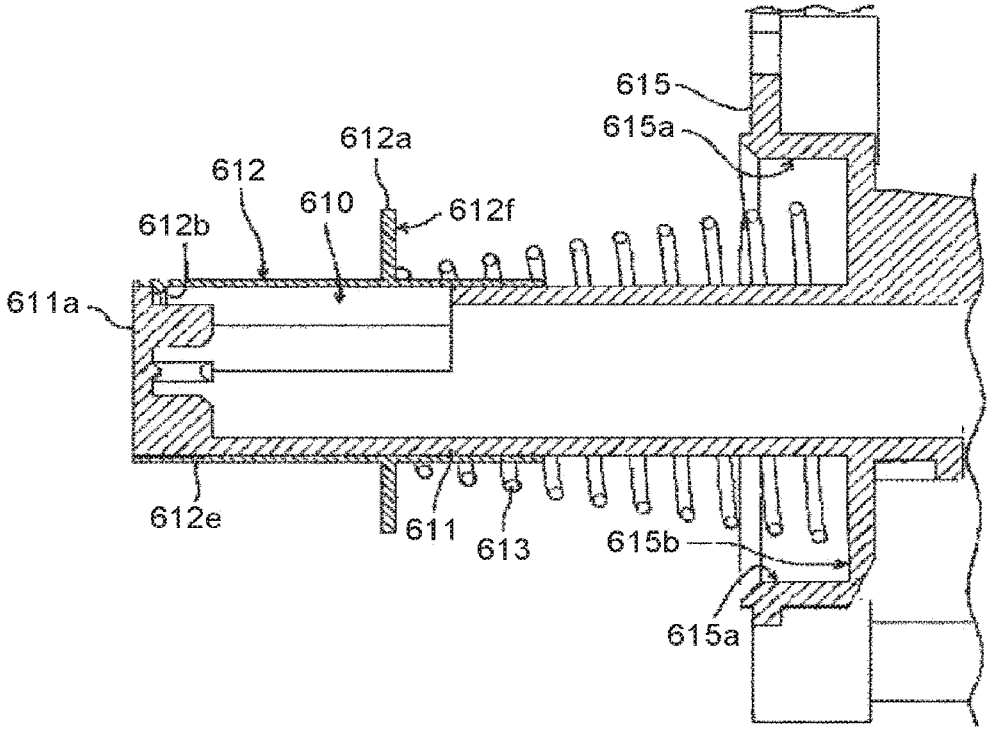
FIG. 18 is an explanatory cross-sectional view of the neighborhood of a conveying nozzle of the toner replenishing device.
Figure 19:
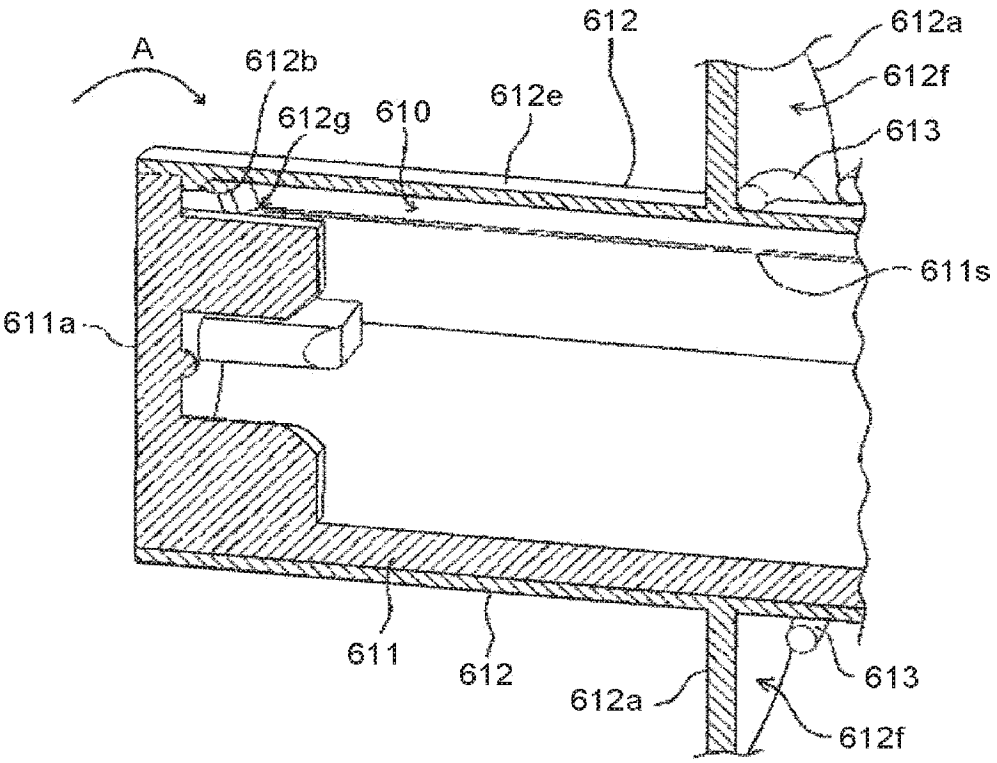
FIG. 19 is an explanatory cross-sectional perspective view of the neighborhood of a nozzle opening of the conveying nozzle.
Figure 20:
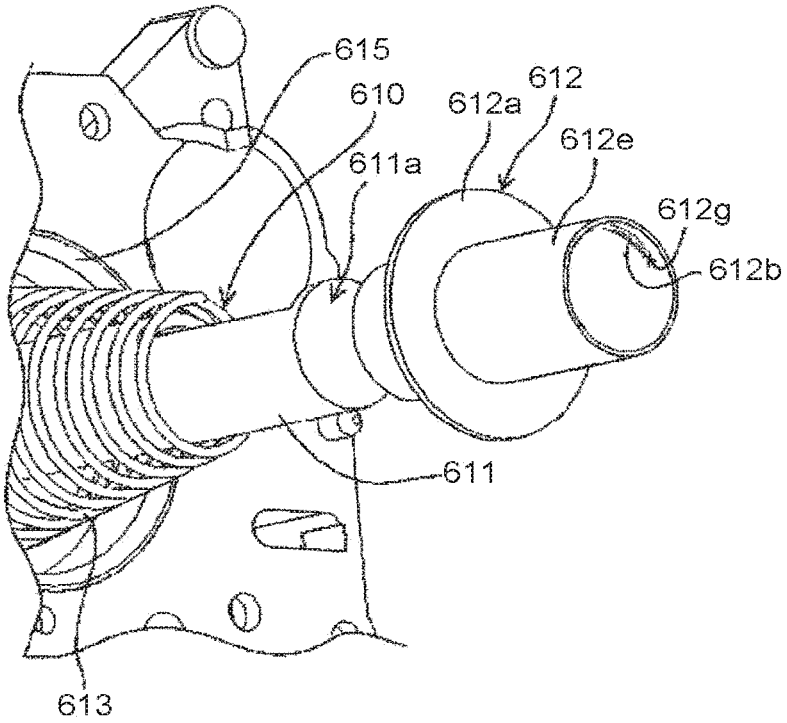
FIG. 20 is an explanatory perspective view of the neighborhood of the conveying nozzle when viewed from the nozzle front end after removing the nozzle shutter.
Figure 21:
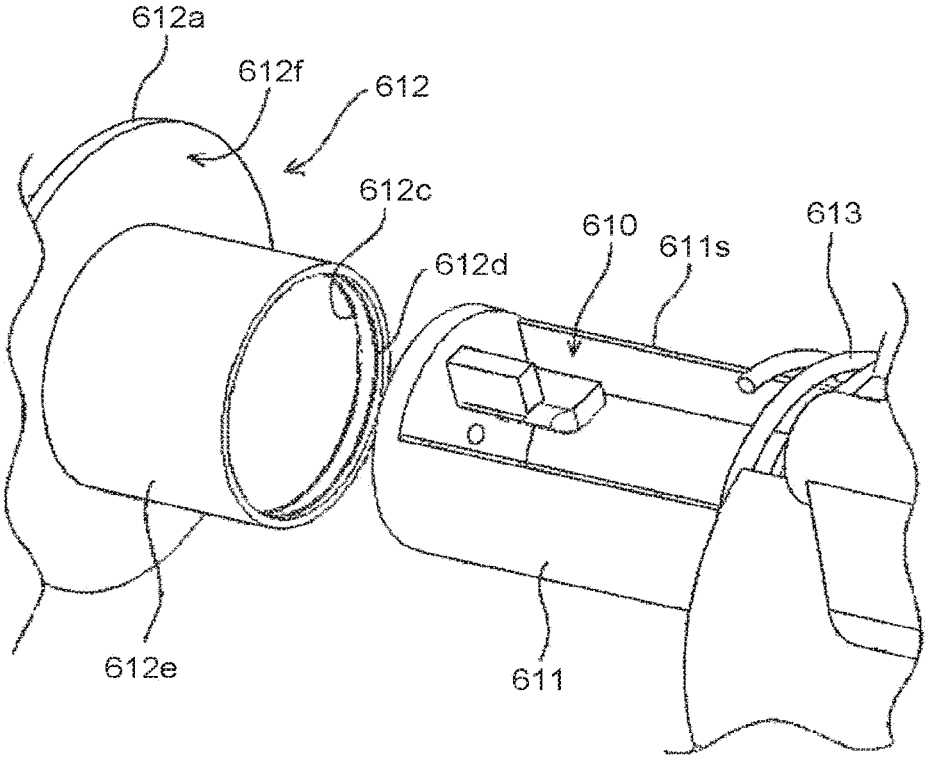
FIG. 21 is an explanatory perspective view of the neighborhood of the nozzle opening after removing the nozzle shutter.

FIG. 18 is an explanatory cross-sectional view of the neighborhood of the conveying nozzle 611 in the toner replenishing device 60. FIG. 19 is an explanatory cross-sectional view of a nozzle shutter 612. FIG. 20 is an explanatory perspective view of the nozzle shutter 612 when viewed from the side of attaching the toner container 32 (i.e., viewed from the nozzle front end). FIG. 21 is an explanatory perspective view of the nozzle shutter 612 when viewed from the side of the toner replenishing device 60 (i.e., viewed from the nozzle base end).

Figure 8:
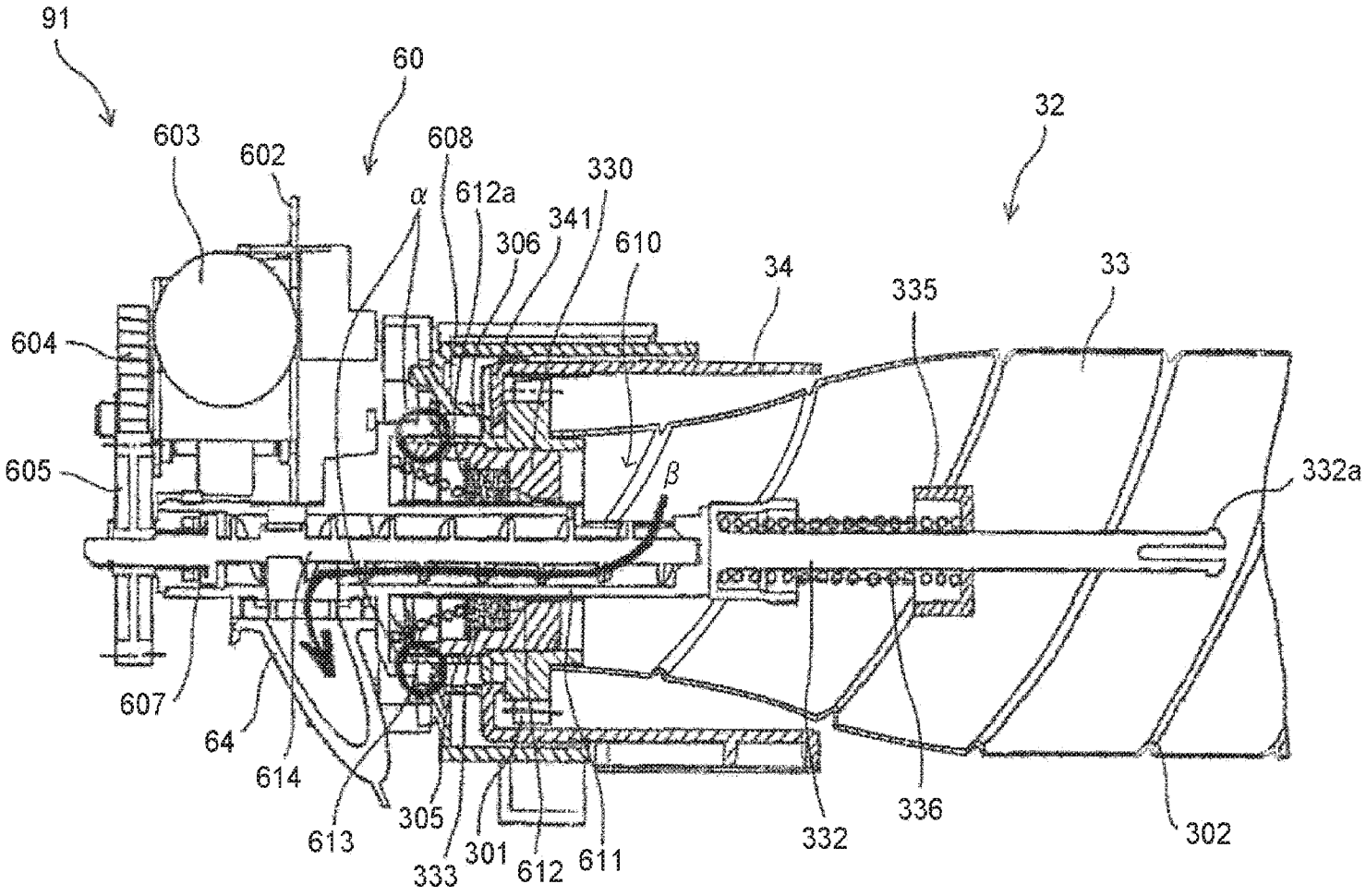
FIG. 8 is an explanatory cross-sectional view of the toner replenishing device and the toner container according to the first embodiment after the toner container is attached to the toner replenishing device.

At the base of the conveying nozzle 611 is formed a container setting section 615 that fits with a container opening 33*a*, when the toner container 32 is attached to the toner replenishing device 60. The container setting section 615 is cylindrical in shape, and an inner surface 615*a* thereof fits with the outer surface of the container opening 33*a* in a slidable manner. As a result of that fitting, positioning of the toner container 32 with respect to the toner replenishing device 60 is done in the planar direction perpendicular to the rotational axis of the toner container 32. Meanwhile, while the toner container 32 is rotating, the outer surface of the container opening 33*a* serves as a rotational axis portion and the container setting section 615 functions as a bearing. At that time, the outer surface of the container opening 33*a* comes in slidable contact with the container setting section 615. With reference to FIG. 8, "α" represents the positions at which the positioning of the toner container 32 is done with respect to the toner replenishing device 60.

Figure 15:
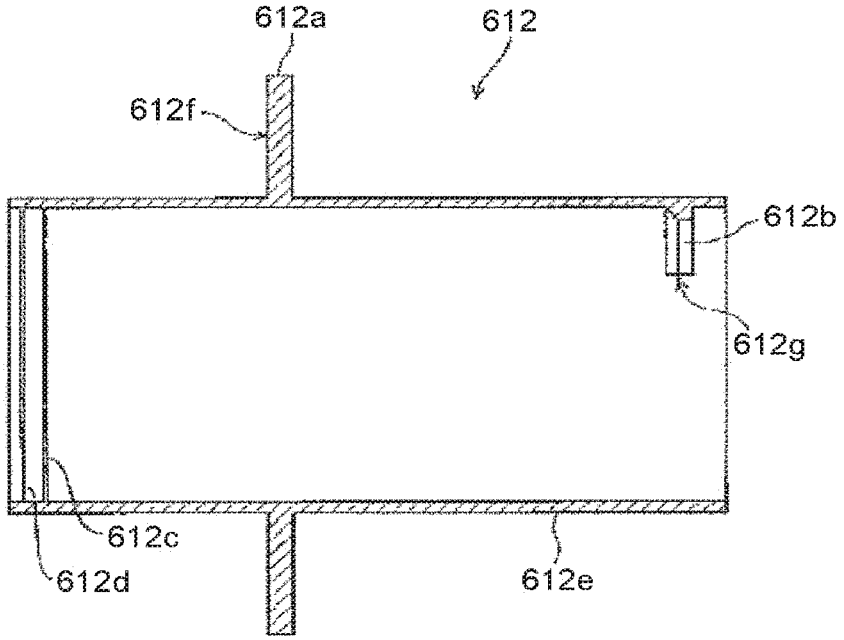
FIG. 15 is an explanatory cross-sectional view of a nozzle shutter according to all embodiments.
Figure 16:
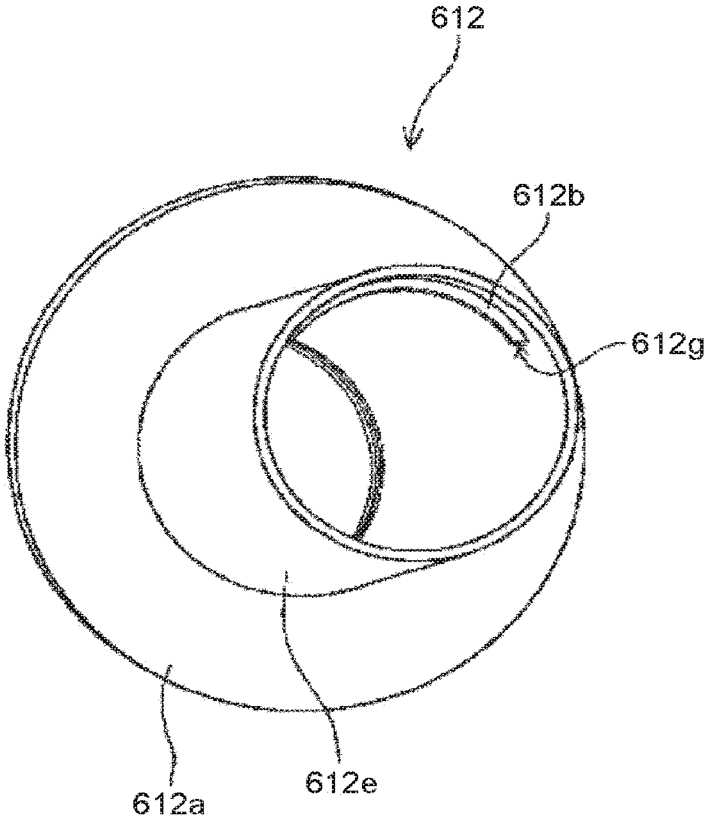
FIG. 16 is an explanatory perspective view of the nozzle shutter, which is illustrated in FIG. 15, when viewed from the nozzle front end.
Figure 17:
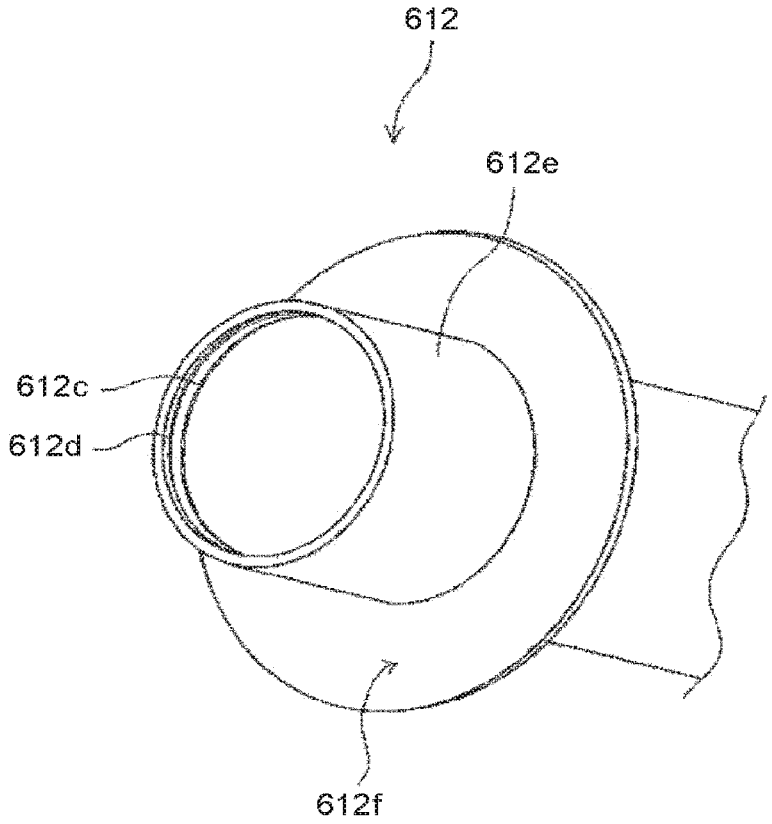
FIG. 17 is an explanatory perspective view of the nozzle shutter, which is illustrated in FIG. 15, when viewed from the nozzle base end.

As illustrated in FIG. 15, the nozzle shutter 612 includes a nozzle shutter flange 612*a* serving as a butting portion and includes a nozzle shutter tube 612*e*. In some part of the top portion of the inner surface of the nozzle shutter tube 612*e* in the neighborhood of the nozzle front end is formed a first inner rib 612*b*. On the other hand, on the inner surface of the nozzle shutter tube 612*e* in the neighborhood of the nozzle base end are formed a second inner rib 612*c* and a third inner rib 612*d* in a lapping manner around the inner surface.

The length in the circumferential direction on the inner surface of the first inner rib 612*b* is such that, when the nozzle shutter 612 is attached to the conveying nozzle 611, the first inner rib 612*b* can fit into the width in the circumferential direction of a nozzle opening 610.

Figure 1:
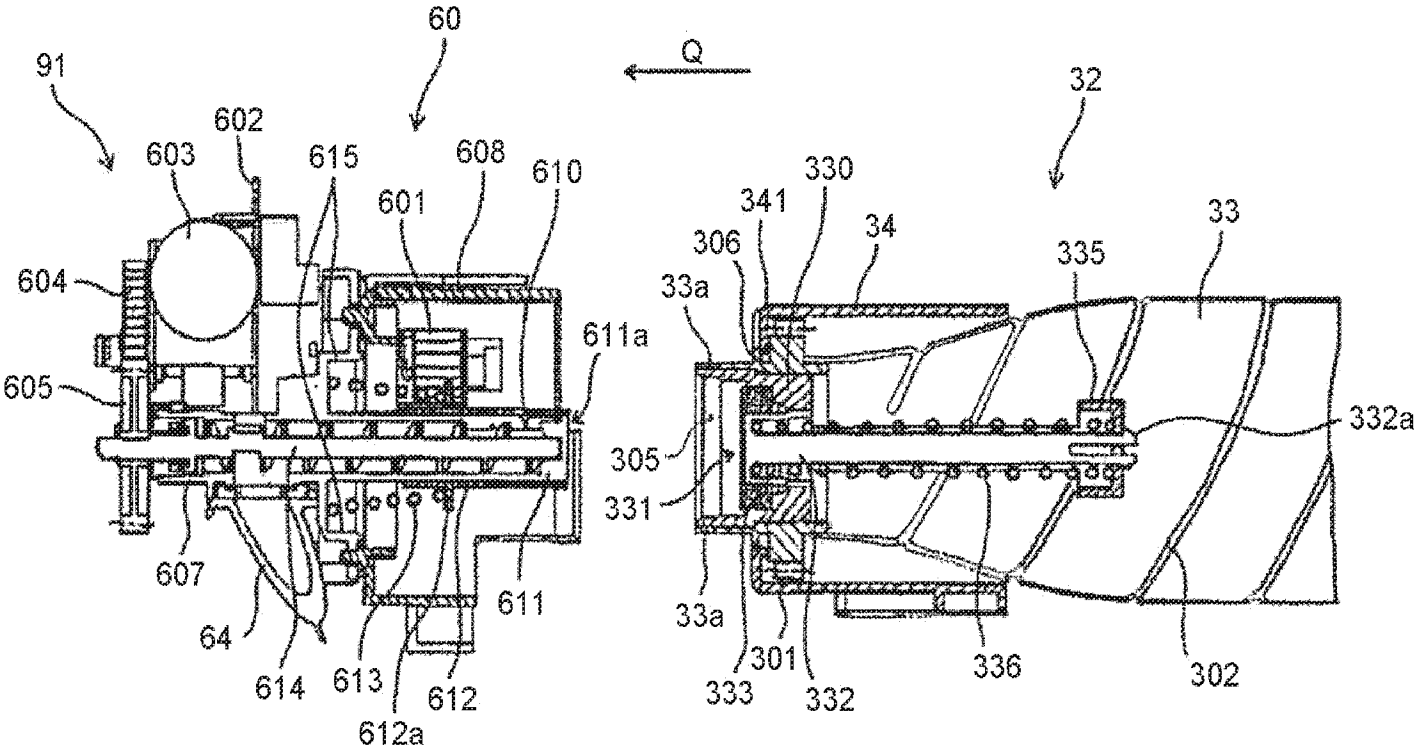
FIG. 1 is an explanatory cross-sectional view of a toner replenishing device and a toner container according to a first embodiment before the toner container is attached to the toner replenishing device.

As illustrated in FIGS. 1 and 18, the end portion at the nozzle base end of a nozzle shutter spring 613, which serves as a biasing member, runs into an end surface 615*b* of the container setting section 615. Moreover, the end portion at the nozzle front end of the nozzle shutter spring 613 runs into a nozzle shutter spring receiving surface 612*f* of the nozzle shutter flange 612*a*. In the compressed condition of the nozzle shutter spring 613, the nozzle shutter 612 is subjected to the biasing force in the direction of coming off from the nozzle front end (the left-side direction) illustrated in FIG. 18. However, since the first inner rib 612*b* runs into the edge on the nozzle front end of the nozzle opening 610, that is, runs into the upper part of the inner side wall surface of a front end 611*a* of the conveying nozzle 611; a situation is prevented from occurring in which the nozzle shutter 612 moves in the direction of coming off from the conveying nozzle 611 by a greater extent as compared to the condition illustrated in FIG. 18. Due to such contact of the first inner rib 612*b* and due to the biasing force of the nozzle shutter spring 613, positioning of the nozzle shutter 612 with respect to the conveying nozzle is done in the direction of the rotational axis.

Given below is the detailed explanation regarding the toner containers 32 (32Y, 32M, 32C, and 32K) and the toner replenishing devices 60 (60Y, 60M, 60C, and 60K). As described above, except for the point that the color of the used toner is different in each toner container 32 (32Y, 32M, 32C, and 32K) and each toner replenishing device 60 (60Y, 60M, 60C, and 60K), the configurations are substantially identical. Hence, the following explanation is given without writing the toner color referring characters of Y, M, C, and K.

Figure 6:
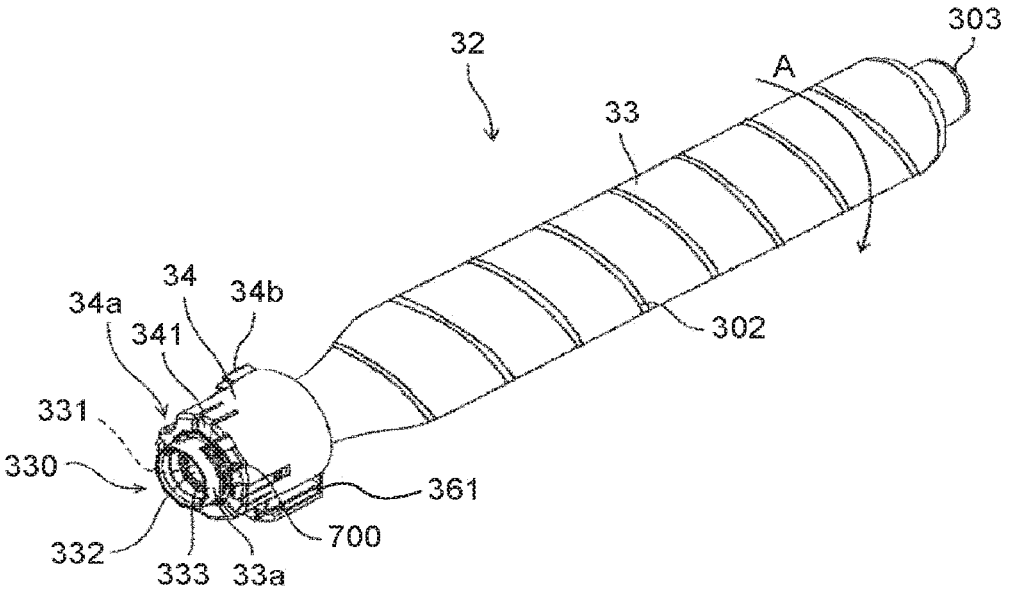
FIG. 6 is an explanatory perspective view of the toner container according to the first embodiment.

FIG. 6 is an explanatory perspective view of the toner container 32 according to the first embodiment. FIG. 1 is an explanatory cross-sectional view of the toner replenishing device 60 before the toner container 32 is attached to it, and of the end portion at the container front end side of the toner container 32. FIG. 8 is an explanatory cross-sectional view of the toner replenishing device 60 after the toner container 32 is attached to it, and of the end portion on the container front end side of the toner container 32.

The toner replenishing device 60 includes the conveying nozzle 611 that in turn includes the conveying screw 614. Besides, the toner replenishing device 60 includes the nozzle shutter 612. In a container-unattached condition in which the toner container 32 is yet to be fit (i.e., in the condition illustrated in FIG. 1 and FIG. 7), the nozzle shutter 612 shuts the nozzle opening 610 that is formed on the conveying nozzle 611. On the other hand, in a container-attached condition in which the toner container 32 has been fit (i.e., in the condition illustrated in FIG. 8), the nozzle shutter 612 opens the nozzle opening 610. Meanwhile, in the center of the apical surface of the toner container 32 is formed a nozzle receiving opening 331 in which the conveying nozzle 611 is inserted in the container-attached condition. In other words, the nozzle receiving opening 331 can receive the conveying nozzle 611. Moreover, a container shutter 332 is disposed that shuts the nozzle receiving opening 331 in the container-unattached condition.

Firstly, the explanation is given regarding the toner container 32.

Figure 9:
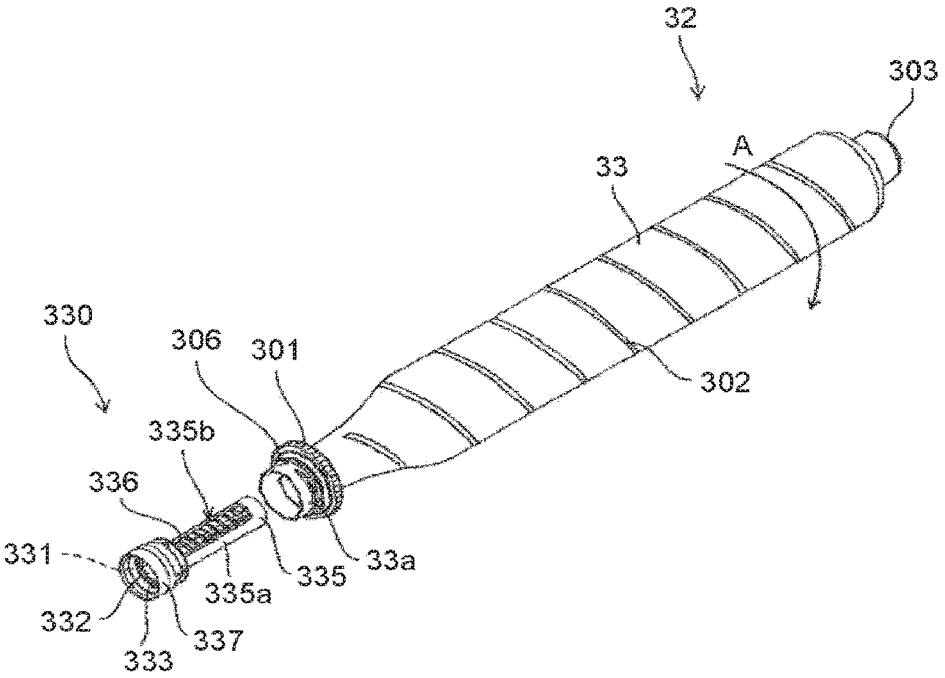
FIG. 9 is an explanatory perspective view of a condition of the toner container according to the first embodiment in which a nozzle receiver has been removed from a container body of the toner container.
Figure 10:
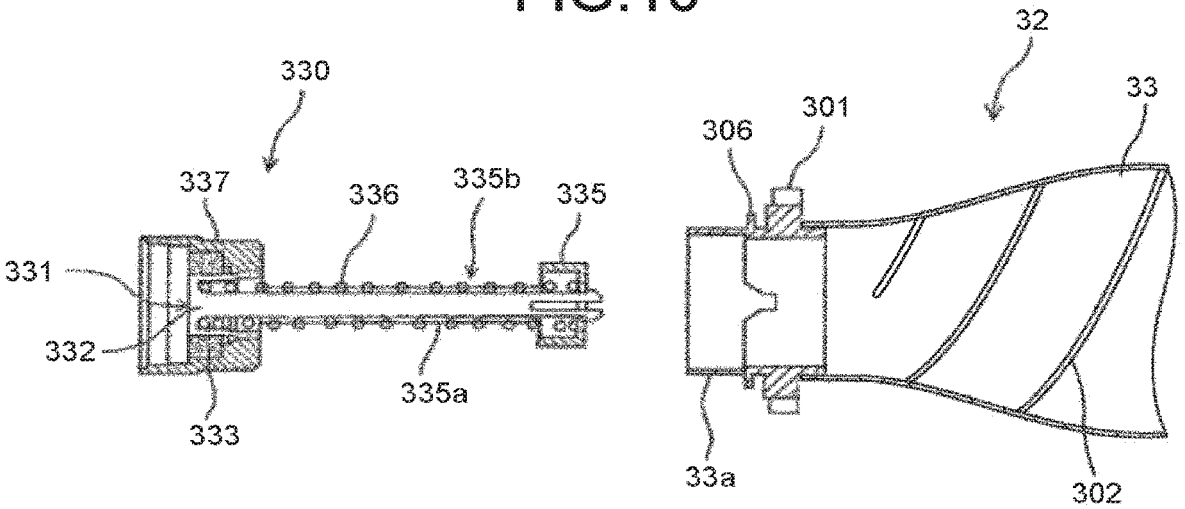
FIG. 10 is an explanatory cross-sectional view of the condition of the toner container according to the first embodiment in which the nozzle receiver has been removed from the container body of the toner container.
Figure 11:
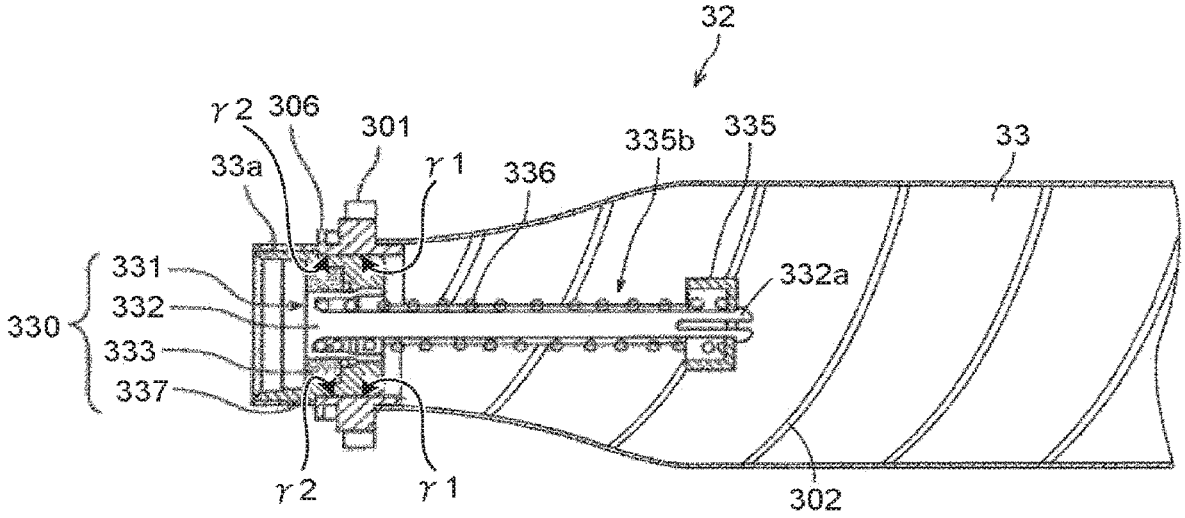
FIG. 11 is an explanatory cross-sectional view of a condition of the toner container according to the first embodiment in which the nozzle receiver has been attached to the container body of the toner container from the condition illustrated in FIG. 10.

As described above, the toner container 32 mainly includes the container body 33 and the container front end cover 34. FIG. 9 is an explanatory perspective view of a condition of the toner container 32 in which a nozzle receiver 330 serving as a nozzle insertion member has been removed from the container body 33. FIG. 10 is an explanatory cross-sectional view of the condition of the toner container 32 in which the nozzle receiver 330 has been removed from the container body 33. FIG. 11 is an explanatory cross-sectional view of a condition of the toner container 32 in which the nozzle receiver 330 has been attached to the container body 33 from the condition illustrated in FIG. 10. As illustrated in FIGS. 9 to 11, the toner container 32 from which the container front end cover 34, which functions as the container cover, is removed, includes the container body 33 and includes the nozzle receiver 330 that constitutes the nozzle receiving opening 331.

The container body 33 is substantially cylindrical in shape and is configured to be rotatable around the central axis of the cylindrical shape as the rotational axis. In the following explanation, the direction parallel to the rotational axis is called "rotational axis direction". Moreover, in the toner container 32, the side in the rotational axis direction at which the nozzle receiving opening 331 is formed (i.e., the side at which the container front end cover 34 is present) is called "container front end side". Furthermore, in the toner container 32, the side at which the gripper 303 is disposed (i.e., the opposite side to the container front end side) is called "container rear end side". Hereinafter, the terms "the container front end side" and "the container rear end side" are referred to in the direction in which any members are attached to the toner container 32. Meanwhile, the longitudinal direction of the toner container 32 is the rotational axis direction. In the condition in which the toner container 32 is attached to the toner replenishing device 60, the rotational axis direction points to the horizontal direction. The portion of the container body 33 more toward the container rear end side than the container gear 301 has a greater outer diameter as compared to the container front end side. On the inner surface of the container body 33 is formed the spiral rib 302. When the container body 33 rotates in the direction of the arrow A illustrated in FIG. 9, a conveying force acts in such a way that the toner inside the container body 33 is conveyed from one side (the container rear end side) to the other side (the container front end side) in the rotational axis direction due to the action of the spiral rib 302.

The container body 33 is configured in such a way that, when the container body 33 rotates in the direction of the arrow A illustrated in FIG. 9, the spiral rib 302 guides the toner to the nozzle opening 610 and the nozzle receiving opening 331. That is because, the inner side wall surface in the neighborhood of the opening is continuous with the cylindrical internal shape in the main body portion on one side. And the inner side wall surface is a side surface having a conic shape; the toner gradually moves up the conic side surface toward the opening as a result of being guided by the spiral rib 302.

In the portion of the container body 33 that is more toward the container front end side than the conic-shaped portion, the container gear 301 functioning as a gear is formed. And the container front end cover 34 includes a gear exposing hole 34*a* from which a portion of the container gear 301 gets exposed, in the condition in which the container front end cover 34 is attached to the container body 33. Then, once the toner container 32 is attached to the toner replenishing device 60, the container gear 301 that is exposed from the gear exposing hole 34*a* engages with the container driving gear 601 of the toner replenishing device 60.

In the portion of the container body 33 that is more toward the container front end side than the container gear 301, the container opening 33*a* having a cylindrical shape is formed. Then, if a nozzle receiver fixing portion 337 of the nozzle receiver 330 is press-fit in the container opening 33*a*, it becomes possible to fix the nozzle receiver 330 to the container body 33. However, the method of fixing the nozzle receiver 330 is not limited to press fitting. Alternatively, the nozzle receiver 330 can be fixed using an adhesive agent or using screws.

In the toner container 32, when the toner is filled in the container body 33 from the opening of the container opening 33*a*, the nozzle receiver 330 is fixed to the container opening 33*a* of the container body 33.

In the container opening 33*a*, a cover hooked portion 306 is formed at the end portion on the side of the container gear 301. To the toner container 32 (the container body 33) in the condition illustrated in FIG. 9, the container front end cover 34 is attached from the container front end side (with reference to FIG. 9, from the lower left side). As a result, the container body 33 passes through the container front end cover 34 in the rotational axis direction, and a cover hook 341 disposed in the upper part of the container front end cover 34 gets hooked in the cover hooked portion 306. Herein, the cover hooked portion 306 is formed in a lapping manner around the outer surface of the container opening 33*a*. When the cover hook 341 gets hooked, the container body 33 and the container front end cover 34 get attached in a relatively rotatable manner.

Meanwhile, the container body 33 is formed by implementing the biaxial stretch blow molding method (see Japanese Patent Application Laid-open No. 2003-241496, Japanese Patent Application Laid-open No. 2005-221825, and Japanese Patent No. 4342958). The biaxial stretch blow molding method generally includes preform molding and stretch blow molding. During preform molding, injection molding of a resin is performed to cast a test-tube-shaped preform. As a result of performing injection molding; the container opening 33*a*, the cover hooked portion 306, and the container gear 301 are formed at the opening of the test-tube-shaped preform. During stretch blow molding; the preform, which has been cooled after preform injection molding and which has been removed from the cast, is heated and softened before being blow-molded and stretched.

In the container body 33 according to the first embodiment, the portion on the container rear end side than the container gear 301 is molded by performing stretch blow molding. That is, the portion including the spiral rib 302, and the gripper 303 are molded by performing stretch blow molding.

In the container body 33, the constituent elements such as the container opening 33*a* and the cover hooked portion 306 that are present more toward the container front end side than the container gear 301 take the shape of the preform that is formed by injection molding. Hence, those constituent elements can be molded with accuracy. In contrast, the portion including the conveying vane 304 and the spiral rib 302, and the gripper 303 are formed firstly by injection molding and are then stretched during stretch blow molding. Hence, the molding accuracy is inferior as compared to preform molding.

Given below is the explanation regarding the nozzle receiver 330 that is fixed to the container body 33.

Figure 12:
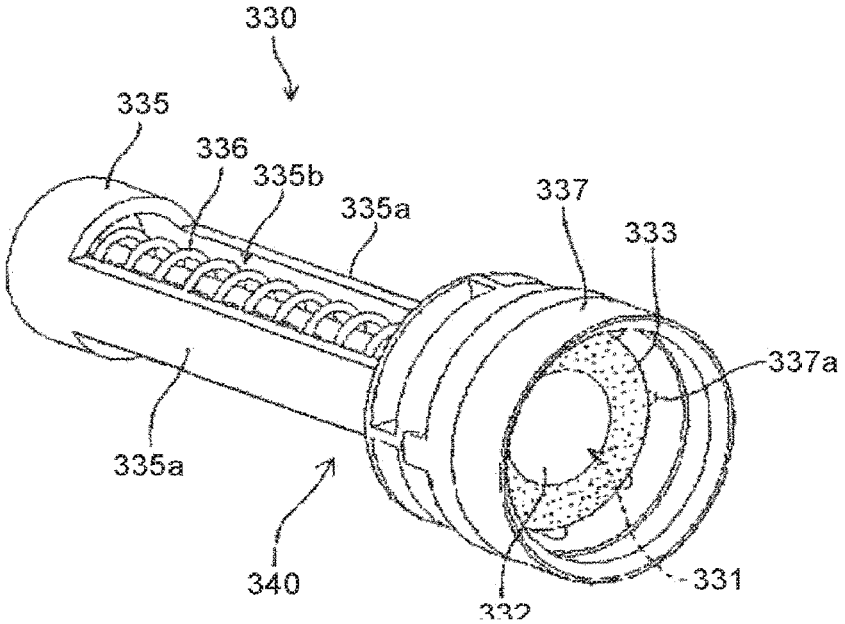
FIG. 12 is an explanatory perspective view of the nozzle receiver when viewed from the container front end side according to all embodiments.
Figure 13:
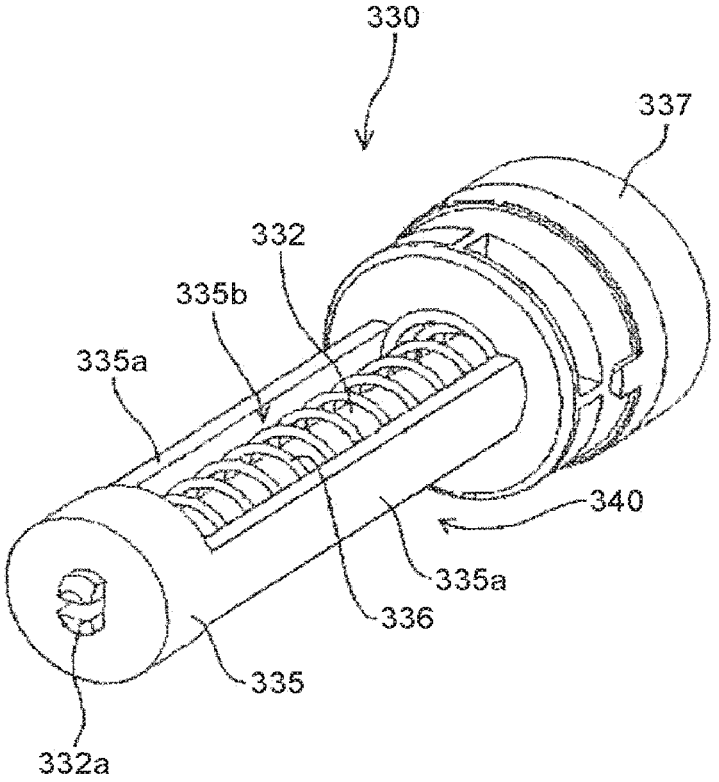
FIG. 13 is an explanatory perspective view of the nozzle receiver when viewed from the container rear end side according to all embodiments.
Figure 14:
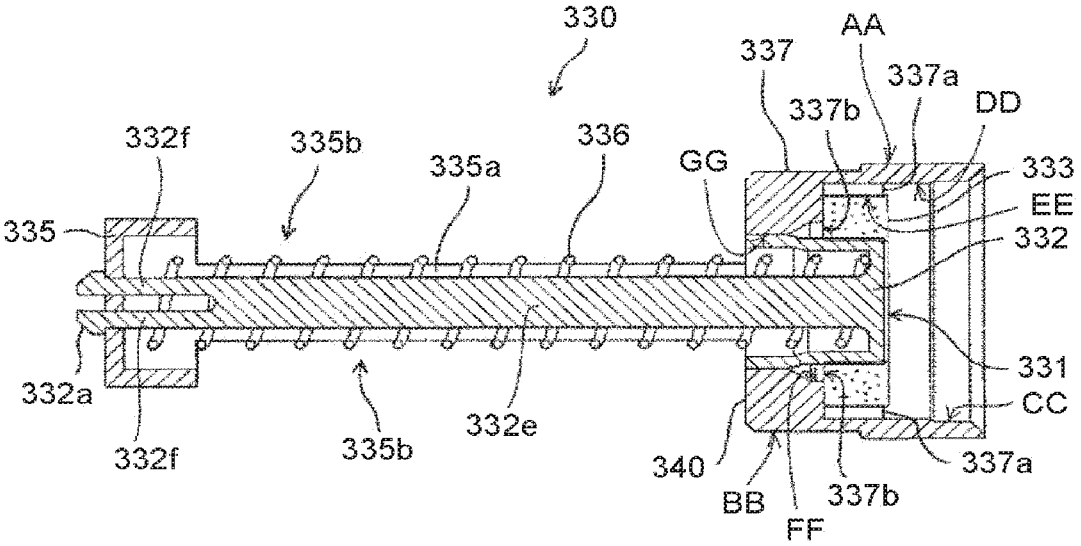
FIG. 14 is a transverse sectional view of the nozzle receiver in the condition illustrated in FIG. 13.

FIG. 12 is an explanatory perspective view of the nozzle receiver 330 when viewed from the container front end side. FIG. 13 is an explanatory perspective view of the nozzle receiver 330 when viewed from the container rear end side. FIG. 14 is a transverse sectional view of the nozzle receiver 330 when viewed in profile.

The nozzle receiver 330 includes a container shutter supporter 340, the container shutter 332, a container seal 333, a container shutter spring 336, and the nozzle receiver fixing portion 337. The container shutter supporter 340 includes a shutter rear end supporting portion 335, shutter side supporting portions 335*a*, and the nozzle receiver fixing portion 337. The container shutter spring 336 is made of a coil spring.

The container shutter 332 includes a front end cylindrical portion 332*c*, a sliding section 332*d*, a guiding rod 332*e*, and a shutter hook 332*a*. The front end cylindrical portion 332*c* is that portion of the container front end side which fits tightly to the cylindrical opening (the nozzle receiving opening 331) of the container seal 333. The sliding section 332*d* is a cylindrical section that is formed more on the container rear end side than the front end cylindrical portion 332*c*, that has a slightly greater outer diameter than the front end cylindrical portion 332*c*, and that slides on the inner surface of the pair of shutter side supporting portions 335*a*. The guiding rod 332*e* is a column erected from the inside of the front end cylindrical portion 332*c* toward the container rear end side; and is a rod-like portion that, when inserted inside the coil of the container shutter spring 336, guides the container shutter spring 336 to prevent buckling thereof. The shutter hook 332*a* is disposed at the opposite end of the erected base of the guiding rod 332*e* and has a pair of claws for preventing the container shutter 332 from falling off from the container shutter supporter 340.

As illustrated in FIG. 14, the front end portion of the container shutter spring 336 runs into the inner surface of the front end cylindrical portion 332*c*, while the rear end portion of the container shutter spring 336 runs into the wall of the shutter rear end supporting portion 335. At that time, since the container shutter spring 336 is in a compressed state, the container shutter 332 receives a biasing force in the direction away from the shutter rear end supporting portion 335 (with reference to FIG. 14, in the right-hand direction or in the container front end side direction). However, the shutter hook 332*a*, which is formed in the end portion at the container rear end side of the container shutter 332, gets hooked to the outer wall of the shutter rear end supporting portion 335. As a result, the container shutter 332 is prevented from moving in the direction farther away from the shutter rear end supporting portion 335 than the condition illustrated in FIG. 14. In this way, due to the hooking of the shutter hook 332*a* against the shutter rear end supporting portion 335 and due to the biasing force of the container shutter spring 336; positioning of the front end cylindrical portion 332*c* and the container seal 333, which fulfill the toner leakage preventing function of the container shutter 332, is done with respect to the container shutter supporter 340 in the axial direction. Herein, the front end cylindrical portion 332*c* and the container shutter supporter 340 are positioned in a tightly-adhering relationship with each other, thereby enabling prevention of toner leakage.

The nozzle receiver fixing portion 337 is tubular in shape in which the diameter of the outer surface and the diameter of the inner surface goes on decreasing in a stepwise manner toward the container rear end side. That is, the diameters decrease in sequence from the container front end side to the container rear end side. On the outer surface of the nozzle receiver fixing portion 337 are present two outer diameter portions (an outer surface AA and an outer surface BB in that order from the container front end side). On the inner diameter of the nozzle receiver fixing portion 337 are present five inner diameter portions (an outer surface CC, an outer surface DD, an outer surface EE, an outer surface FF, and an outer surface GG in that order from the container front end side). The boundary between the outer surface AA and the outer surface BB on the outer surface is linked by a tapered surface. In an identical manner, the boundary between the fourth inner diameter portion FF and the fifth inner diameter portion GG on the inner surface is also linked by a tapered surface. The inner diameter portion FF on the inner surface and the tapered surface linked to the inner diameter portion FF correspond to a seal jam preventing space 337*b* (described later); while the ridge lines of those surfaces correspond to a pentagonal cross-section (described later).

As illustrated in FIGS. 12 to 14, the pair of shutter side supporting portions 335*a*, which are positioned opposite to each other and which are formed in a flake-like manner by cutting a cylinder along the axial direction, protrude from the nozzle receiver fixing portion 337 toward the container rear end side. The end portions in the container rear end side of the two shutter side supporting portions 335*a* are linked to the shutter rear end supporting portion 335 that is cup-shaped with a hole formed in the center of its bottom. Since the two shutter side supporting portions 335*a* are positioned opposite to each other, a columnar space 51 is formed therebetween that is recognizable by the inner wall cylindrical surfaces of the two shutter side supporting portions 335*a* and by a virtual circular surface extending from the inner wall cylindrical surfaces. The nozzle receiver fixing portion 337 includes the inner diameter portion GG, which is the fifth inner diameter from the front end, as the cylindrical inner surface having the same inner diameter to the diameter of the columnar space Si. The sliding section 332*d* of the container shutter 332 slides over the columnar space Si and the cylindrical inner surface GG. The third inner surface EE of the nozzle receiver fixing portion 337 is a virtual circumferential surface through which pass the longitudinal apices of nozzle shutter positioning ribs 337*a*, which serve as butted portions arranged at regular intervals having 45° distribution. The container seal 333 having a quadrangular cylindrical (a circular tube-like) cross-section (i.e., the cross-section illustrated in the cross-sectional views in FIG. 14) is disposed corresponding to the inner surface EE. The container seal 333 is fixed using an adhesive agent or a double-faced tape to the vertical surface linking the third inner surface EE to the fifth inner surface FF. The exposed surface on the opposite side at which the container seal 333 is pasted (i.e., the surface on the right-hand side with reference to FIG. 14) forms the inside bottom of the cylindrical opening of the nozzle receiver fixing portion 337 (container opening) having the cylindrical shape.

Meanwhile, as illustrated in FIG. 14, the seal jam preventing space 337*b* (insertion jam preventing space) is formed corresponding to the inner surface FF of the nozzle receiver fixing portion 337 and the tapered surface linked to the inner surface FF. The seal jam preventing space 337*b* is a ring-like enclosed space surrounded by three different members. That is, the seal jam preventing space 337*b* is a ring-like space surrounded by the inner surface of the nozzle receiver fixing portion 337 (the fourth inner surface FF and the tapered surface linked thereto); by the vertical surface on the side of pasting the container seal 333; and by the outer surface from the front end cylindrical portion 332*c* to the sliding section 332*d* of the container shutter 332. Moreover, the cross-section of this ring-like space (the cross-sectional illustrated in FIG. 14) is pentagonal in shape. The inner surface of the nozzle receiver fixing portion 337 and the end surface of the container seal 333 is 90°; while the angle between the outer surface of the container shutter 332 and the end surface of the container seal is also 90°.

Given below is the explanation of the functions of the seal jam preventing space 337*b*. When the container shutter 332 moves in the container rear end side direction from the condition of shielding the nozzle receiving opening 331; the inner surface of the container seal 333 slides with the front end cylindrical portion 332*c* of the container shutter 332. For that reason, the inner surface of the container seal 333 is pulled by the container shutter 332 and undergoes elastic deformation to move in the container rear end side direction.

At that time, in case the seal jam preventing space 337*b* is absent and if the vertical surface linked from the third inner surface (i.e., the surface for attaching the container seal 333) is orthogonal to the fifth inner surface GG, then there is a possibility of the following condition occurring. That is, there is a possibility that the elastically-deformed portion of the container seal 333 gets sandwiched and jammed between the inner surface of the nozzle receiver fixing portion 337, which slides with the container shutter 332, and the outer surface of the container shutter 332. If the container seal 333 gets jammed in the portion within which the nozzle receiver fixing portion 337 and the container shutter 332 slide against each other, that is, if the container seal 333 gets jammed between the front end cylindrical portion 332*c* and the inner surface GG; then the container shutter 332 gets locked with respect to the nozzle receiver fixing portion 337. As a result, opening and closing of the nozzle receiving opening 331 cannot be performed.

In contrast, in the first embodiment, the nozzle receiver 330 has the seal jam preventing space 337*b* formed on the inner perimeter thereof. The inner diameter of the seal jam preventing space 337*b* (the inner diameter of the inner surface FF and the inner diameter of each tapered surface linked to the inner surface FF) is smaller than the outer diameter of the container seal 333. For that reason, the entire container seal 333 never enters the seal jam preventing space 337*b*. Moreover, there is a limit to the area of the container seal 333 which gets pulled and undergoes elastic deformation, and the container seal 333 itself goes back to the original state before getting jammed at the inner surface GG. Due to that action, it becomes possible to prevent a situation in which opening and closing of the nozzle receiving opening 331 cannot be performed because the container shutter 332 gets locked with respect to the nozzle receiver fixing portion 337.

As illustrated in FIGS. 12 and 14, at portions that are on the inner surface of the nozzle receiver fixing portion 337 and that are adjacent to the outer perimeter of the container seal 333, a plurality of nozzle shutter positioning ribs 337*a* serving as butted portions are formed in a radially extending manner. As illustrated in FIG. 14, in the condition in which the container seal 333 is fixed to the nozzle receiver fixing portion 337, the vertical surface at the container front end side of the container seal 333 protrudes in the rotational axis direction slightly more as compared to the end portion at the container front end side of the nozzle shutter positioning ribs 337*a*. As illustrated in FIG. 8, when the toner container 32 is attached to the toner replenishing devices 60, the nozzle shutter flange 612*a* of the nozzle shutter 612 in the toner replenishing device 60 gets biased by the nozzle shutter spring 613 and flattens out the protruded portion of the container seal 333. Moreover, the nozzle shutter flange 612*a* proceeds further; covers the front end surface of the container seal 333 from the nozzle receiving opening 331 of the container seal 333 that had run into the container front end side of the nozzle shutter positioning ribs 337*a*; and shields the front end surface of the container seal 333 from the outside of the toner container 32. As a result, at the time of fitting the toner container 32, it becomes possible to ensure sealability around the conveying nozzle 611 at the nozzle receiving opening 331 as well as to prevent toner leakage from occurring.

When the reverse side of the nozzle shutter spring receiving surface 612*f* of the nozzle shutter flange 612*a*, which is biased to the nozzle shutter spring 613, runs into the nozzle shutter positioning ribs 337*a*; the position in the rotational axis direction of the nozzle shutter 612 is determined with respect to the toner container 32. As a result, the positional relationship in the rotational axis direction of the end surface at the container front end side of the container seal 333 and the end surface at the container front end side of a front end opening 305 (i.e., as described later, the internal space of the cylindrical nozzle receiver fixing portion 337 that is disposed inside the container opening 33*a*) with the nozzle shutter 612 is determined.

As illustrated in FIG. 8, when the toner container 32 is attached to the toner replenishing device 60; the nozzle shutter 612, which functions as a butting portion, and the nozzle shutter spring 613, which functions as a biasing member, are housed in the front end opening that is a cylindrical internal space. For the purpose of achieving the abovementioned configuration, given below is the explanation regarding the relationship between the diameter of the outer surface of the container opening 33*a*, the internal diameter of the nozzle receiver fixing portion 337, and the diameters of configurations such as the container setting section 615 of the toner replenishing device 60.

Figure 41:
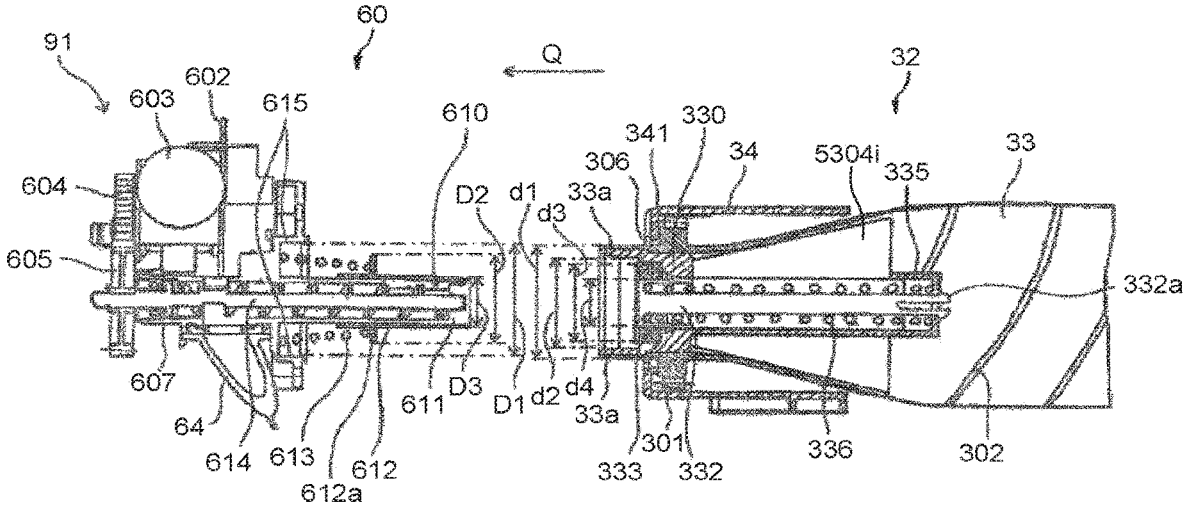
FIG. 41 is an explanatory cross-sectional view of the toner replenishing device and the toner container before the toner container is attached to the toner replenishing device.

FIG. 41 is an explanatory diagram illustrating the relationship between the diameter of the outer surface of the container opening 33*a*, the internal diameter of the nozzle receiver fixing portion 337, and the diameters of configurations such as the container setting section 615 of the toner replenishing device 60.

As described later, the container setting section 615 has the inner surface 615*a* that, at the time of setting the toner container 32, engages with the container opening 33*a* of the toner container 32. The inner surface 615*a* of the container setting section 615 is assumed to have an inner diameter D1; while the outer surface of the container opening 33*a* of the toner container 32 is assumed to have a diameter d1.

The nozzle shutter 612 disposed in the conveying nozzle 611 includes the nozzle shutter flange 612*a* that is assumed to have an outer diameter D2. Moreover, of the inner diameter of the nozzle receiver fixing portion 337, the inner diameter on the outside of the container seal 333 in the axial direction (i.e., the inner diameter of the second inner surface from the container front end side) is assumed to be d2. Furthermore, the outer diameter of the container seal 333 is assumed to be d3. Meanwhile, the nozzle shutter positioning ribs 337*a* makes contact against the outer surface of the container seal 333 and are arranged in plurality between the outer surface of the container seal 333 and the second inner surface from the container front end side of the nozzle receiver fixing portion 337. The outer diameter of the nozzle shutter 612 (i.e., the outer diameter of the nozzle shutter tube 612*e* (described later)) is assumed to be D3, and the inner diameter of the container seal 333 is assumed to be d4.

At the time of fitting the toner container 32 into the toner replenishing device 60, the conveying nozzle 611 enters the nozzle receiving opening 331, with the nozzle opening 610 remaining shut by the nozzle shutter 612. Then, the nozzle shutter flange 612*a* makes contact against the container seal 333 and flattens out the container seal 333. Subsequently, the nozzle shutter flange 612*a* runs into the end portions at the container front end side of the nozzle shutter positioning ribs 337*a*. As a result, the nozzle opening 610 is opened, and the inside of the toner container 32 becomes communicated with the inside of the conveying nozzle 611. At that time, the outer surface of the container opening 33*a* of the toner container 32 and the inner surface 615*a* of the container setting section 615 fit into each other in such a way that the toner container body 33 is held in a rotatable manner at that position of fitting.

In order to ensure that the outer surface of the container opening 33*a* of the toner container 32 and the inner surface 615*a* of the container setting section 615 fit into each other in a rotatable manner, the diameter d1 of the outer surface of the container opening 33*a* of the toner container 32 and the internal diameter D1 of the inner surface 615*a* of the container setting section 615 are set to satisfy the relationship "d1<D1". Herein, d1 and D1 are set to have the fitting tolerance in the range of 0.01 mm to 0.1 mm. In this way, by maintaining the relationship "d1<D1", it becomes possible to rotary drive the container body 33 while holding it on the inner surface 615*a* of the container setting section 615.

Herein, the configuration is such that the conveying nozzle 611 and the nozzle shutter 612 enter the nozzle receiving opening 331, with the nozzle opening 610 of the conveying nozzle 611 remaining shut by the nozzle shutter 612. In order to implement the configuration, the setting is done to satisfy the relationship "D2<d2", where D2 represents the outer diameter of the nozzle shutter flange 612*a* and d2 represents the inner diameter that, of the inner diameter of the nozzle receiver fixing portion 337, is on the outside of the container seal 333 in the axial direction (i.e., d2 represents the inner diameter of the second inner surface from the container front end side).

Meanwhile, the outer diameter D2 of the nozzle shutter flange 612*a* is set to also satisfy the relationship "D2>d3" in order to ensure the following: after the nozzle shutter flange 612*a* makes contact against the container seal 333 and flattens out the container seal 333, the nozzle shutter flange 612*a* runs into the end portions in the container front end side of the nozzle shutter positioning ribs 337*a*. Thus, the setting is done to satisfy the relationship "d3<D2<d2", where D2 represents the outer diameter of the nozzle shutter flange 612*a*; d2 represents the inner diameter that, of the inner diameter of the nozzle receiver fixing portion 337, is on the outside of the container seal 333 in the axial direction (i.e., d2 represents the inner diameter of the second inner surface from the container front end side); and d3 represents the outer diameter of the container seal 333.

As a result of doing the setting in this manner, the nozzle shutter 612 can be housed in the front end opening 305 of the toner container 32 (i.e., can be housed on the inside of the nozzle receiver fixing portion 337). Then, accompanying the rotation of the container body 33, when the container seal 333 and the nozzle shutter flange 612*a* slide against each other; it also becomes possible to prevent sliding-induced deterioration of the container seal 333. That becomes possible because, the nozzle shutter flange 612*a* is made to abut against the nozzle shutter positioning ribs 337*a* in such a way that the container seal 333 is not excessively flattened out and the sliding load can be controlled. In addition, since the nozzle shutter flange 612*a* flattens out the container seal 333 and fits thereto tightly but within limits, it also becomes possible to reduce toner scattering that occurs at the time of fitting the toner container 32 into the toner replenishing device 60.

Besides, the outer diameter D3 of the nozzle shutter 612 and the inner diameter d4 of the container seal 333 of the nozzle receiver 330 are set to satisfy the relationship "d4<D3". Because of that, when the conveying nozzle 611 enters the container seal 333, the inner diameter of the container seal 333 is pushed out. Hence, the container seal 333 can fit tightly but within limits to the nozzle shutter 612. For that reason, in the condition in which the conveying nozzle 611 is inserted, it becomes possible to prevent toner leakage from the toner container 32 to the outside.

By summing up the abovementioned relationships of diameters, the constituent elements of the toner container 32 are set to satisfy "d4<D3<d3<D2<d2<d1<D1". As a result of doing the setting in such a manner, it not only becomes possible to achieve sealability that prevents scattering or leakage of the toner from the toner container 32 but also becomes possible to achieve the housing capacity to house the nozzle shutter 612 and the nozzle shutter spring 613.

Moreover, as described later, at the time of fitting the toner container 32 into the toner replenishing device 60, the nozzle opening 610 starts opening only after the nozzle shutter flange 612*a* runs into the nozzle shutter positioning ribs 337*a* and the relative position of the nozzle shutter 612 with respect to the toner container 32 is fixed. On the other hand, at the time of removing the toner container 32 from the toner replenishing device 60, even if the conveying nozzle 611 starts pulling out from the toner container 32, as long as the nozzle opening 610 is open, the relative position of the nozzle shutter 612 with respect to the toner container 32 does not change because of the biasing force applied by the nozzle shutter spring 613.

Once the toner container 32 is pulled out, the relative position of the toner container 32 with respect to the conveying nozzle 611 undergoes a change. For that reason, the relative position of the nozzle shutter 612 with respect to the conveying nozzle 611 also undergoes a change, and the nozzle shutter 612 starts shutting the nozzle opening 610. At that time, as the toner container 32 is pulled out, the distance between the toner container 32 and the container setting section 615 goes on increasing. As a result, the nozzle shutter spring 613 starts returning to the natural length because of its own restoring force. Hence, the biasing force against the nozzle shutter 612 starts to decrease.

Moreover, once the toner container 32 is pulled out and the nozzle shutter 612 completely shuts the nozzle opening 610, some portion of the nozzle shutter 612 (i.e., the first inner rib 612*b* (described later in detail)) runs into some portion of the conveying nozzle 611. As a result of that contact, the relative position of the nozzle shutter 612 with respect to the conveying nozzle 611 gets fixed, and the contact made by the nozzle shutter flange 612*a* against the nozzle shutter positioning ribs 337*a* is released.

When the toner container 32 is further pulled out, the nozzle shutter 612 comes out of the toner container 32 along with the conveying nozzle 611.

In the condition in which the nozzle shutter flange 612*a* has run into the nozzle shutter positioning ribs 337*a*, the portion of the conveying nozzle 611 in which the nozzle opening 610 is formed is positioned sufficiently on the inward side (the container rear end side or the depth side) as compared to the opening portion of the nozzle receiving opening 331. More particularly, the arrangement is such that the nozzle opening 610 is placed at a position that is beyond the container gear 301 in the rotational axis direction toward the container rear end side. Since the nozzle opening 610 performs opening and closing from the position that is sufficiently on the inward side of the toner container 32, it becomes possible to prevent leakage of the toner from the nozzle opening 610 to the outside.

Meanwhile, regarding the shutter side supporting portions 335*a* and a space 335*b* between the shutter side supporting portions 335*a*; the two shutter side supporting portions 335*a* that are opposite to each other constitute a cylindrical shape that is cut off in a large way at a portion (two positions) of the space 335*b* between the shutter side supporting portions 335*a*. Because of such a shape, the container shutter 332 can be guided to move along the rotational axis direction inside the columnar space 51 that is formed on the inward side of the cylindrical shape.

While the container body 33 is rotating, the nozzle receiver 330 that is fixed to the container body 33 also rotates along the container body 33. At that time, the shutter side supporting portions 335*a* of the nozzle receiver 330 rotate around the conveyor nozzle 611 of the toner replenishing device 60. For that reason, the shutter side supporting portions 335*a* that are rotating pass through the space immediately above the nozzle opening 610, which is formed in the upper part of the conveying nozzle 611. With that, even if the toner gets deposited momentarily above the nozzle opening 610, the shutter side supporting portions 335*a* cut across the deposited toner and break it. As a result, it becomes possible to prevent a situation in which the deposited toner agglutinates during the period of non-use of the device thereby leading to trouble while conveying the toner when the device is restarted. Meanwhile, at a timing at which the shutter side supporting portions 335*a* are positioned laterally with respect to the conveying nozzle 611 and opposite to the nozzle opening 610, the toner inside the container body 33 is supplied into the conveying nozzle 611 as illustrated by an arrow β illustrated in FIG. 8.

As illustrated in FIG. 14, on the outer surface of the nozzle receiver fixing portion 337 of the nozzle receiver 330, the outer diameter at the container rear end side becomes smaller halfway through the rotational axis direction. That results in the formation of a level difference (a level difference between the first outer surface AA and the second outer surface BB). Moreover, as illustrated in FIG. 11, the inner surface of the container opening 33*a* of the container body 33 has the shape that runs along the outer surface of the nozzle receiver fixing portion 337, and has a level difference formed in such a way that the inner diameter becomes smaller at the container rear end side. Then, the level difference on the outer surface of the nozzle receiver fixing portion 337 runs into the level difference on the inner surface of the container opening 33*a* across the circumferential direction. That enables achieving prevention of axis inclination of the nozzle receiver 330 with respect to the container body 33 (i.e., prevention of a condition in which the central axis of the nozzle receiver fixing portion 337 having a cylindrical shape is inclined with respect to the central axis of the container opening 33*a* having a cylindrical shape).

Explained below with reference to FIGS. 5 to 8 is a configuration of the container front end cover 34 according to the first embodiment.

At the time of fitting the toner container 32 into the toner replenishing device 60, the container front end cover 34 is moved in a sliding manner over the container receiving section 72 illustrated in FIG. 5. It is illustrated in FIG. 5 that, immediately beneath the four toner containers 32, four grooves are formed from the insert hole portion 71 to the container cover receiving section 73 with the axial direction of the container body 33 serving as the longitudinal direction. In order to enable each container front end cover 34 to fit in the corresponding groove and move therein in a sliding manner, a pair of sliding guides 361 is disposed on both side surfaces in the lower portion of the container front end cover 34. More specifically, in each groove formed in the container receiving section 72, a pair of slide rails are formed that protrude from both side surfaces of the container receiving section 72. With the aim of sandwiching the pair of slide rails from above and below, each sliding guide 361 has a slide gutter 361*a* along the rotational axis of the container body 33. Moreover, the container front end cover 34 includes container engaged portions 339 that, at the time of fitting the toner container 32 into the toner replenishing device 60, get engaged with replenishing device engaging members 609 which are disposed in the setting cover 608.

Meanwhile, on the container front end cover 34 is disposed an IC tag (an ID tag or an ID chip) 700 that is used in recording data of the usage status of the toner container 32. Moreover, on the container front end cover 34 is disposed a color specific rib 34*b* that prevents a situation in which the toner container 32 that contains the toner of a particular color is fit into the setting cover 608 corresponding to a different toner color. As described above, at the time of fitting the toner container 32 into the replenishing device 60, the sliding guides 361 engage with the slide rails of the container receiving section 72. As a result, the orientation of the container front end cover 34 in the toner replenishing device 60 gets determined. With that, the position adjustment between the container engaged portions 339 and the replenishing device engaging members 609 can be performed in a smooth manner; as well as the position adjustment between the IC tag 700 (described later) and a connector 800 of the toner replenishing device 60 can be performed in a smooth manner.

Given below is the explanation about the operation of fitting the toner container 32 into the toner replenishing device 60.

As indicated by the arrow Q illustrated in FIG. 7 or FIG. 1, when the toner container 32 is moved in the direction of the toner replenishing device 60, the front end 611*a* of the conveying nozzle 611 comes in contact with the end surface at the container front end side of the container shutter 332. When the toner container 32 is further moved in the direction of the toner replenishing device 60, the conveying nozzle 611 presses the end surface at the container front end side of the container shutter 332. Because of the pressing of the container shutter 332, the container shutter spring 336 undergoes compression. Consequently, the container shutter 332 is pressed to the inward side of the toner container 32 (i.e., pressed to the container rear end side), and the nozzle front end of the conveying nozzle 611 is inserted in the nozzle receiving opening 331. At that time, the nozzle shutter tube 612*e*, which is positioned more toward the nozzle front end as compared to the nozzle shutter flange 612*a* in the nozzle shutter 612, also gets inserted in the nozzle receiving opening 331 along with the conveying nozzle 611.

When the toner container 32 is further moved in the direction of the toner replenishing device 60, that surface of the nozzle shutter flange 612*a* which is opposite to the nozzle shutter spring receiving surface 612*f* comes in contact with the container front end side of the container seal 333. When the container seal 333 is slightly flattened out, the abovementioned surface of the nozzle shutter flange 612*a* runs into the nozzle shutter positioning ribs 337*a*. As a result, the relative position in the rotational axis direction of the nozzle shutter 612 with respect to the toner container 32 gets fixed.

When the toner container 32 is further moved in the direction of the toner replenishing device 60, the conveying nozzle 611 gets further inserted on the inward side of the toner container 32. At that time, the nozzle shutter 612 that has run into the nozzle shutter positioning ribs 337*a* is pushed back to the nozzle base end with respect to the conveying nozzle 611. As a result, the nozzle shutter spring 613 undergoes compression, and the relative position of the nozzle shutter 612 with respect to the conveying nozzle 611 moves to the nozzle base end. Accompanying the movement of the relative position, the nozzle opening 610 that was covered by the nozzle shutter 612 gets exposed inside the container body 33, and the inside of the container body 33 becomes communicated with the inside of the conveying nozzle 611.

In the condition in which the conveying nozzle 611 is inserted in the nozzle receiving opening 331; due the biasing force of the container shutter spring 336 in the compressed state or the biasing force of the nozzle shutter spring 613 in the compressed state, a force acts in the direction of pushing back the toner container 32 with respect to the toner replenishing device 60 (i.e. a force acts in the opposite direction to the direction of the arrow Q illustrated in FIG. 7 or FIG. 1). However, at the time of fitting the toner container 32 into the toner replenishing device 60, the toner container 32 is moved in the direction of the toner replenishing device 60 against the abovementioned force until the container engaged portions 339 get engaged with the replenishing device engaging members 609. As a result, there is an action of the biasing force of the container shutter spring 336 and the biasing force of the nozzle shutter spring 613; as well as there is an action of the engagement of the container engaged portions 339 with respect to the replenishing device engaging members 609. Because of such action of the biasing force and the engagement, in the condition illustrated in FIG. 8, the positioning in the rotational axis direction of the toner container 32 with respect to the toner replenishing device 60 is done.

Figure 39:
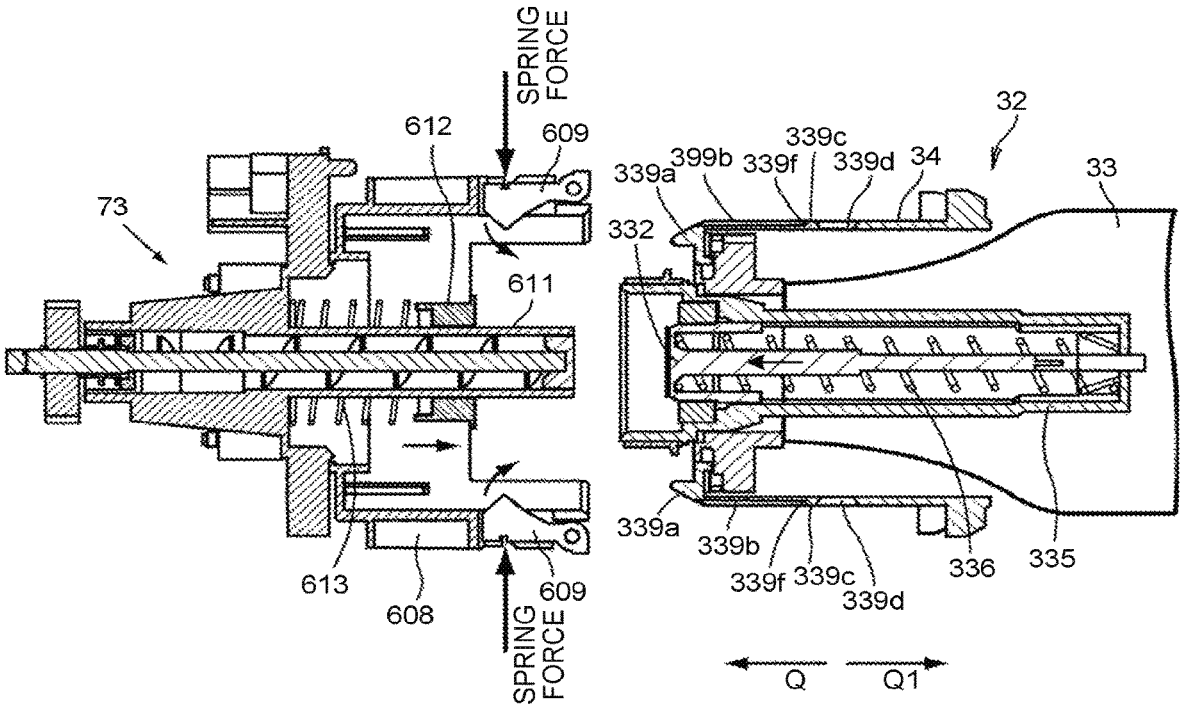
FIG. 39 is an explanatory cross-sectional view of the toner replenishing device and the toner container according to the first embodiment before the toner container is attached to the toner replenishing device.

As illustrated in FIGS. 7 and 39, each container engaged portion 339 includes a guiding protrusion 339*a*, a guiding gutter 339*b*, a bump 339*c*, and a quadrangular engaged hole 339*d*. With these constituent elements forming a single set, two such sets are arranged to form a pair of container engaged portions 339 on both sides of the container front end cover 34 with respect to a vertical line passing through the nozzle receiving opening 331. Each guiding protrusion 339*a* is disposed on the vertical plane at the front end of the container front end cover 34 and on the horizontal line passing through the center of the nozzle receiving opening 331. Moreover, each guiding protrusion 339*a* has an inclined surface that is linked to the corresponding guiding gutter 339*b* in such a way that, at the time of fitting the toner container 32 into the toner replenishing device 60, the replenishing device engaging members 609 abut against the guiding protrusions 339*a* and are guided toward the guiding gutter 339*b*. Herein, each guiding gutter 339*b* is formed at a lower level than the side peripheral surface of the container front end cover 34. The guiding protrusions 339*a* and the guiding gutters 339*b* serve as sliding portions on which the replenishing device engaging members 609 move in an abutted manner.

Moreover, the gutter width of the guiding gutters 339*b* is slightly greater than the width of the replenishing device engaging members 609, and is set to such an extent that the replenishing device engaging members 609 do not drop out from the gutters.

The container rear end side of each guiding gutter 339*b* is not directly linked to the corresponding engaged hole 339*d*, but has a dead end. Moreover, the container rear end side of each guiding gutter 339*b* has the same height as the height of the side peripheral surface of the container front end cover 34. That is, between each guiding gutter 339*b* and the corresponding engaged hole 339*d* is present the outer surface of about 1 mm thickness of the container front end cover 34. That portion corresponds to the corresponding bump 339*c*. The replenishing device engaging members 609 climb over the bumps 339*c* and land into the engaged holes 339*d*. With that, the engaging of the toner container 32 with respect to the toner replenishing device 60 is accomplished.

The toner container 32 is configured in such a way that, on a virtual plane that is orthogonal to the rotational axis, the container shutter 332 is positioned in the center of the line segment that joins the two container engaged portions 339. If the container shutter 332 is not positioned on the line segment that joins the two container engaged portions 339, then there arises the following possibility. That is, the distance from the line segment to the container shutter 332 functions as an arm of moment; and, due to the biasing force of the container shutter spring 336 and the nozzle shutter spring 613, there occurs an action of the moment of force which rotates the toner container 32 around the line segment. Because of the action of the moment of the force, there is a possibility that the toner container 32 tilts with respect to the toner replenishing device 60. In that case, there occurs an increase in the fitting load of the toner container 32, and the nozzle receiver 330 that holds and guides the container shutter 332 comes under strain.

Particularly, in the case of a new toner container 32 that is sufficiently filled with the toner, when the horizontally-protruding conveying nozzle 611 is pushed from the rear end of the toner container 32 for insertion in the toner container 32, the moment of force for rotating the toner container 32 acts by also taking into account the toner weight. As a result, there is a possibility that the nozzle receiver 330, in which the conveying nozzle 611 is inserted, comes under strain and, at worst, undergoes deformation or breaks down. In contrast, in the toner container 32 according to the first embodiment, the container shutter 332 is positioned on the line segment that joins the two container engaged portions 339. For that reason, due to the biasing force of the container shutter spring 336 and the nozzle shutter spring 613 acting at the position of the container shutter 332, it becomes possible to prevent the toner container 32 from tilting with respect to the toner replenishing device 60.

Meanwhile, as illustrated in FIG. 8, in the condition in which the toner container 32 is attached to the toner replenishing device 60, the circular end surface of the container opening 33*a* does not come in contact with the end surface 615*b* of the container setting section 615. That is because of the following reason. Consider a configuration in which the circular end surface of the container opening 33*a* comes in contact with the end surface 615*b* of the container setting section 615. In such a case, before the engaged holes 339*d* of the container engaged portions 339 are hooked in the replenishing device engaging members 609, there is a possibility that the circular end surface of the container opening 33*a* runs into the end surface 615*b* of the container setting section 615. If such a contact occurs, then the toner container 32 cannot be moved any further in the direction of the toner replenishing device 60, and the positioning of the toner container 32 in the rotational axis direction cannot be done. In order to prevent such a situation from occurring, in the condition in which the toner container 32 is attached to the toner replenishing device 60, there remains a small clearance gap between the circular end surface of the container opening 33*a* and the end surface 615*b* of the container setting section 615.

In the condition in which the positioning of the toner container 32 in the rotational axis direction is done in the abovementioned manner, the outer surface of the container opening 33*a* fits in a slidable manner in the inner surface 615*a* of the container setting section 615. For that reason, as described above, the positioning of the toner container 32 is done with respect to the toner replenishing device 60 in the planar direction orthogonal to the rotational axis. With that, the fitting of the toner container 32 into the toner replenishing device 60 is completed.

After the fitting of the toner container 32 is completed, when the driving motor 603 is rotary-driven, the container body 33 of the toner container 32 rotates as well as the conveying screw 614 in the conveying nozzle 611 rotates.

Due to the rotation of the container body 33, the toner inside the container body 33 is conveyed by the spiral rib 302 to the container front end side of the container body 33. Then, the toner that has been conveyed to near the nozzle opening 610 enters the nozzle opening 610 and is supplied in the conveying nozzle 611. Subsequently, the toner supplied in the conveying nozzle 611 is conveyed ahead by the conveying screw 614 to the developing device 50 through the toner dropping passage 64. The flow of the toner from the inside of the container body 33 to the toner dropping passage 64 is indicated by the arrow β illustrated in FIG. 8.

In the toner container 32 according to the first embodiment, as illustrated in FIG. 1, the end surface at the container front end side of the container body 33 is more protruding in the rotational axis direction as compared to the end surface at the container front end side of the nozzle receiver 330 on which the nozzle receiving opening 331 is formed. That is, in the toner container 32, the opening position of the nozzle receiving opening 331 is formed more toward the container rear end side as compared to the end portion at the container front end side of the front end opening 305, which is the opening position of the container body 33.

In this way, since the opening position of the nozzle receiving opening 331 is deeper as compared to the opening position of the container body 33, it becomes possible to prevent toner attachment to the outer surface of the container opening 33*a*. That is because, even if toner leakage occurs at the time of taking out the conveying nozzle 611 from the toner container 32, the toner that leaks and floats free from the nozzle receiving opening 331 cannot easily float around the end surface at the container front end side of the container opening 33*a*. Moreover, the toner that leaks and falls down from the nozzle receiving opening 331 gets stuck at the lower inner surface of the front end opening 305. For that reason, it becomes possible to prevent toner attachment to the inner surface 615*a* of the container setting section 615. In this way, the toner that leaks from the nozzle receiving opening 331 can be held in the area surrounded by the inner surface that is more toward the container rear end side of the container opening 33*a* as compared to the end surface at the container front end side of the container opening 33*a*. Hence, it becomes possible to prevent scattering of the toner to the outside of the toner container 32.

Moreover, as described above, when the toner container 32 is attached to the toner replenishing device 60, the container seal 333 is flattened out by the nozzle shutter flange 612*a*. As a result, the nozzle shutter flange 612*a* fits tightly and with pressure to the container seal 333. That enables achieving prevention of toner leakage in a more reliable manner. By having the configuration in which the container shutter 332 is disposed more toward the inward side in the longitudinal direction (i.e., more toward the container rear end side) as compared to the opening position, a cylindrical space is formed between the front end of the toner container 32 and the end surfaces at the container front end side of the container shutter 332 and the container seal 333.

In the condition in which the toner container 32 is not attached to the toner replenishing device 60, the nozzle opening 610 of the conveying nozzle 611 is shut by the nozzle shutter 612. Thus, when the toner container 32 is attached to the toner replenishing device 60, it becomes necessary to open the nozzle shutter 612 so that the toner can be received.

In the toner replenishing device 60, a cylindrical space (the front end opening 305) is formed between the end portion at the container front end side of the container opening 33*a* and the end surfaces at the container front end side of the container shutter 332 and the container seal 333. Inside that space is formed a withdrawal space in which the withdrawal space of the nozzle shutter 612 in the open state fits entirely or partially. Moreover, in that withdrawal space, the nozzle shutter spring 613 that is used for shutting the nozzle shutter 612 fits entirely or partially. With such a configuration, it becomes possible to reduce the space required to dispose the nozzle shutter 612 and the nozzle shutter spring 613.

As illustrated in FIG. 8, in the first embodiment, in the condition in which the toner container 32 is attached to the toner replenishing device 60, the withdrawal position of the nozzle shutter 612 is such that the nozzle front end of the nozzle shutter 612 is positioned more on the inward side of the container seal 333 as compared to the nozzle shutter flange 612*a*. Moreover, the portion of the nozzle shutter 612 that is more toward the nozzle base end than the nozzle shutter flange 612*a* substantially fits in the cylindrical space formed between the opening position of the front end opening 305 (i.e., the end portion at the container front end side) and the end surface at the container front end side of the container seal 333. Furthermore, the nozzle shutter spring 613 in the compressed state also substantially fits in that cylindrical space.

With such a configuration, the distance from the opening position of the front end opening 305, which is the foremost end of the toner container 32, to the toner falling portion in the toner replenishing device 60 (i.e., the position at which the toner dropping passage 64 is connected to the conveying nozzle 611) can be shortened. As a result, it becomes possible to downsize the main body of the copier 500.

Meanwhile, in the toner container 32 according to the first embodiment, the portions are figured out for press fitting the nozzle receiver 330 into the container body 33.

With reference to FIG. 11, either one of portions γ1 and γ2 serves as the press fitting portion. The portion γ1 is the inner surface of the container body 33 at the position of the container gear 301, and the portion γ2 is the inner surface of the container body 33 at the position of the cover hooked portion 306.

The toner container 32 illustrated in FIG. 11 includes the following invention. Herein, the toner container 32 is a powder container that contains a toner, which is a powdered developer, and that includes the container shutter 332 and the nozzle receiver 330. The container shutter 332 opens or shuts the nozzle receiving opening 331, which serves as a powder outlet through which passes the toner discharged from the container body 33. The nozzle receiver 330 holds the container shutter 332. In the toner container 32, the container opening 33*a* is formed in a circular shape at the end portion of the container front end side. The outer surface of the container opening 33*a* (i.e., the rotational axis unit of the container body 33) fits in a slidable manner into the inner surface 615*a* of the container setting section 615 (i.e., the bearing). Moreover, the nozzle receiver 330 is press-fit and fixed to the inner surface of the container body 33, and the position in the rotational axis direction of the press fitting portion is more on the container rear end side as compared to the position at which the outer surface of the container opening 33*a* and the circular inner surface of the container setting section 615 slide against each other.

As illustrated in FIG. 11, the end portion at the container front end side of the nozzle receiver 330 and the end portion at the container front end side of the container opening 33*a* have coincident positions in the rotational axis direction. For that reason, it is possible to think of a configuration in which the nozzle receiver 330 is press-fit to the inner surface in the neighborhood of the end portion at the container front end side of the container opening 33*a*. However, the neighborhood of the end portion at the container front end side of the container opening 33*a* fits into the cylindrical inner surface 615*a* of the container setting section 615. Hence, when the nozzle receiver 330 is press-fit, the press fitting portion of the container opening 33*a* swells out. If the outer diameter of the container opening 33*a* increases, then the fitting into the container setting section 615 cannot happen. As a result, there arises a possibility that the toner container 32 cannot be attached to the toner replenishing device 60. Moreover, even if the toner container 32 can be attached to the toner replenishing device 60, it may result in an increase in the rotary torque of the toner container 32.

In order to prevent such issues from arising, the amount of swelling of the container opening 33*a* caused due to press fitting can be estimated in advance, and the outer diameter of the container opening 33*a* can be accordingly set while manufacturing the toner container 32. However, if the outer diameter of the container opening 33*a* is set by taking into account the amount of swelling caused due to press fitting, then the following issue may arise. That is, it becomes necessary to set a large dimensional tolerance for the outer diameter of the container opening 33*a*. If the amount of swelling is small within the dimensional tolerance, then that leads to an increase in the difference between the outer diameter of the container opening 33*a* and the cylindrical inner surface 615*a* of the container setting section 615. That may result in inadequate positioning.

As a configuration that enables preventing such issues from arising, in the toner container 32 according to the first embodiment, in the neighborhood of the end portion at the container front end side of the nozzle receiver fixing portion 337 of the nozzle receiver 330, the outer diameter is reduced slightly to such an extent that the nozzle receiver 330 is clearance-fit, and not press-fit, to the inner surface of the container opening 33*a*. Moreover, the end portion at the container front end side is not set as the press fitting portion. Instead, at a position that is more toward the container rear end side and that has no relation to the fitting of the container setting section 615 and the toner container body 33 (i.e., that does not affect the fitting), the outer diameter of the nozzle receiver fixing portion 337 is set to such an extent that adequate press fitting is possible with respect to the container inner diameter. Examples of the position not related to the fitting include the portion corresponding to the thick portion of the container gear 301 (i.e., the portion γ1 illustrated in FIG. 11) or the portion at which the inner diameter of the container opening 33*a* goes down a notch and the thickness of the container opening 33*a* increases (i.e., the portion γ2 illustrated in FIG. 11). As the portion at which the inner diameter changes thereby resulting in the formation of a level difference (i.e., the portion γ2 illustrated in FIG. 11), the cover hooked portion 306 that has a ring-like rib on the outer perimeter is also present.

If a press fitting portion having a greater outer diameter is formed more toward the container rear end side as compared to the end portion at the container front end side of the nozzle receiver fixing portion 337 of the nozzle receiver 330, it becomes possible to prevent swelling out of the container opening 33*a* with respect to the fitting portion of the container setting section 615. As a result, it becomes possible to prevent a situation in which the toner container 32 cannot be attached to the toner replenishing device 60 or in which the rotary torque of the toner container 32 increases.

Moreover, since the container opening 33*a* has the shape of the preform that is formed by injection molding, it can be formed with accuracy. Furthermore, since the press fitting portion in the container opening 33*a* does not swell out after press fitting the nozzle receiver 330 and can be used as a positioning portion or a sliding portion, it becomes possible to maintain the accuracy of injection molding, as well as to achieve accurate positioning and excellent slidability.

Meanwhile, the toner container 32 that is press-fit in the portion γ1 includes the following invention. Regarding the toner container 32 that is press-fit in the portion γ1, the press fitting portion in the nozzle receiver fixing portion 337 of the resinous nozzle receiver 330 corresponds to the inner surface of the position at which the container gear 301 of the container body 33 is disposed. Since the portion of the container gear 301 has a gearing mechanism in the whole circumference of the rotational axis and the vertical direction, it has more strength than the other portion of the container body 33 and does not easily undergo deformation due to press fitting. Moreover, since the nozzle receiver fixing portion 337 is tightened, the nozzle receiver 330 does not easily come out over time. Hence, this press fitting portion is suitable for the purpose.

The toner container 32 that is press-fit in the portion γ2 includes the following invention. Regarding the toner container 32 that is press-fit in the portion γ2, the press fitting portion in the nozzle receiver fixing portion 337 of the nozzle receiver 330 corresponds to the portion at which the inner diameter of the container opening 33*a* goes down a notch (step) and the thickness increases. Since the portion at which the inner diameter of the container opening 33*a* goes down a notch (step) is thick in the whole circumference of the rotational axis and the vertical direction, it has more strength than the other portion of the container body 33 and does not easily undergo deformation due to press fitting. Moreover, since the nozzle receiver fixing portion 337 is tightened, the nozzle receiver 330 does not easily come out over time. Hence, this press fitting portion is suitable for the purpose.

Furthermore, the toner container 32 that is press-fit in the portion γ2 includes the following invention. Alternatively, regarding the toner container 32 that is press-fit in the portion γ2, the press fitting portion in the nozzle receiver fixing portion 337 of the resinous nozzle receiver 330 corresponds to the inner surface of the position at which the cover hooked portion 306 of the container body 33 is disposed. Since the portion of the cover hooked portion 306 has a rib structure in the whole circumference of the rotational axis and the vertical direction, it has more strength than the other portion of the container body 33 and does not easily undergo deformation due to press fitting. Moreover, since the nozzle receiver fixing portion 337 is tightened, the nozzle receiver 330 does not easily come out over time. Hence, this press fitting portion is suitable for the purpose.

Given below is the explanation regarding the holding mechanism of the IC tag (the ID tag or the ID chip) 700 that is disposed in the toner container 32 according to the first embodiment.

Figure 22:
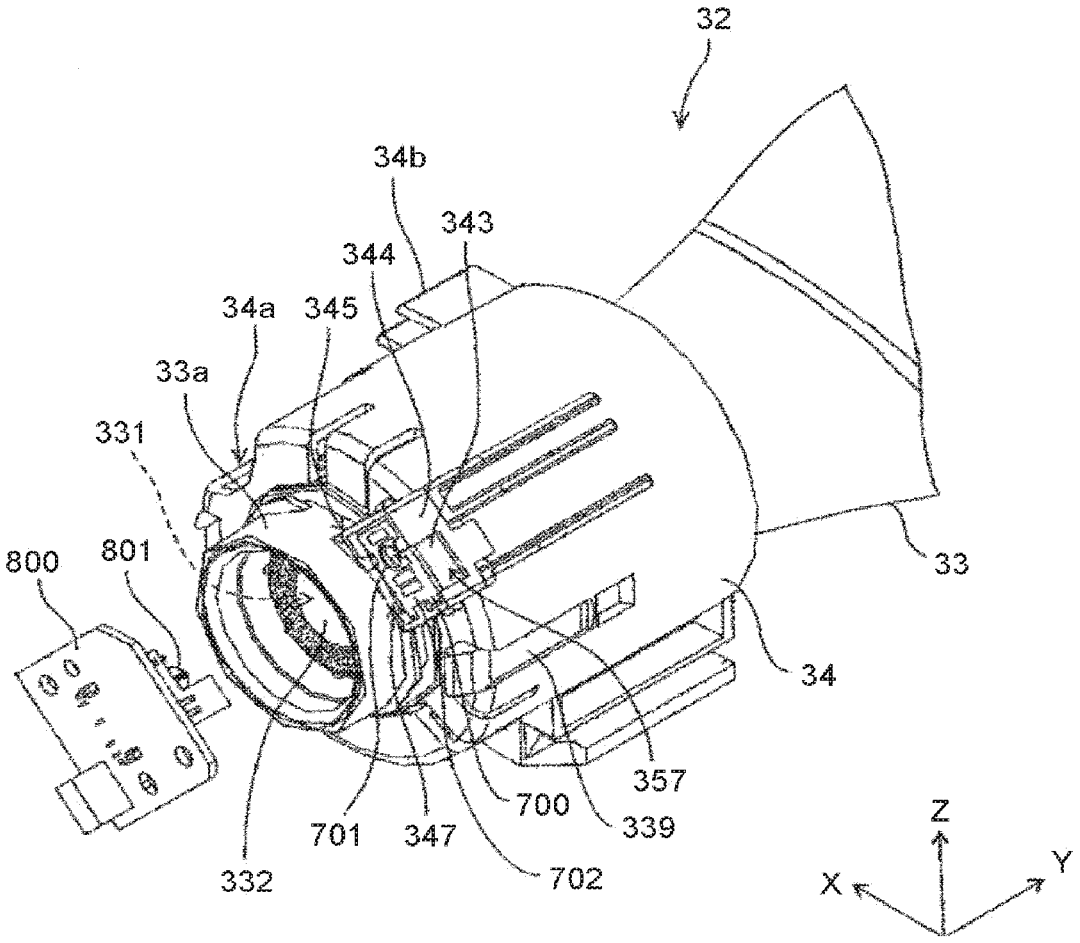
FIG. 22 is an explanatory perspective view of a connector that is fixed to the toner replenishing device according to all embodiments, and an explanatory perspective view of the end portion at the container front end side of the toner container according to the first embodiment.

FIG. 22 is an explanatory perspective view of the connector 800 that is fixed to the toner replenishing device 60, and an explanatory perspective view of the end portion at the container front end side of the toner container 32. As illustrated in FIG. 22, the toner container 32 includes the container body 33 and includes the container front end cover 34 which is attached to the container body 33 in such a way that the container opening 33*a*, which has the nozzle receiving opening 331 formed as a toner outlet of the container body 33, is exposed. Moreover, the toner container 32 includes the IC tag 700, which is attached as an information memory device to the front end of the container front end cover 34; and includes an IC tag holding structure 345 that holds the IC tag 700.

Herein, the IC tag disclosed in Japanese Patent Application No. 2011-121688 is used as the IC tag 700 according to the first embodiment, and the contact-type communication method is implemented. Accordingly, the connector 800 is disposed at such a position in the toner replenishing device 60 that is opposite to the end surface at the container front end side of the container front end cover 34.

Figure 23:
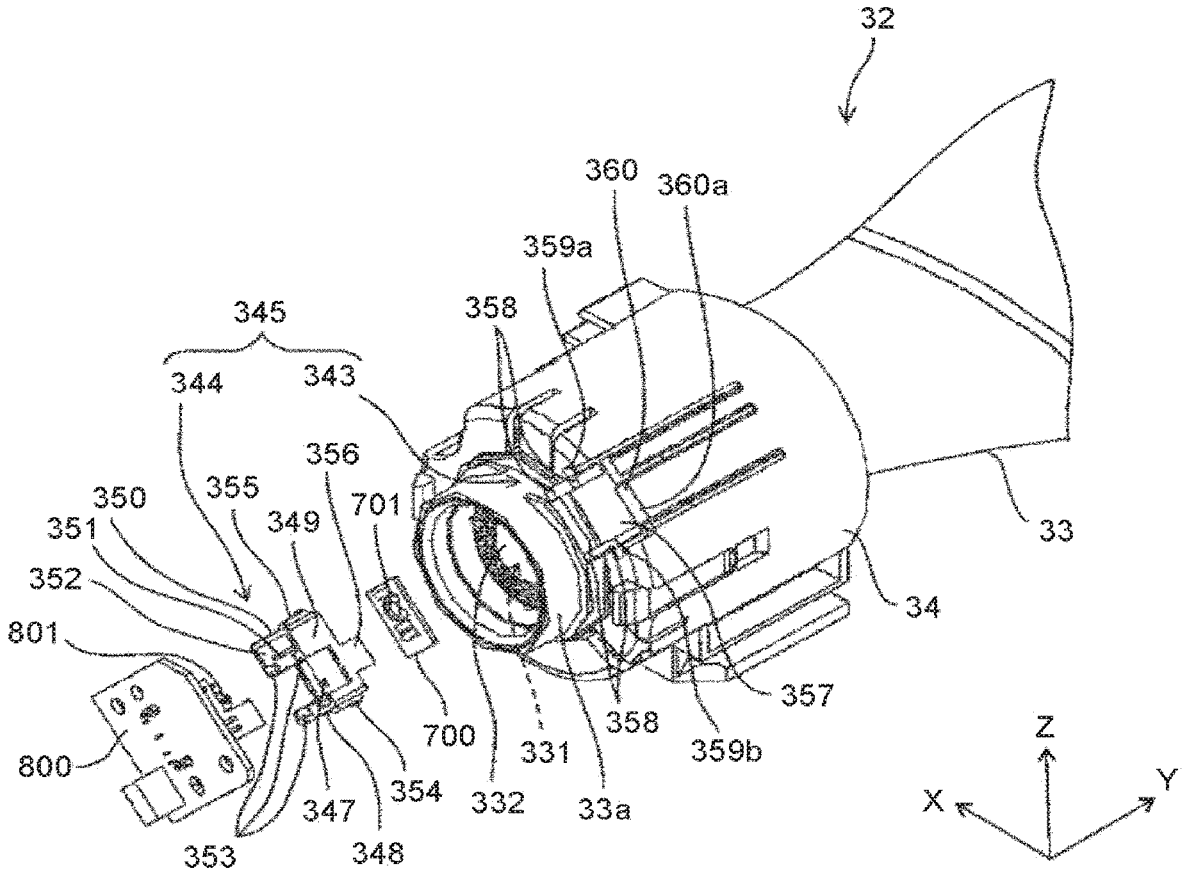
FIG. 23 is an explanatory perspective view of the end portion at the container front end side of the toner container according to the first embodiment in which an IC tag holding structure illustrated in FIG. 22 is illustrated in a disassembled state, and an explanatory perspective view of the connector.

FIG. 23 is an explanatory perspective view of the end portion at the container front end side of the toner container 32 in which the IC tag holding structure 345 is illustrated in a disassembled state, and an explanatory perspective view of the connector 800. As illustrated in FIG. 23, the IC tag 700 has an ID tag hole 701 formed thereon for the purpose of positioning. When the toner container 32 is attached to the toner replenishing device 60, a guiding pin 801 of the connector 800 is inserted in the ID tag hole 701.

The IC tag holding structure 345 includes a holding portion 343, which has holding bases 358 for holding the IC tag 700; and includes an IC tag holder 344, which is a covering member that holds the IC tag 700 in a movable manner in the X-Z direction illustrated in FIGS. 22 and 23 as well as engages with the holding portion 343 in a detachable manner. When the toner container 32 is viewed from the container front end side along the rotational axis, the IC tag 700 and the IC tag holding structure 345 are disposed in the diagonally upward right-hand space of the container front end cover 34. That is, the IC tag holding structure 345 is disposed above the container front end cover 34 by making use of the diagonally upward right-hand space that becomes a dead space when the toner containers 32 of the other colors are also disposed. With that, it becomes possible to provide a compact toner replenishing device in which the cylindrical toner containers 32 can be disposed close to each other. Meanwhile, in the diagonally upward left-hand space of the container front end cover 34, the container gear 301 and the container driving gear 601 are disposed. Herein, in order to ensure that neighboring toner replenishing systems do not interfere with each other; the IC tag 700, the IC tag holding structure 345, a terminal 804 of the connector 800, and the container driving gear 601 are disposed in a non-interfering manner.

Figure 24:
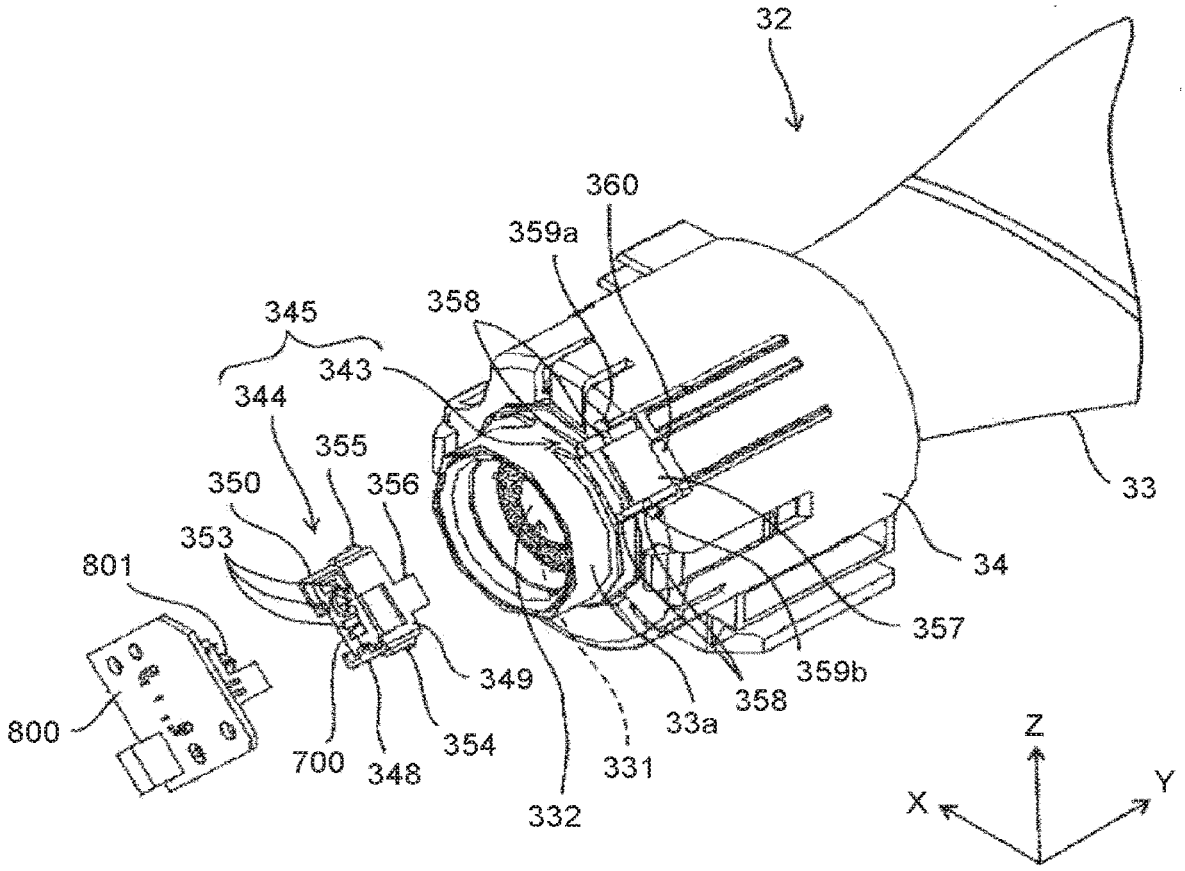
FIG. 24 is an explanatory perspective view of the end portion at the container front end side of the toner container according to the first embodiment in which an IC tag illustrated in FIG. 22 is temporarily joined to an IC tag holder, and an explanatory perspective view of the connector.

FIG. 24 is an explanatory perspective view of the end portion at the container front end side of the toner container 32 in the condition in which the IC tag 700 is temporarily joined to the IC tag holder 344, and an explanatory perspective view of the connector 800. As illustrated in FIG. 24, the holding portion 343 is formed on an IC tag attaching surface 357 present at the end portion of the container front end side of the container front end cover 34. Moreover, the holding portion 343 has the holding bases 358 which are made of four prismatic columns that support a board surface which is the rear surface of the IC tag 700 having no hard-wiring. The IC tag holder 344 includes a frame 352 and a holder protrusion 353. The frame 352 is formed to enclose from outside the holding bases 358 at the time of engagement with the holding portion 343 and to prevent the IC tag 700 from uncoupling. The holder protrusion 353 protrudes from the inner surface of the frame 352 over a terminal-free area of the top surface of the IC tag 700. The frame 352 of the IC tag holder 344 is large enough to house therein an oblong IC tag; and when the IC tag 700 is set therein, can hold the IC tag 700 in a movable manner to some extent in the X-Z direction.

The explanation about the IC tag holding structure 345 is given below in more detail.

The frame 352 of the IC tag holder 344 is formed to be longer than the length of the holding bases 358 in the Y-axis direction illustrated in FIGS. 23 and 24 (i.e., longer than the height from the IC tag attaching surface 357). Accordingly, when the IC tag 700 is installed on the holding bases 358, the IC tag 700 is not fixed to the container front end cover 34. Moreover, the IC tag 700 is installed while maintaining a clearance gap with the frame 352 that encloses the outside of the IC tag 700 in the X-Z direction. Furthermore, the IC tag 700 has a slight clearance gap also with the holder protrusion 353 of the IC tag holder 344. For that reason, although the IC tag 700 is not fixed to the container front end cover 34, there is no uncoupling of it too. The IC tag 700 is held in such a way that, if the toner container 32 is lightly shaken, the IC tag 700 moves while making a clattery sound.

While assembling it, the IC tag 700 gets hooked against an inner wall protrusion 351 (see FIG. 25) of the IC tag holder 344 as illustrated in FIG. 24, and is assembled in a temporarily joined manner on the holding bases 358 of the holding portion 343. At that time, the outside of the holding bases 358, which are made of four prismatic columns, serves as a guide for the IC tag holder 344; and the IC tag 700 that has been assembled on the holding bases 358 moves away from the inner wall protrusion 351 and gets mounted on the end surface at the container front end side of the four holding bases 358.

Given below is the detailed explanation about attaching the IC tag holder 344.

In the toner container 32 according to the first embodiment, the IC tag holder 344 is fixed to the container front end cover 34 not by using thermal caulking or using a fastener but by using a hook.

Figure 25:
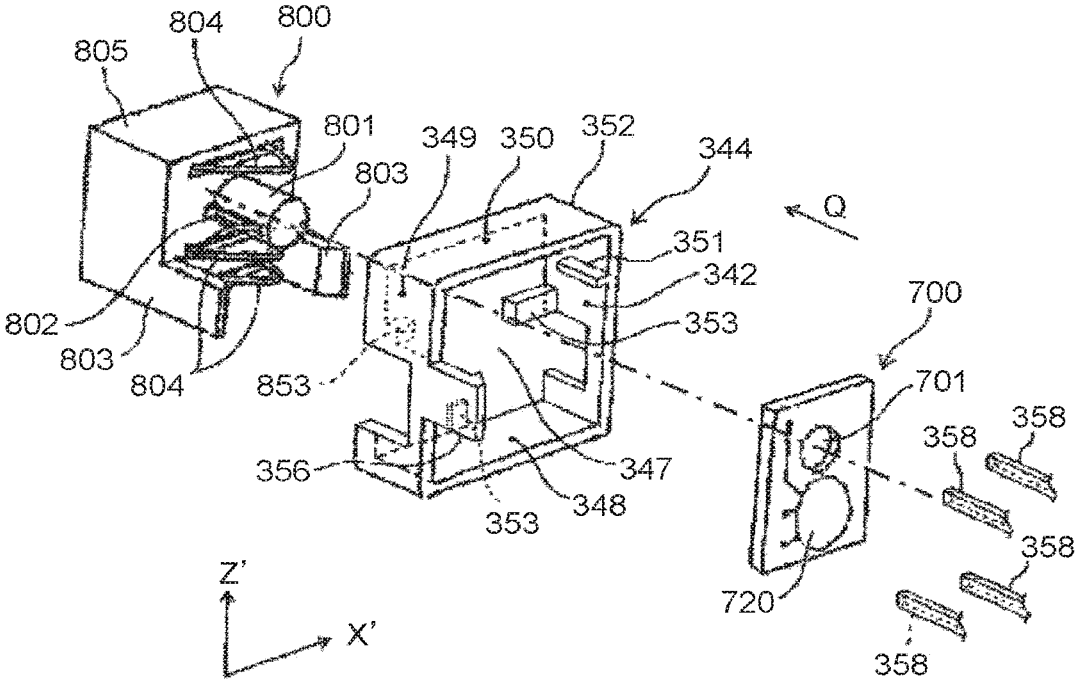
FIG. 25 is a perspective view illustrating the relative positional relationship between the IC tag, the IC tag holder, and the connector according to all embodiments.

As illustrated in FIG. 25, the IC tag holder 344 includes a holder upper hook 355 in a holder upper part 350, includes a holder lower hook 354 in a holder lower part 348, and includes a holder right side hook 356 in a holder right side part 349.

Around the IC tag attaching surface 357 in the container front end cover 34, three attached parts are formed opposite to the holder upper hook 355, the holder lower hook 354, and the holder right side hook 356, respectively. More specifically, around the IC tag attaching surface 357, an upper attached part 359*a* is formed at the position opposite to the holder upper hook 355. Moreover, around the IC tag attaching surface 357, a lower attached part 359*b* is formed at the position opposite to the holder lower hook 354. Similarly, around the IC tag attaching surface 357, a side attached part 360 is formed at the position opposite to the holder right side hook 356.

While setting the IC tag holder 344 in the container front end cover 34, the three hooks (the holder upper hook 355, the holder lower hook 354, and the holder right side hook 356) in the IC tag holder 344 engage with and get fixed at the three attached parts (the upper attached part 359*a*, the lower attached part 359*b*, and the side attached part 360, respectively). Meanwhile, the upper attached part 359*a* and the lower attached part 359*b* are hole-shaped, while the side attached part 360 is hook-shaped.

With respect to the hole-shaped upper attached part 359*a* and the hole-shaped lower attached part 359*b*, the IC tag holder 344 is set using the inclination at the hook front ends of the holder upper hook 355 and the holder lower hook 354 as well as using the elasticity of those hooks. With respect to the hook-shaped side attached part 360, the IC tag holder 344 is set using the inclination at the hook front end of the holder right side hook 356 as well as using an inclined surface 360*a* of the side attached part 360.

In such a configuration, as illustrated in FIG. 24, the IC tag 700 is temporarily set on the inward side of the frame 352 of the IC tag holder 344, and the IC tag holder 344 is then moved along the holding bases 358 of the container front end cover 34. With that, the hooks (the holder upper hook 355, the holder lower hook 354, and the holder right side hook 356) that are formed in the IC tag holder 344 engage with the attached parts (the upper attached part 359*a*, the lower attached part 359*b*, and the side attached part 360, respectively) that are formed in the container front end cover 34. As a result of the engagement, it becomes possible to fix the IC tag holder 344 to the container front end cover 34.

In the example illustrated in FIGS. 22 to 25, a portion above the IC tag holder 344, a portion below the IC tag holder 344, and a portion on the right side of the IC tag holder 344 are used as portions for engagement of the hooks (the holder upper hook 355, the holder lower hook 354, and the holder right side hook 356) and the attached parts (the upper attached part 359*a*, the lower attached part 359*b*, and the side attached part 360). However, the portions for engagement of the IC tag holder 344 are not limited to a combination of an upper portion, a lower portion, and a right-side portion. Alternatively, the portions for engagement of the IC tag holder 344 can be a combination of only an upper portion and a lower portion; or can be a combination of only a right-side portion and a left-side portion; or can be a combination of an upper portion, a lower portion, a right-side portion, and a left-side portion. Moreover, the portions for engagement or the number of engagements is not limited to the examples given in the first embodiment.

In this way, in the first embodiment, the explanation is given regarding the engagement performed using hooks. However, as the case may be, the IC tag holder 344 can be fixed to the container front end cover 34 using thermal caulking or using a fastener. Alternatively, it is also possible to cite an example in which the demand is to attach the IC tag to the container front end cover 34 in a more rigid manner or an example in which a jig is present that, at the time of recycling the IC tag, can perform rewriting in the IC tag without having to remove the IC tag from the container front end cover 34.

In the IC tag 700 according to the first embodiment, only a single ID tag hole 701 is formed on a substrate 702. That ID tag hole 701 is formed in between a plurality of metallic pads 710 (710*a*, 710*b*, and 710*c*) made of rectangular metallic plates.

Given below is the explanation regarding a protecting unit for protecting the toner container 32 when not in use.

Figure 26:
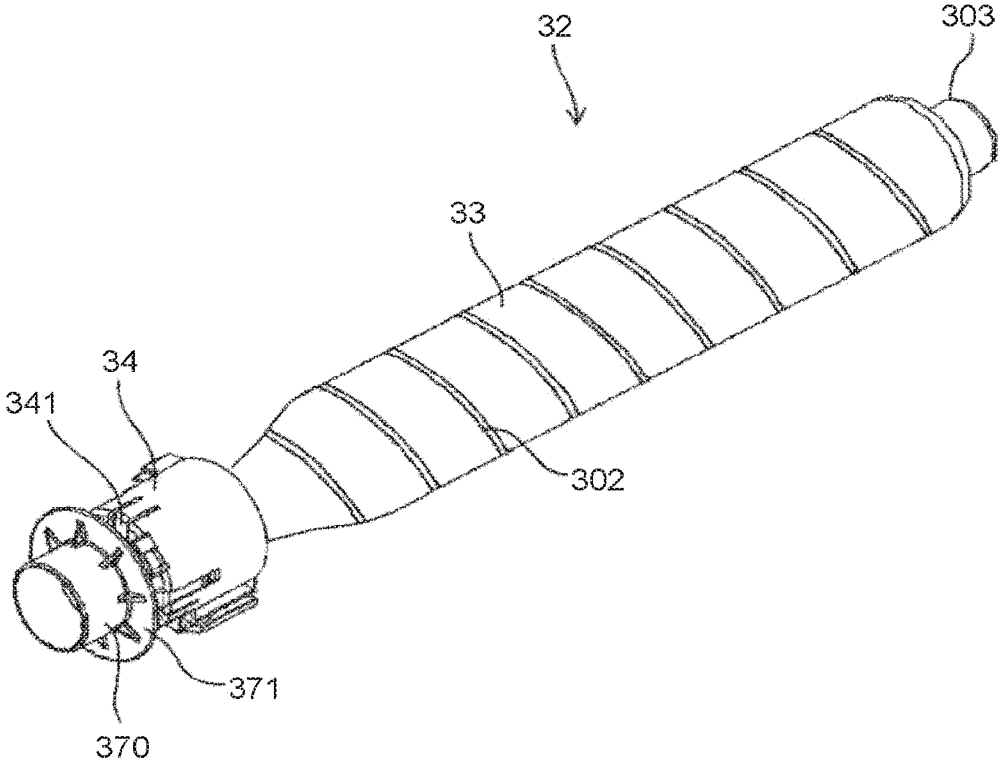
FIG. 26 is an explanatory perspective view of the toner container according to the first embodiment in the condition being stored.

FIG. 26 is an explanatory perspective view of the toner container 32 at the time of storage. In FIG. 26 is illustrated a condition in which a cap 370 is attached that serves as a seal for sealing the opening (the front end opening 305) of the container opening 33*a* of the toner container 32 illustrated in FIG. 6.

The toner container 32 illustrated in FIG. 26 includes the following invention. The toner container 32 illustrated in FIG. 26 is a powder container that contains a toner, which is a powdered developer, and that can have the cap 370, which is a seal for sealing the nozzle receiving opening 331 serving as the developer outlet, attached to the front end opening 305. Moreover, as described above, the front end opening 305 is a part of the container body 33. As illustrated in FIGS. 1, 6, and 7; in the container body 33, the front end opening 305 is formed to penetrate the container front end cover 34 that is required in fixing the toner container 32 to the toner replenishing device 60. As a result, it becomes possible to expose the front end opening 305 of the container body 33 from the container front end cover 34. Consequently, the front end opening 305, which is a part of the toner container 32 containing the toner, can be sealed directly by the cap 370. That enables achieving an enhanced sealing result and preventing toner leakage in a more reliable manner.

In the toner container 32 according to the first embodiment, the cap 370 has a cap flange 371. When the cap 370 is attached to the toner container 32; then, as illustrated in FIG. 26, the cap flange 371 conceals the IC tag 700 disposed in the container front end cover 34. As a result, when the toner container 32 is kept in storage, the IC tag 700 can be prevented from external contact or external impact shock, thereby enabling protection of the ID chip tag.

Moreover, in the toner container 32 according to the first embodiment, the cap flange 371 of the cap 370 is made to be greater in size than the outer diameter of the container body 33 of the container front end cover 34. With that, even if there is an unexpected fall of the container front end cover 34, it can be prevented from getting broken, thereby enabling protection of the toner container 32.

Moreover, the front end opening 305, which is a part of the toner container 32, is sealed directly by the cap 370. Hence, as compared to a configuration in which the front end opening 305 is sealed via a different member (such as the container front end cover 34) other than the container body 33, it becomes possible to achieve a greater sealing effect. Moreover, by sealing the front end opening 305 in a direct manner, it also becomes possible to hermetically seal the container body 33. If hermetic sealing can be achieved, then it becomes possible to prevent entry of air or moisture into the container body 33. That also enables achieving reduction in the use of the packaging material while keeping the toner container 32 in storage.

Figure 27:
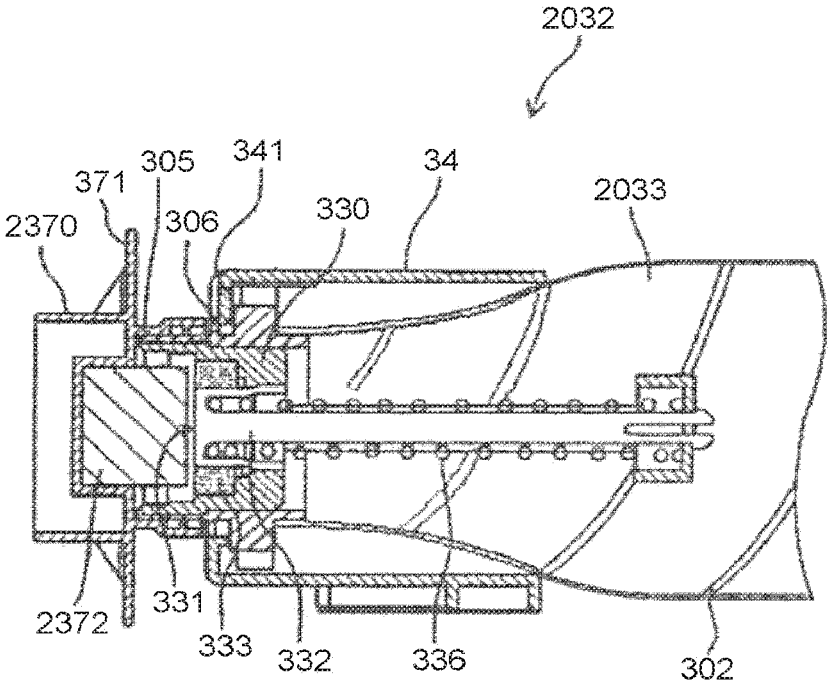
FIG. 27 is an explanatory cross-sectional view of a toner container according to a second embodiment in which an adsorption agent is disposed on a cap.

At the time of using the toner container 32 (i.e., at the time of fitting the toner container 32 into the toner replenishing device 60), the cap 370 is removed. As far as attaching the cap 370 to the toner container 32 is concerned, it is possible to make use of screws or hooks for the fixing purpose. Herein, the fixing portion such as a screw thread for using a screw or a hooked portion for using a hook is disposed on the outer surface of the front end opening 305 in an exposed manner from the container front end cover 34. Meanwhile, as illustrated in FIG. 27, a male screw 309 is disposed on the outer surface of the front end opening 305. That is, a screw is used for the purpose of seal fixing.

Meanwhile, the configuration for sealing the opening formed at the front end opening 305 is not limited to using a screw for fixing the cap 370. Alternatively, the opening can be sealed by pressure bonding a film to the end portion at the container front end side of the front end opening 305.

Second Embodiment

As a second embodiment of the present invention, explained below with reference to FIG. 27 is a toner container 2032 in which an adsorption agent such as a desiccant agent is used at the time of storage. FIG. 27 is an explanatory cross-sectional view of the toner container 2032 in which an adsorption agent 2372 is disposed on a cap 2370. Meanwhile, in the following description according to the second embodiment, the constituent elements identical to the constituent elements described in the first embodiment are referred to by the same reference numbers.

According to the second embodiment, the adsorption agent adsorbs not only the moisture but also various other elements (such as gases). Hence, the adsorption agent also functions as a desiccant agent. Examples of the adsorption agent include silica gel, aluminum oxide, and zeolite. Thus, any material having the adsorptive property can be used as the adsorption agent.

Meanwhile, if the container body 2033 can be completely-sealed by the cap 2370, it becomes possible to prevent entry of air or moisture into the container body 2033. That eliminates the need for the adsorption agent and eliminates the need for the packaging material accompanying the adsorption material. In this method, by reducing the packaging material such as the bag for packing the toner container 32, the cushioning material, and the individual packaging box; it becomes possible to downsize the packaging. That leads to a reduction of the use material as well as a reduction of environmental burdens.

However, the inventors of the present invention confirmed that a gas is formed from the toner in the powdered form; and, although it does not result in agglutination or solidification, it leads to the formation of toner aggregation in the form of small agglomerates. Since such toner aggregation can lead to the generation of defective images having white spots or spots of other colors, it needs to be prevented from occurring. If no gas is formed from the toner, then it is possible to have a sealing configuration without using any adsorption agent. However, in the case when the toner container 32 contains a toner from which a gas is formed, then it is desirable to dispose an adsorption agent for adsorbing the gas.

The toner container 2032 illustrated in FIG. 27 includes the following invention. The toner container 2032 illustrated in FIG. 27 is a powder container that contains a toner, which is a powdered developer, and that can have the cap 2370, which is a seal for sealing the nozzle receiving opening 331 serving as the developer outlet, attached to the front end opening 305 in such a way that the container body 2033 is hermetically-closed from inside. Moreover, in the toner container 2032 illustrated in FIG. 27, the adsorption agent 2372 is disposed on the inward side of the cap 2370 that hermetically-seals the front end opening. Furthermore, in the toner container 2032 illustrated in FIG. 27, the adsorption agent 2372 is disposed in such a way that at least some portion thereof fills the recessed portion at the front end of the toner container 2032. Herein, the recessed portion at the front end of the toner container 2032 points to a cylindrical space formed between the opening position of the front end opening 305 and the end surface at the container front end side of the container seal 333.

In the toner container 2032 illustrated in FIG. 27, the adsorption agent 2372 is disposed on the cap 2370. Hence, when the cap 2370 is removed, the adsorption agent 2372 can also be removed along with the cap 2370.

Moreover, in the toner container 2032 illustrated in FIG. 27, since at least some portion of the adsorption agent 2372 fills the recessed portion at the front end of the toner container 2032; it becomes possible to shorten the length of the cap 2370 in the rotational axis direction and to make the toner container 2032 compact for storage purposes.

Meanwhile, in the configuration in which the cap 2370 is used in sealing the toner container 2032, the degree of adhesion between the front end opening 305 of the toner container 2032 and the cap 2370 can be enhanced using a packing material or the like.

As far as the configuration of disposing the adsorption agent 2372 on the cap 2370 is concerned, the adsorption agent 2372 either can be disposed in an integrated manner with the cap 2370 (i.e., can be fixed to the cap 2370) or can be disposed separately from the cap 2370 (i.e., can be unfixed with respect to the cap 2370). However, if the adsorption agent 2372 can be disposed in an integrated manner with the cap 2370, then the adsorption agent 2372 and the cap 2370 can be removed together. That does not leave room to forget removing the adsorption agent 2372. Hence, the operability is also enhanced.

Third Embodiment

According to a third embodiment, the toner container 3032 is a powder container that contains a toner as a powdered developer; and that includes the container shutter 332 which opens or shuts the nozzle receiving opening 331 that is a powder outlet through which passes the toner discharged from the container body 3033. In addition, in the toner container 3032, a nozzle receiver 3330 that serves as a nozzle insertion member for supporting the container shutter 332 is detachably attachable to a container body 3033.

Herein, the explanation is given for a screw clamp mechanism that enables the nozzle receiver 3330 to be detachably attachable to the container body 3033. Moreover, the explanation is given for a configuration example in which the nozzle receiver 3330 is fixed to the container body 3033 using the screw clamp mechanism.

Figure 28:
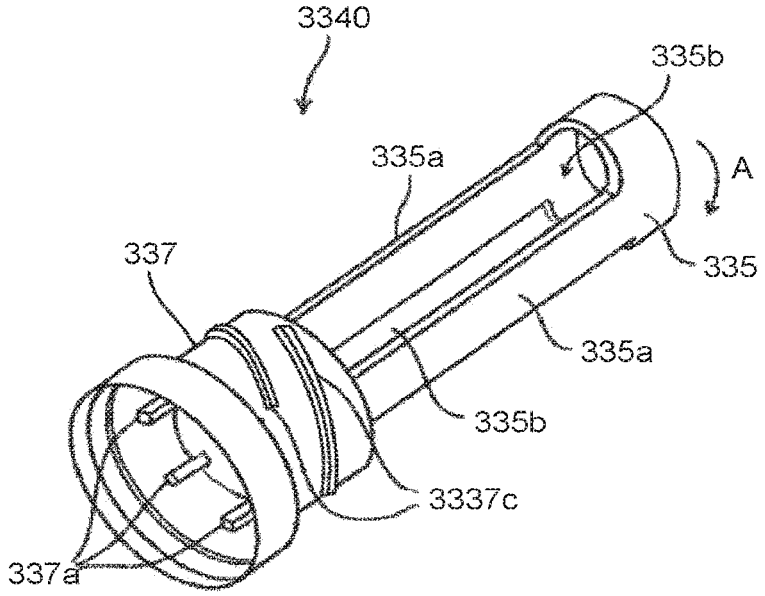
FIG. 28 is an explanatory perspective view of a container shutter supporter that is used in a nozzle receiver which is fixed using screw clamping to a container body according to a third embodiment.
Figure 29:
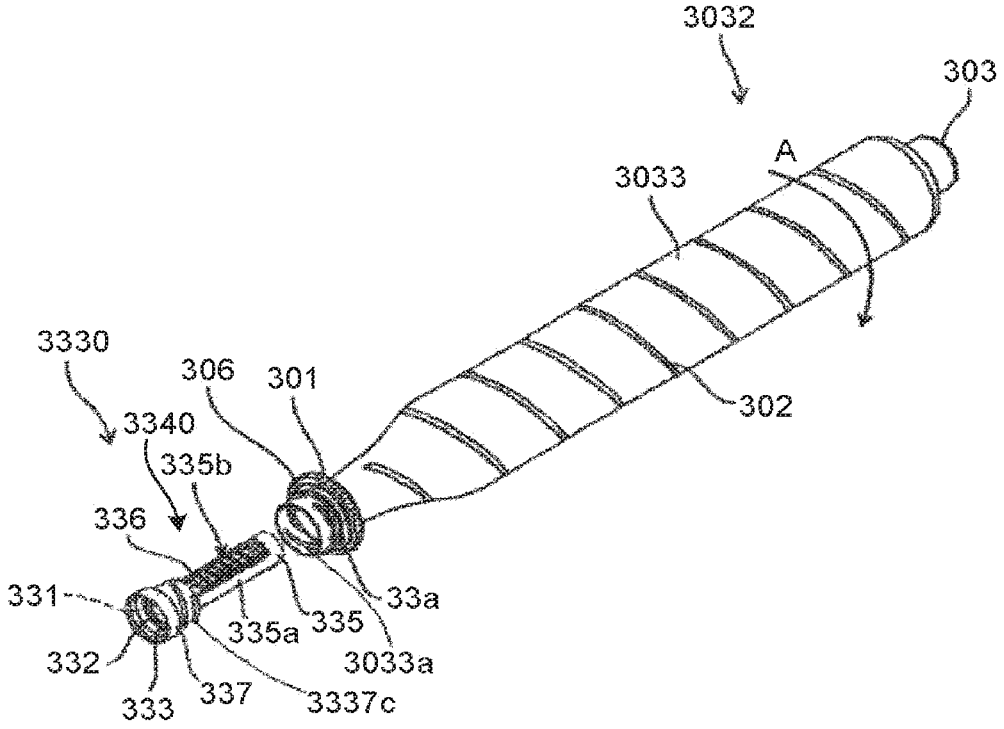
FIG. 29 is an explanatory perspective view of a condition of a toner container according to the third embodiment in which the nozzle receiver is removed from the container body.

FIG. 28 is an explanatory perspective view of a container shutter supporter 3340 that is used in the nozzle receiver 3330, which is fixed to the container body 3033 using screw clamping. The container shutter supporter 3340 illustrated in FIG. 28 has a male screw 3337*c* formed on the outer surface of the nozzle receiver fixing portion 337. FIG. 29 is a perspective view of the condition in which the nozzle receiver 3330 is separated from the container body 3033. In the toner container 3032, on the inner surface of the opening (the front end opening 305) of the container opening 33*a* of the container body 3033, a male screw 3033*a* is formed that is used in screw clamping with the male screw 3337*c*.

In the nozzle receiver 3330 in which the container shutter supporter 3340 illustrated in FIG. 28 is used, the container shutter supporter 3340 is screw clamped to the container body 3033 while the container seal 333 and the container shutter 332 are held on the container shutter supporter 3340. Meanwhile, regarding the toner container 3032 that includes the container shutter supporter 3340, other than the fact that a screw clamp mechanism is used to fix the nozzle receiver 3330 to the container body 3033, the configuration is identical to the toner container 3032 explained with reference to FIG. 9.

In the assembled form of the toner container 32 explained with respect to FIG. 9, the opening of the front end opening 305 that is used for toner filling is covered with the nozzle receiver 330 that has been press-fit. However, in this case, if a business model is to be adopted in which only the toner containers are manufactured first and the toner is filled in each toner container after transporting the toner container to a portion that is close to the point of consumption, one may have to face the following disadvantages. If the container body 33 and the container shutter supporter 340 are configured in an integrated manner prior to performing the toner filling operation; firstly the container shutter 332 needs to be pressed so as to establish communication between inside of the container body 33 and the outside, and then the toner needs to be filled using a toner filling nozzle. That causes a decline in the efficiency of the toner filling operation. On the other hand, if the container body 33 and the container shutter supporter 340 are transported separately followed by toner filling, then it results in an increase in the transportation cost and the management cost.

In regard to such issues, in the toner container 3032 in which the container shutter supporter 3340 illustrated in FIG. 28 is used, if the toner container 3032 is kept fixed and if the nozzle receiver 3330 is rotated in the direction of the arrow A illustrated in FIG. 28, or if the nozzle receiver 3330 is kept fixed and if the toner container 3032 is rotated in the opposite direction to the direction of the arrow A illustrated in FIG. 28; then the screw clamping of the nozzle receiver 3330 with respect to the container body 3033 is released. Hence, the nozzle receiver 3330 can be easily taken out from the container body 3033 after the use. For that reason, from the container body 3033, it becomes easier to take out the nozzle receiver 3330 that has been covering the opening of the front end opening 305 serving as the toner filling opening. Consequently, in the case of the toner container 3032 in which the container shutter supporter 3340 illustrated in FIG. 28 is used, the container body 3033 and the nozzle receiver 3330 can be assembled in an integrated manner and transported in that condition. Then, at the time of filling the toner, the nozzle receiver 3330 can be removed. As a result, it becomes possible to reduce the time and efforts required for toner filling as well as to reduce the transportation cost. Besides, it also becomes easier to recycle and reuse the once-used toner container 3032 by refilling the toner into it.

Meanwhile, the nozzle receiver 3330 includes different types of materials such as the container shutter supporter 3340 and the container shutter 332 that are made of a resin such as acrylonitrile butadiene styrene (ABS), polystyrene (PS), or polyoxymethylene (POM); the container seal 333 made of a sponge; and the container shutter spring 336 that is made of SW-C (hard steel wire), SWP-A (piano wire), or SUS304 (steel wire for spring). For that reason, the nozzle receiver 3330 can be easily removed from the container body 3033 that is made of polyethylene terephthalate (PET) or the like. Hence, it becomes possible to easily perform material recycling in which the toner container 3032 is disassembled and different materials are separated.

Moreover, the third embodiment includes the following invention. Meanwhile, in the toner container 3032 according to the third embodiment, as illustrated in FIG. 29, the spiral rib 302 disposed on the side surface of the container body 3033, which is positioned on the right-hand side when viewed from the container front end side, has the winding direction inclined toward the container front end side on the upper side. For that reason, when the container body 3033, which is positioned on the right-hand side when viewed from the container front end side, rotates in such a way that the side surface thereof moves from above to downward (i.e., rotates in the direction of the arrow A illustrated in FIG. 29), the toner stored in the container body 3033 can be conveyed to the container front end side.

Along with the container body 3033, the nozzle receiver 3330 also rotates in the direction of the arrow A illustrated in FIG. 29. However, since the container seal 333 and the conveying nozzle 611 slide with each other, a force of friction in the direction of stopping the rotation gets applied from the conveying nozzle 611. At that time, if the winding direction of the male screw 3337*c* is different than the winding direction illustrated in FIG. 28 but is same as the winding direction of the spiral rib 302, that is, if the male screw 3337*c* disposed on the side surface of the nozzle receiver fixing portion 337, which is positioned on the right-hand side when viewed from the container front end side, has the winding direction inclined toward the container front end side on the upper side (the direction of a right-hand screw); then the rotation of the container body 3033 in the direction of the arrow A illustrated in FIG. 29 becomes the direction in which the screw clamping with respect to the nozzle receiver fixing portion 337 is loosened.

In contrast, in the toner container 3032 in which the container shutter supporter 3340 illustrated in FIG. 28 is used, the winding direction of the male screw 3337*c* is set to be opposite to the winding direction of the spiral rib 302. That is, in the toner container 3032 according to the third embodiment, as illustrated in FIG. 28, the male screw 3337*c* is formed in such a way that the nozzle receiver 3330 is a left-hand screw. With that, it becomes possible to prevent a situation in which the rotation of the container body 3033 in the direction of the arrow A becomes the direction in which the screw clamping of the nozzle receiver 3330 with respect to the container body 3033 is loosened.

Fourth Embodiment

Figure 30:
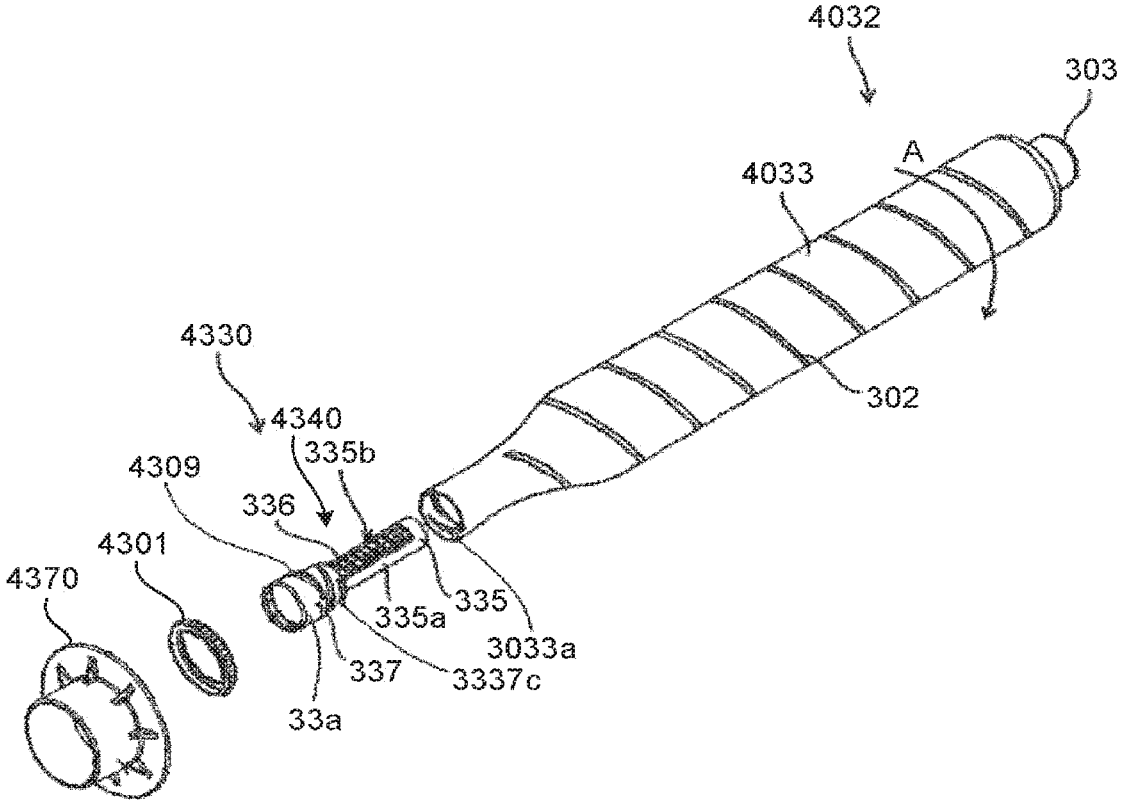
FIG. 30 is an explanatory perspective view of a condition of a toner container according to a fourth embodiment in which a nozzle receiver is removed from a container body.

FIG. 30 is a perspective view of a nozzle receiver 4330 that serves as a nozzle insertion member according to a fourth embodiment and a perspective view of a container body 4033 according to the fourth embodiment. As compared to the toner container according to the third embodiment, the fourth embodiment differs in the way that a male screw 4309 that is used in fixing a container gear 4301 and the cap 4370 is disposed in an integrated manner on the outer perimeter of a container shutter supporter 4340. That eliminates the need for having a container gear in the container body. Meanwhile, the male screw 3337*c* that is used in fixing the nozzle receiver 4330 and the container body 4033 is a left-hand screw in an identical manner to the third embodiment. Even if a torque in the direction of the arrow A acts on the container gear 4301, it does not lead to loosening of the screw clamping between the nozzle receiver 4330 and the container body 4033. Moreover, a male screw 4309 that is used in fixing the cap 4370 is a right-hand screw. Thus, even if a torque for loosening the cap 4370 acts in response to a user operation, the nozzle receiver 4330 that is a left-hand screw does not become loose with respect to the container body 4033.

Fifth Embodiment

As compared to the first four embodiments, a fifth embodiment differs in the way that the nozzle receiver includes conveying vanes for enhancing the toner conveying property.

Figure 31A:
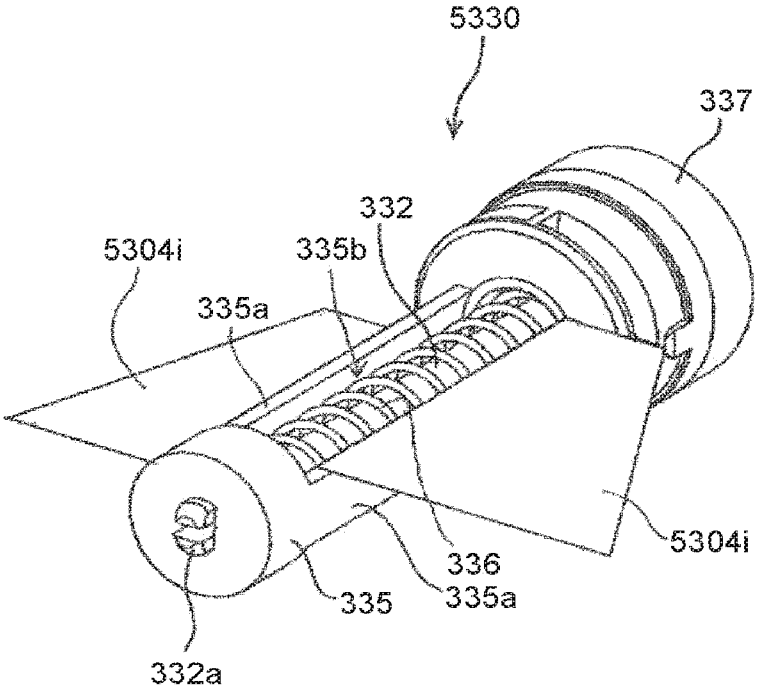
FIG. 31A is an explanatory perspective view of conveying vanes that are viewed from the container rear end side and that are included in a nozzle receiver according to a fifth embodiment.
Figure 31B:
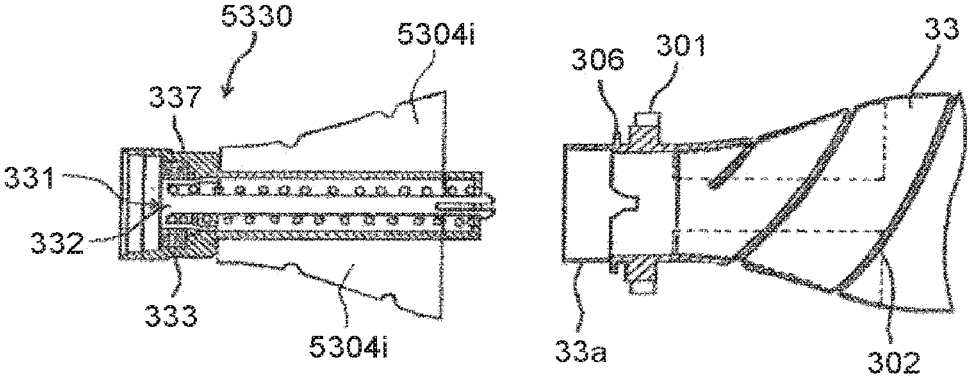
FIG. 31B is an explanatory cross-sectional view of a condition of a toner container according to the fifth embodiment in which the nozzle receiver is removed from a container body.
Figure 32:
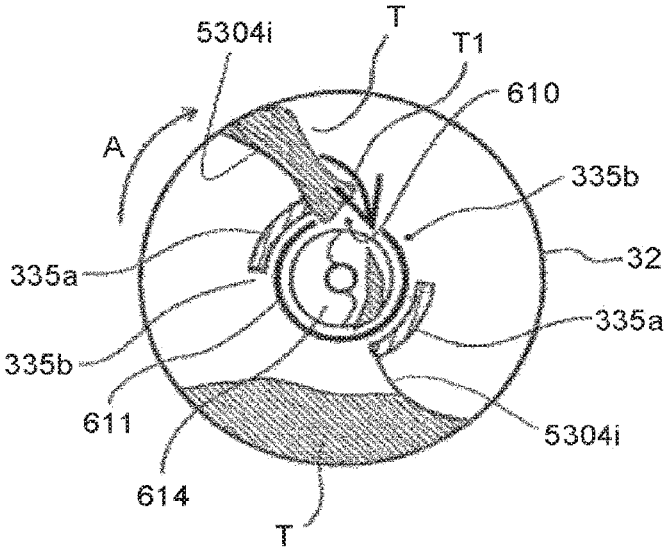
FIG. 32 is a cross-sectional view of lifting portions viewed from a direction perpendicular to the rotational axis of the toner container according to the fifth embodiment.

FIG. 31A is a perspective view of a condition in which lifting portions 5304*i*, which serve as conveying vanes, are disposed in an integrated manner with a nozzle receiver 5330, which serves as a nozzle insertion member. FIG. 31B is an explanatory cross-sectional view of the toner container in which the nozzle receiver 5330 is removed from the container body 33. FIG. 32 is a cross-sectional view of the lifting portions on the surface perpendicular to the rotational axis of the toner container.

As illustrated in FIG. 31A, in the nozzle receiver 5330, the lifting portions 5304*i* that are made of a flexible resinous film of polyethylene terephthalate (PET) or the like are attached to the shutter side supporting portions 335*a* of the container shutter supporter 340, which is identical to the first embodiment. Herein, two lifting portions 5304*i* are present, and are arranged in a point-symmetric manner around the central axis of the nozzle receiver 5330 (i.e., arranged in a 180° symmetry). As illustrated in FIG. 31B, the oblique sides of the lifting portions 5304*i* that come in contact with the inner wall of the container body 33 can be notched in accordance with the spiral rib 302. Meanwhile, the fixing of the lifting portions 5304*i* to the shutter side supporting portions 335*a* is not limited to the pasting method. Alternatively, for example, a plurality of pins of the snap-fit type can be disposed on the shutter side supporting portions 335*a*, and those pins can be inserted for the fixing purpose through a plurality of holes formed at the corresponding positions on the lifting portions 5304*i*.

The toner conveying action using the lifting portions 5304*i* is explained with reference to FIG. 32. FIG. 32 is a cross-sectional view taken from the side of the nozzle opening 610. When the container body 33 rotates in the direction of the arrow A, the nozzle receiver 5330 that is fixed to the container body 33 also rotates in the same direction. As a result, the lifting portions 5304*i* that are attached to the nozzle receiver 5330 also rotate in the direction of the arrow A, and lift the toner present at the bottom to the upper side. The nozzle opening 610 of the conveying nozzle 611, which is inserted in the center of the container body 33, is always open on the upper side. Thus, the toner lifted by each lifting portion 5304*i* falls down as indicated by an arrow T1 and enters the nozzle opening 610. The two lifting portions 5304*i* perform this conveying action in an alternate manner. Because of the lifting portions 5304*i*, the toner conveying property is enhanced as compared to the first embodiment. Hence, even when the amount of toner in the container body 33 decreases, it becomes possible to continue with conveying the toner into the conveying nozzle 611.

Thus, in the fifth embodiment, the explanation is given for an example in which the lifting portions 5304*i* are disposed on the toner container 33 and the nozzle receiver 330 according to the first embodiment. Alternatively, even if the lifting portions 5304*i* are disposed in the toner container and the nozzle receiver according to any one of the second to fourth embodiments, it still becomes possible to achieve the same toner conveying property.

Sixth Embodiment

Figure 33:
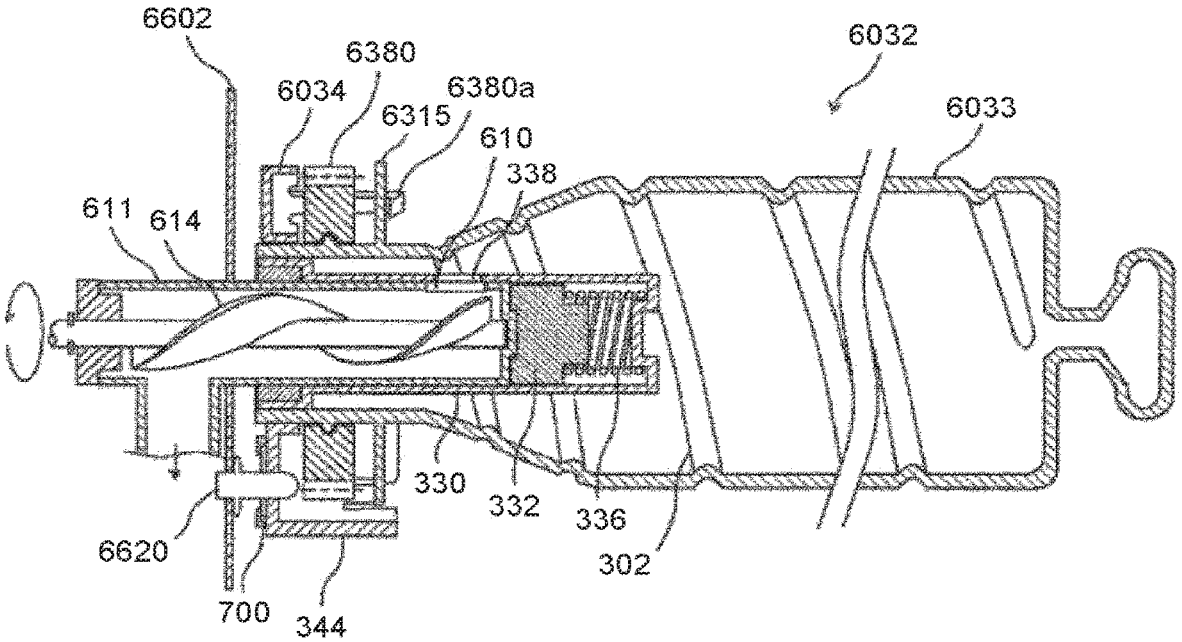
FIG. 33 is an explanatory cross-sectional view of the toner replenishing device into which a toner container according to a sixth embodiment is fit, and an explanatory cross-sectional view of the toner container.

FIG. 33 is an explanatory cross-sectional view of a portion of a toner container and a toner replenishing device according to a sixth embodiment. Herein, although the toner container and the toner replenishing device have different shapes than the toner container and the toner replenishing device according to the first embodiment, the constituent elements having identical functions are referred to by the same reference numerals and the explanation thereof is not repeated. As illustrated in FIG. 33, according to the sixth embodiment, a container gear 6380 that functions as a drive transmitter for transmitting the rotary driving force to a container body 6033 is disposed as a separate constituent element from the container body 6033. By disposing the container gear 6380 as a separate constituent element, the configuration of the container body 6033 gets simplified and thus the container body 6033 can be manufactured in an easier manner. That enables achieving reduction in the manufacturing cost of the container body 6033. Besides, it also becomes possible to replace the container gear 6380 and the container body 6033 independent of each other.

With reference to FIG. 33, the container gear 6380 is disposed on the outer surface of the end portion on the side of the nozzle receiving opening 331 of the container body 6033. Moreover, a container flange 6315 is formed at the end portion on the side of the nozzle receiving opening 331 of the container body 6033. Furthermore, on a container front end cover 6034, an engaging hook 6380*a* is provided outer than the gear teeth of the container gear 6380 in the radial direction. The engaging hook 6380*a* crosses over the gear teeth of the container gear 6380, and engages with the container flange 6315 of the container body 33. As a result, the container front end cover 6034 becomes relatively rotatable with respect to the container body 6033 as well as gets configured in an integrated manner with the container body 6033. When the container body 6033 rotates due to the rotary driving force transmitted by the container gear 6380, the toner present inside the container body 6033 is supplied to the conveying nozzle 611 via the toner receiving opening 338 of the nozzle receiver 330 and via the nozzle opening 610. Then, because of the conveying screw 614 of the conveying nozzle 611, the toner is conveyed toward the toner replenishing device 60. Meanwhile, the container front end cover 6034, which is attached to enclose the gear 6380 and which functions as the cover of a toner container 6032, has the IC tag 700 attached thereto and is positioned and held by a guiding pin 6620 disposed on a frame 6602.

Seventh Embodiment

Figure 34:
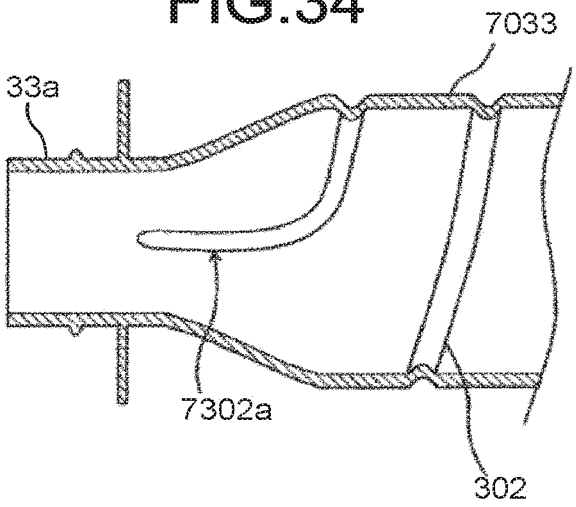
FIG. 34 is an explanatory cross-sectional view of a container body according to a seventh embodiment.

FIG. 34 is an explanatory cross-sectional view of a container body 7033 according to a modification example of the container body 6033 described in the sixth embodiment. In the toner container illustrated in FIG. 34, in a spiral rib 7302 that is formed on the inner side wall surface of the container body 7033, an end portion 7302*a* on the side of the container opening (opening) 33*a* is substantially parallel to the rotational axis direction of the container body 7033. In other words, a part of the spiral rib 7302*a* that is formed on the inner side wall surface near the opening of the container body 7033 includes a pitch parallel to the rotational axis. Because of the end portion 7302*a*, when the nozzle receiver 330 is assembled, the toner that has been conveyed to the neighborhood of the toner receiving opening 338 inside the container body 7033 can be conveyed ahead in a lifted manner from the lower side to the upper side along the inner side wall surface of the container body 7033. Consequently, when the toner receiving opening 338 of the nozzle receiver 330 is oriented in a direction perpendicular to the rotational axis of the container body 7033, the toner that has been conveyed to the neighborhood of the toner receiving opening 338 inside the container body 7033 can be lifted and be efficiently guided to the toner receiving opening 338 of the nozzle receiver 330. Meanwhile, the configuration in which the end portion 7302*a* of the spiral rib 7302 is substantially parallel to the rotational axis direction of the container body 7033 is not limited to the sixth embodiment. That is, the same configuration can be implemented in any one of the first to seventh embodiments. For example, if the configuration is implemented in combination with the lifting portions according to the fifth embodiment, then the lifting portions and the end portion of the spiral rib can be positioned at 90° from each other around the rotational axis of the container body.

Eighth Embodiment

Figure 35:
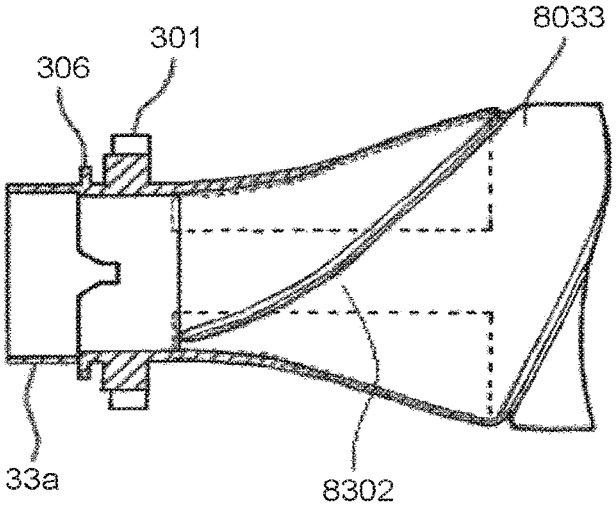
FIG. 35 is an explanatory cross-sectional view of a container body according to an eighth embodiment.

Meanwhile, in the first to sixth embodiments, a spiral rib 8302, which is formed on the inner side wall surface in the neighborhood of the container opening 33*a* of a container body 8033 (i.e., formed on the inner side wall surface at the container front end side, or at the other end, or at the conical portion), can have the pitch set to be greater than the pitch of the spiral rib 302, which is formed on the inner side wall surface of the main body portion (the cylindrical portion) on one end (the container rear end side or the gripper end) of the container body 8033, as illustrated in FIG. 35. In short, the spiral rib 8302 is a part of the spiral rib 302 of the main body portion. In this case, at one end of the container body 8033, the angle between the extending direction of the spiral rib 302, which is formed on the inner side wall surface of the container body 8033, and the direction toward the container opening 33*a* (i.e., the direction along the rotational axis of the container body) becomes relatively large. For that reason, the powdered toner present at one end inside the container body can be efficiently conveyed to the other end at which the container opening 33*a* is formed. On the other hand, in the neighborhood of the container opening 33*a* of the container body 8033, the angle between the extending direction of the spiral rib 8302 of the inner side wall surface of the container body 8033 and the direction toward the container opening 33*a* (toner receiving opening 338) becomes relatively small. For that reason, the toner that has been conveyed to the neighborhood of the container opening 33*a* can be conveyed ahead in a lifted manner along the inner side wall surface of the container body 8033. Consequently, when the toner receiving opening 338 of the nozzle receiver 330 is oriented in a direction perpendicular to the rotational axis of the container body 8033, the toner that has been conveyed to the neighborhood of the toner receiving opening 338 inside the container body 33 can be lifted and efficiently guided to the toner receiving opening 338 of the nozzle receiver 330.

Ninth Embodiment

Figure 36:
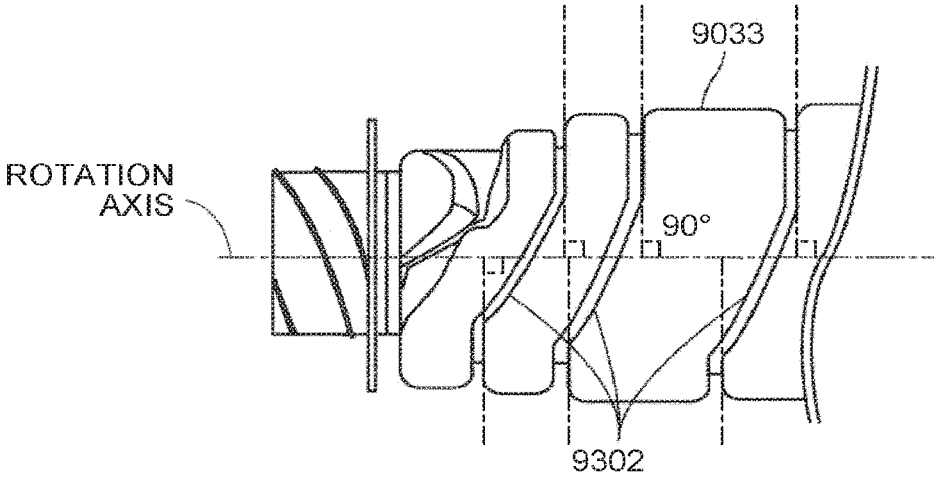
FIG. 36 is an explanatory cross-sectional view of a container body according to a ninth embodiment.
Figure 37:
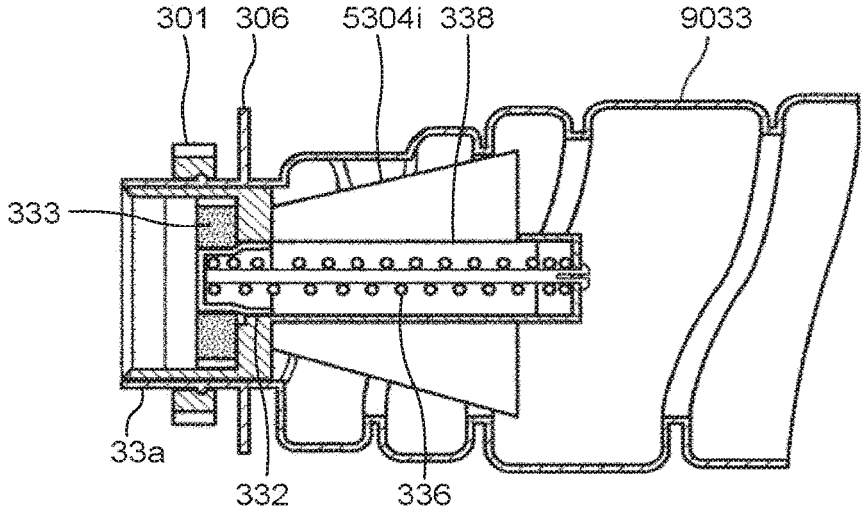
FIG. 37 is an explanatory cross-sectional view of a condition in which the conveying vanes according to the fifth embodiment are disposed in a container body according to a ninth embodiment.

Meanwhile, in the first to sixth embodiments, it is possible to implement the following configuration. That is, a spiral rib 9302, which is formed on the inner side wall surface in the neighborhood of the opening of a container body 9033, can have some portion thereof to be perpendicular to the rotational axis of the container body 9033. As an example of that, FIG. 36 illustrates a modification example of the container body according to the sixth embodiment. Herein, by changing the inclination angle in some portion of the spiral rib 9302 in the neighborhood of the toner receiving opening 338 of the nozzle receiver 330, the flow of the toner being conveyed is altered. As a result, it can be anticipated that the toner gets separated from the inner side wall surface of the container body 9033 and can be easily guided to the toner receiving opening 338. As illustrated in FIG. 37, in a configuration in which the nozzle receiver including the lifting portions 5304*i* according to the fifth embodiment is combined with the container body 9033, then it is expected that the toner can be guided to the toner receiving opening 338 in a more efficient manner.

Tenth Embodiment

Given below is a more detailed explanation of toner containers A032 (A032Y, A032M, A032C, and A032K) and the toner replenishing devices 60 (60Y, 60M, 60C, and 60K) according to a tenth embodiment. As described above, except for the point that the color of the used toner is different in each toner container A032 (A032Y, A032M, A032C, and A032K) and each toner replenishing device 60 (60Y, 60M, 60C, and 60K), the configurations are substantially identical. Hence, the following explanation is given without writing the toner color referring characters of Y, M, C, and K.

Figure 43:
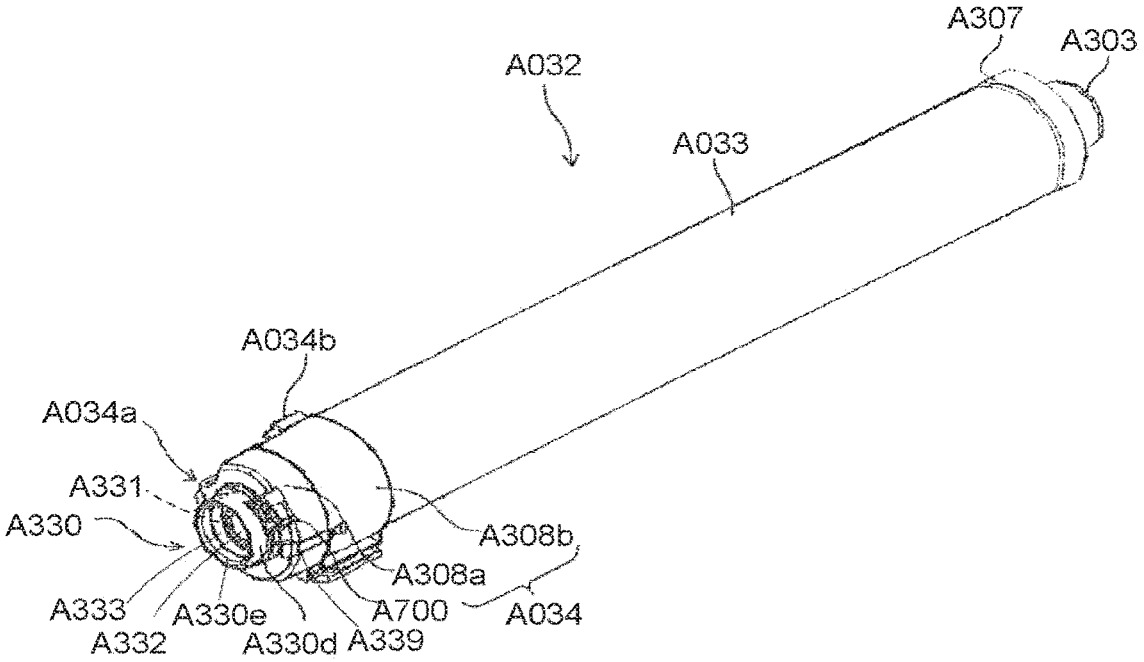
FIG. 43 is an explanatory perspective view of the toner container according to the tenth embodiment.
Figure 44:
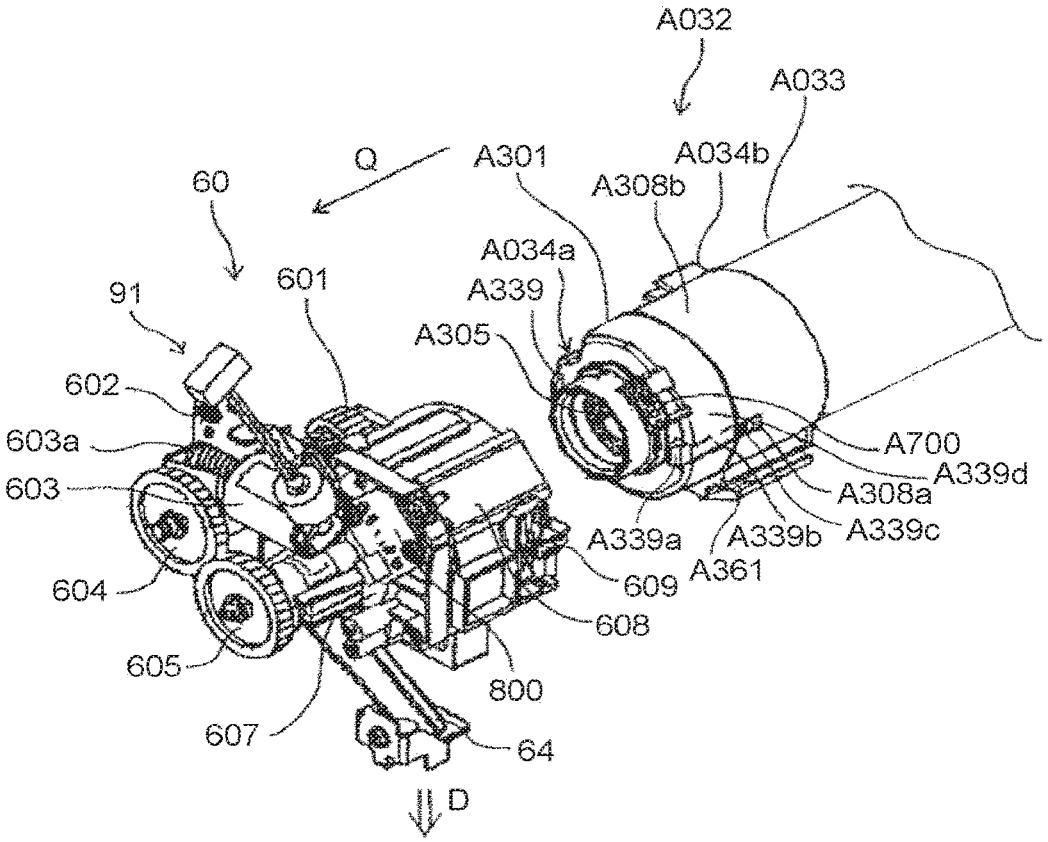
FIG. 44 is an explanatory perspective view of the toner replenishing device and the toner container according to the tenth embodiment before the toner container is attached to the toner replenishing device.

FIG. 43 is an explanatory perspective view of the toner container A032 according to the tenth embodiment. FIG. 44 is an explanatory perspective view of the toner replenishing device 60 before the toner container A032 is attached to it, and of the end portion of the toner container A032 at the container front end side.

Figure 42:
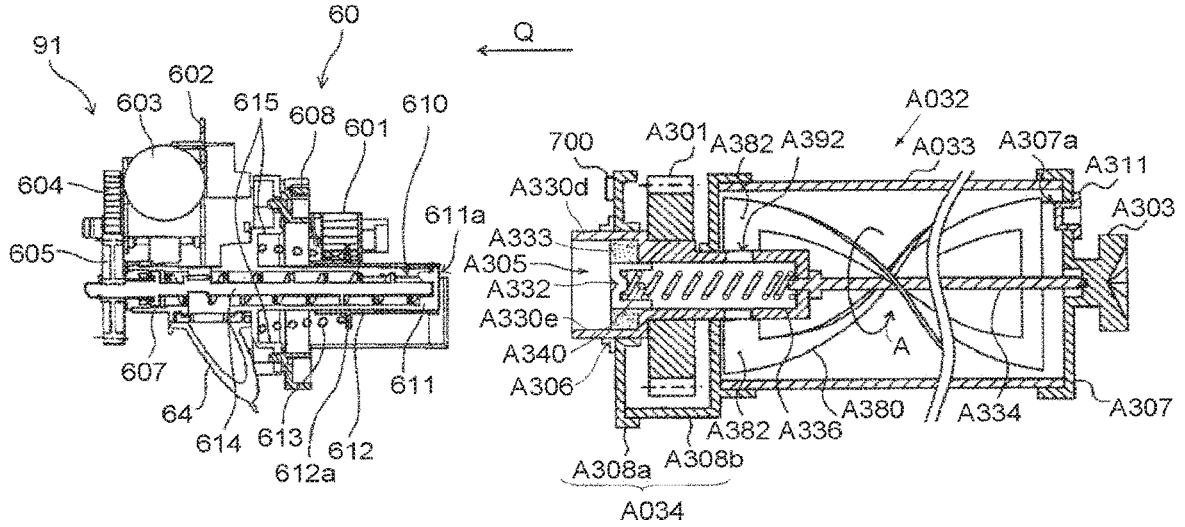
FIG. 42 is an explanatory cross-sectional view of the toner replenishing device and a toner container according to a tenth embodiment before the toner container is attached to the toner replenishing device.
Figure 45:
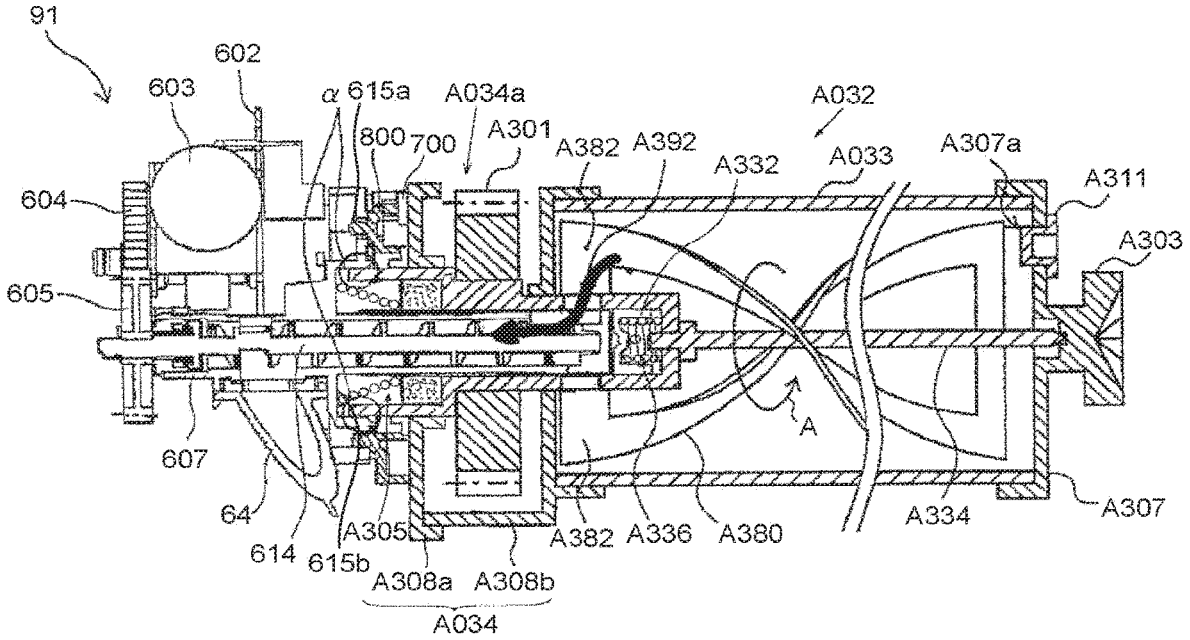
FIG. 45 is an explanatory cross-sectional view of the toner replenishing device and the toner container according to the tenth embodiment after the toner container is attached to the toner replenishing device.

FIG. 42 is an explanatory cross-sectional view of the toner replenishing device 60 before the toner container A032 is attached to it, and of the end portion of the toner container A032 at the container front end side. FIG. 45 is an explanatory cross-sectional view of the toner replenishing device 60 after the toner container A032 is attached to it, and of the end portion of the toner container A032 at the container front end side.

The toner replenishing device 60 includes the conveying nozzle 611 having the conveying screw 614. Moreover, the toner replenishing device 60 includes the nozzle shutter 612. In a container-unattached condition in which the toner container A032 is yet to be attached (i.e., in the condition illustrated in FIGS. 42 and 44), the nozzle shutter 612 shuts the nozzle opening 610 formed on the conveying nozzle 611. On the other hand, in a container-attached condition in which the toner container A032 has been attached (i.e., in the condition illustrated in FIG. 45), the nozzle shutter 612 opens the nozzle opening 610. Meanwhile, in the center of the end portion of the toner container A032 is formed a receiving opening A331 in which the conveying nozzle 611 in inserted in the container-attached condition. Moreover, a container shutter A332 is disposed that shuts the nozzle receiving opening A331 in the container-unattached condition.

Firstly, the explanation is given regarding the toner container A032 with reference to FIG. 43.

As described above, the toner container A032 mainly includes a container body A033, a nozzle receiver A330, an agitating conveyor A380, and a container front end cover A034.

Figure 46:
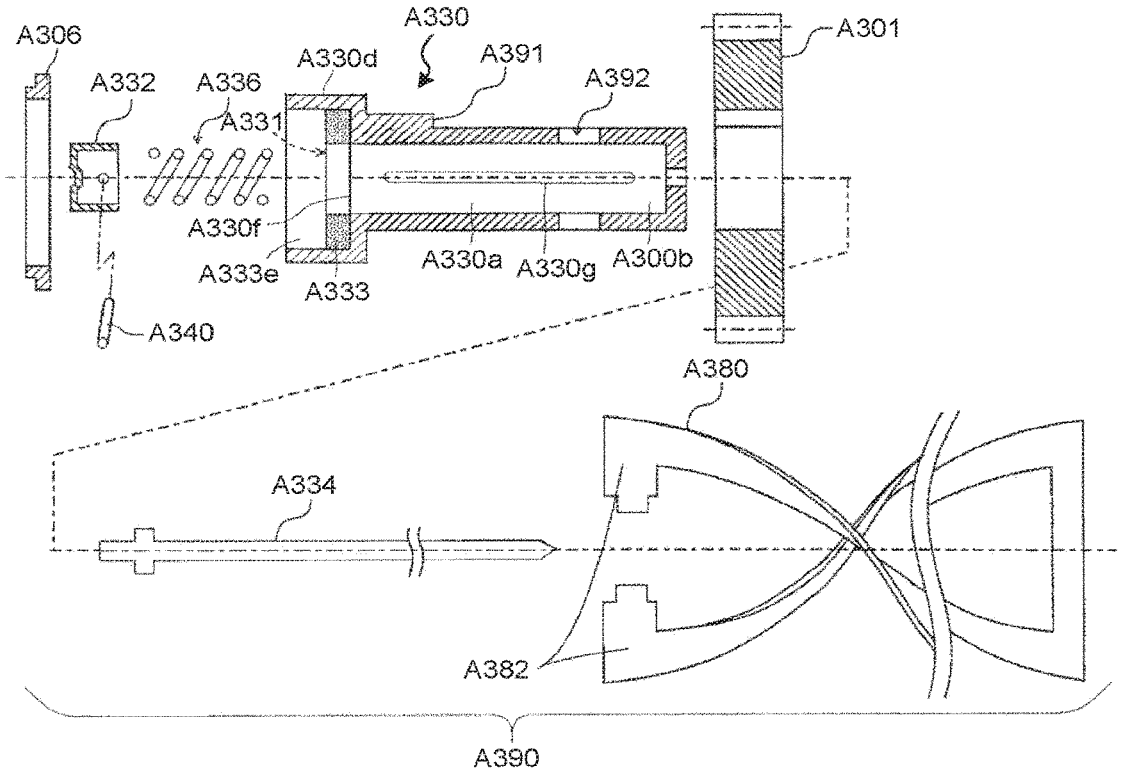
FIG. 46 is an explanatory exploded view of an agitator assembly according to the tenth embodiment.

FIG. 46 is an exploded view of the rotatable members, namely, a container gear A301, the nozzle receiver A330, and the agitating conveyor A380 from among the constituent elements of the toner container A032. In FIG. 46, a dashed line indicates the spindle of those rotatable members. Thus, the container gear A301, the nozzle receiver A330, and the agitating conveyor A380 are configured to have the same spindle.

The container body A033 is cylindrical in shape and houses the agitating conveyor A380 (described later). In the following explanation, the direction parallel to the spindle of the agitating conveyor A380 along the longitudinal direction of the container body A033 is called "shaft direction". The shaft direction is the same direction as the rotational axis direction, which is referred to in the first to ninth embodiments described above. Moreover, in the shaft direction, the side at which the nozzle receiving opening A331 is formed in the toner container A032 (i.e., the side at which the container front end cover A034 is disposed) is called "container front end side". Furthermore, the side at which a gripper A303 is disposed in the toner container A032 (i.e., the end opposite to the container front end side) is called "container rear end side". In the condition in which the toner container A032 is attached to the toner replenishing device 60, the shaft direction is the horizontal direction. As described above, the agitating conveyor A380 is disposed inside the container body A033 and rotates when driving transmission is provided thereto via the container gear A301 and the nozzle receiver A330. When the agitating conveyor A380 rotates in the direction of the arrow A illustrated in FIG. 45 as a result of receiving the driving transmission, a conveying force acts in such a way that a toner T inside the container body A033 is conveyed from one side (the container rear end side) to the other side (the container front end side) in the shaft direction due to the action of the agitating conveyor A380.

In the toner container A032, after the toner T is filled in the container body A033 through a filling hole A307*a* that is formed on a rear end lid A307, the filling hole A307*a* is covered by a cap A311. As a result, the toner T is housed inside the toner container A032.

The nozzle receiver A330 includes a container shutter supporter A330*a*, which supports the container shutter A332 in a movable manner, and a container spring supporter A330*b*, which is the base (the container rear end side) of the container shutter supporter A330*a* and to which abuts the end portion of a container shutter spring A336.

Moreover, the nozzle receiver A330 has a first outer surface A330*c*, which is supported in a rotatable manner by the container front end cover A034, and a second outer surface A330*d*, which has a greater outer diameter than the first outer surface A330*c* and which is supported by a first container cover A308*a*. The first outer surface A330*c* has a toner receiving opening A392 formed thereon and has a key convex A391 that fixes the container gear A301. The second outer surface A330*d* points to such an outer surface of the nozzle receiver A330 which, when the toner container A032 is attached to the toner replenishing device 60, is supported in a rotatable manner by the container setting section 615 of the toner replenishing device 60.

The inner surface of the nozzle receiver 330 includes the container shutter supporter A330*a*; has an inner surface A330*e* that has a greater inner diameter than the container shutter supporter A330*a*; and has a step A330*f* that is formed between the container shutter supporter A330*a* and the inner surface A330*e*. And the nozzle receiver A330 includes a container seal A333. One end surface of the container seal A333 is attached to the step (container seal fixing surface) A330*f*, while the other end surface of the container seal A333 and the inner surface A330*e* form a front end opening A305 as a cylindrical spatial area. Moreover, the outer surface of the container shutter A332 is abutted against the inner surface of the container seal A333 so that the nozzle receiving opening A331 is sealed. In this receiving opening A331 is inserted the conveying nozzle 611 of the toner replenishing device 60. In the toner container A032, the nozzle receiving opening A331 of the nozzle receiver A330 serves as the opening through which the conveying nozzle 611 can be inserted, while the outer surface of the front end opening A305 (i.e., the second outer surface A330*d*) serves as a container opening.

Herein, in order to facilitate smooth insertion of the conveying nozzle 611 into the nozzle receiving opening A331, an insertion guiding member made of Teflon (registered trademark) and having excellent slidability can be disposed in the container shutter supporter A330*a*.

Meanwhile, the nozzle receiver A330 includes different types of materials such as the container shutter A332 that is made of a resin such as acrylonitrile butadiene styrene (ABS), polystyrene (PS), or polyoxymethylene (POM); and the container shutter spring A336 that is made of SW-C (hard steel wire), SWP-A (piano wire), or SUS304 (steel wire for spring).

For that reason, the nozzle receiver A330 can be easily removed from the container body 33 made of PET (polyethylene terephthalate) or the like. Hence, it becomes possible to easily perform material recycling in which the toner container 32 is disassembled and different materials are separated.

The agitating conveyor A380 provides the conveying force to the toner T housed in the container body A033 in such a way that the toner T moves from one end (the container rear end side) to the other end (the container front end side) in the shaft direction. Moreover, at the container front end side of the agitating conveyor A380, lifting portions A382 are disposed that extend from the neighborhood of the toner receiving opening A392 of the nozzle receiver A330 toward the inner surface of the container body A033.

The lifting portions A382 extend from more upstream side as compared to the toner receiving opening A392 in the direction of rotation of the nozzle receiver A330. Due to the rotation of the agitating conveyor A380, the lifting portions A382 can lift the toner T from the lower side to the upper side and run the toner T into the toner receiving opening A392. And then, the powder receiving opening A392 of the nozzle receiver A330 rotates so that the powder receiving opening A392 passes over the nozzle opening. Herein, the agitating conveyor A380 is attached to the nozzle receiver A330 in such a way that the lifting portions A382 make a predetermined angle with respect to the tangential direction at the edges of the toner receiving opening A392.

When the toner container A032 is attached to the toner replenishing device 60, the toner receiving opening A392 becomes communicated with the nozzle opening 610 of the conveying nozzle 611 that has been inserted from the nozzle receiving opening A331 of the nozzle receiver A330. As a result, it becomes possible to supply the toner T from the toner container A032 to the toner replenishing device 60.

In the configuration illustrated in FIGS. 42 and 45, the shape of the agitating conveyor A380 is obtained by spirally twisting a pair of flat plates while considering the shaft as the axis of symmetry. The lifting portions A382 are in the shape of paddle vanes with respect to the direction of rotation.

The container front end cover A034 covers the container gear A301 from the container front end side as well as holds thereon the IC tag 700 (described later). The container front end cover A034 has a first container cover A308*a* that supports the second outer surface A330*d* of the nozzle receiver A330 in a rotatable manner; and has a second container cover A308*b* that is fixed to the container front end side of the container body A033 and that supports the first outer surface A330*c* of the nozzle receiver A300 in a rotatable manner. The first container cover A308*a* is fixed to the second container cover A308*b* and constitutes the container front end cover A034. Moreover, the container front end cover A034 includes a pair of slide guides A361 that are disposed on both lower side surfaces of the container front end cover A034; includes container engaged portions A339; and includes a color specific rib A034*b* that protrudes in the direction perpendicular to the attaching-detaching direction of the toner container A032. Meanwhile, the container front end cover A034 not only can have the same functions as the functions of the container front end cover 34 according to the first embodiment but also can have the same outer shape.

At the time of fitting the toner container A032 into the toner replenishing device 60, the pair of sliding guides A361 that are disposed on both lower side surfaces of the container front end cover A034 function as guides for the container front end cover A034 to move in a sliding manner over the container receiving section 72 illustrated in FIG. 5. More particularly, it is illustrated in FIG. 5 that, immediately beneath the four toner containers A032, four grooves are formed from the insert hole portion 71 up to the container cover receiving section 73 with the shaft direction of the container body A033 serving as the longitudinal direction. The pair of sliding guides A361 enables the container front end cover A034 to fit in the grooves and move in a sliding manner. More specifically, in each groove formed in the container receiving section 72 is formed a pair of slide rails protruding from both side surfaces of the container receiving section 72. In order to sandwich the pair of slide rails from above and below, each sliding guide A361 has a slide gutter A361*a* parallel to the shaft direction of the container body A033.

Moreover, at the time of fitting the toner container A032 into the toner replenishing device 60, the container engaged portions A339 get engaged with the replenishing device engaging members 609 which are disposed in the setting cover 608. Furthermore, each container engaged portion A339 includes a guiding gutter A339*b* that guides the relative movement with the corresponding replenishing device engaging member 609; and an engaged hole A339*d* that gets engaged with the corresponding replenishing device engaging member 609 in the condition in which the toner container A032 is attached to the toner replenishing device 60.

The first container cover A308*a* of the container front end cover A034 constitutes the guiding gutter A339*b* and includes the ID tag (IC tag) 700 that is used in recording data of the usage status of the toner container A032. Moreover, the first container cover A308*a* has a through hole A308*e* through which passes the end portion at the container front end side of the nozzle receiver A330 and which is used to expose the second outer surface A330*d*. Furthermore, the positional relationship of the first container cover A308*a* and the nozzle receiver A330 in the longitudinal direction is regulated by a ring stopper A306 that fits in the second outer surface A330*d* from the container front end side of the nozzle receiver A330.

Meanwhile, the color specific rib A034*b* prevents a situation in which the toner container A032 that contains the toner of a particular color is fit into the setting cover 608 corresponding to a different toner color.

On the container front end cover A034 is formed a gear exposing hole A034*a* from which a portion (the central reverse side illustrated in FIG. 43) of the container gear A301 is exposed. With such a configuration, when the toner container A032 is attached to the toner replenishing device 60, the container gear A301 that is exposed from the gear exposing hole A034*a* can be geared with the container driving gear 601 of the toner replenishing device 60. As a result, it becomes possible to transmit the driving force from the main body of the image forming apparatus to the rotatable members of the toner container A032.

FIG. 46 is an exploded view of the rotatable members, namely, the container gear A301, the nozzle receiver A330, and the agitating conveyor A380 from among the constituent elements of an agitator assembly A390 of the toner container A032. In FIG. 46, the dashed line indicates the spindle of those rotatable members. Thus, the container gear A301, the nozzle receiver A330, and the agitating conveyor A380 are configured to have the same spindle.

Given below is the explanation of the agitator assembly A390 that includes the nozzle receiver A330 and the agitating conveyor A380 which are disposed in a rotatable manner with respect to the container body A033.

Figure 47:
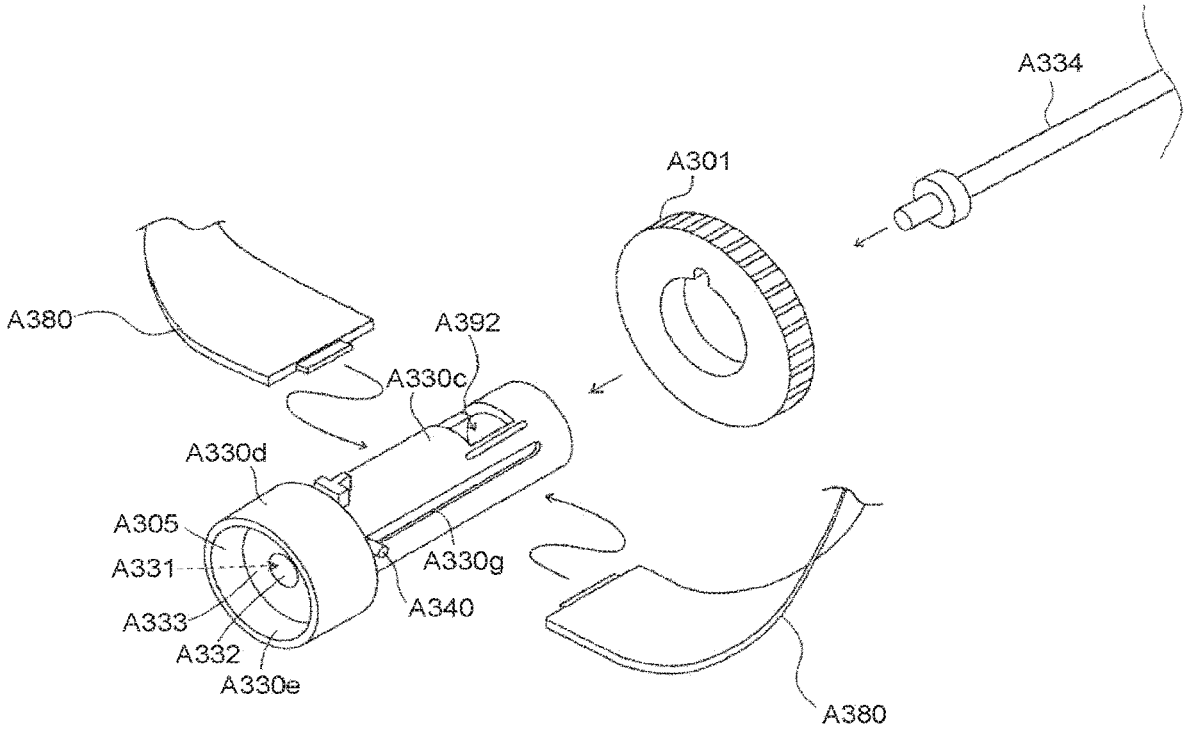
FIG. 47 is an explanatory exploded perspective view of the agitator assembly according to the tenth embodiment.
Figure 48:
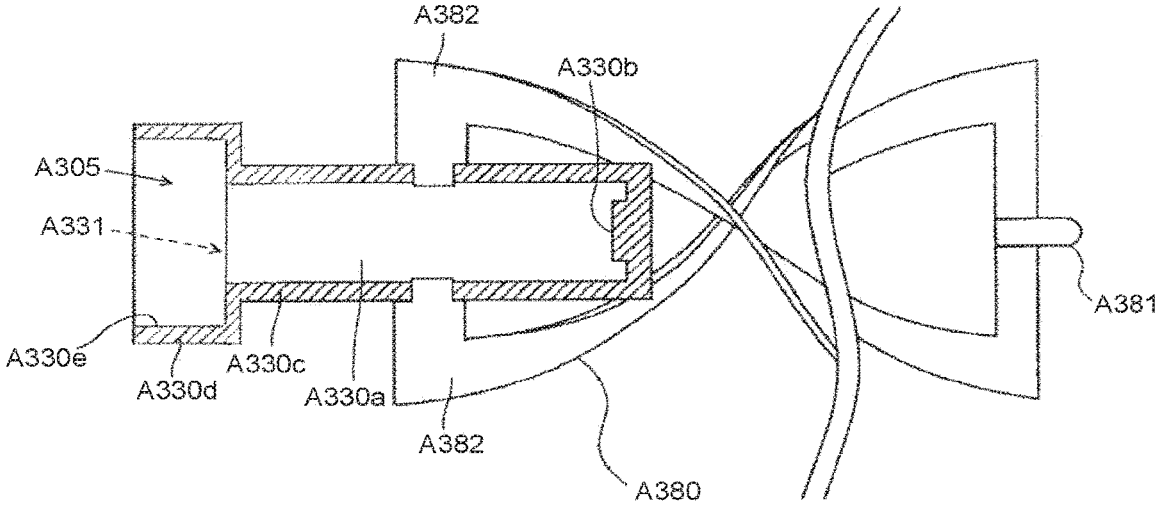
FIG. 48 is a transverse sectional view of a nozzle receiver and an agitating conveyor in a shaft-free configuration of the agitating conveyor according to the tenth embodiment.

FIG. 47 is an exploded perspective view of the agitator assembly A390 that includes the nozzle receiver A330 and the agitating conveyor A380. FIG. 48 is a transverse sectional view of the nozzle receiver A330 and the agitating conveyor A380 in a shaft-free configuration of the agitating conveyor A380.

As illustrated in FIGS. 46 and 47, the agitator assembly A390 is configured by assembling the container gear A301, two agitating conveyors A380, and a shaft A334 with respect to the nozzle receiver A330. After the container shutter spring A336 and the container shutter A332 are inserted and set in the nozzle receiving opening A331 of the nozzle receiver A330, a shutter pin A340 is inserted from a direction perpendicular to the rotational axis through the hole of the container shutter A332 and through a guiding slit 330*g* of the nozzle receiver A330. Moreover, the container shutter A332 can have a hook, and the container spring supporter A330*b* of the nozzle receiver A330 can have a hole in which the hook gets hooked. With that, the container shutter A332 and the nozzle receiver A330 can be assembled together.

The agitator assembly A390 receives the drive of the container driving gear 601 of the toner replenishing device 60 via the container gear A301. That causes the nozzle receiver A330 to rotate, and causes the agitating conveyors A380 to rotate. When the agitating conveyors A380 rotate, not only the toner T present in the container rear end side of the container body A033 is conveyed to the container front end side at which the toner receiving opening A392 is formed, but also the toner T present inside the container body A033 is unhardened. As described above, the lifting portions A382 are disposed at the container front end side of the agitating conveyors A380. Hence, when the agitating conveyors A380 rotate, the lifting portions A382 lift the toner T, which has been conveyed to the container front end side, up to the toner receiving opening A392 formed in the nozzle receiver A330; and run the toner T into the toner receiving opening A392. Then, the toner T that has entered the toner receiving opening A392 sequentially enters the conveying nozzle 611, which is inserted in the nozzle receiving opening A331 and which is communicated to the toner receiving opening A392, via the nozzle opening 610. As a result, the toner T is conveyed into the toner replenishing device 60.

In the example illustrated in FIG. 47, the container gear A301 and the nozzle receiver A330 are joined with the key convex A391 that is formed on the first outer surface A330*c* of the nozzle receiver A330. However, that is not the only possible configuration. Alternatively, the container gear A301 and the nozzle receiver A330 can be glued using an adhesive agent or can be fixed using a slide pin bolt. That is, as long as the drive can be transmitted from the toner replenishing device 60 to the nozzle receiver A330, any type of configuration can be adopted.

Still alternatively, the container gear A301 and the nozzle receiver A330 can be molded in an integrated manner, or the nozzle receiver A330 and the agitating conveyors A380 can be molded in an integrated manner.

That enables streamlining of the assembly process and achieving reduction in the cost.

Meanwhile, the shaft A334 is disposed to prevent center-runout (rotational irregularity) of the nozzle receiver A300 while it rotates. However, if the nozzle receiver A330 has a sufficient strength to avoid center-runout while it rotates, then it is possible to have a configuration not including a shaft as illustrated in FIG. 48. In such a configuration, a center pin A381 can be disposed at the container rear end side of the agitating conveyors A380 so that the agitating conveyors A380 are supported in a rotatable manner at the central part of the rear end lid A307.

Moreover, it is also possible to use a bearing in the portion within which the nozzle receiver A330 slides with the container front end cover A034 and the first container cover A308*a*. Herein, it is desirable that the bearing also has toner sealability.

When the toner container A032 having the configuration described above is inserted in the container holding section 70, the front end portion of the conveying nozzle 611 enters into the nozzle receiving opening A331. When the toner container A032 is further inserted in the container holding section 70, the front end portion of the conveying nozzle 611 abuts against the container shutter A332. As a result, the container shutter A332 gets pressed toward the container rear end side against the biasing force of the container shutter spring A336. Consequently, the container shutter A332 moves in the direction of the container rear end side, and the toner receiving opening A392 becomes communicated with the nozzle opening 610 of the conveying nozzle 611.

Once the toner receiving opening A392 becomes communicated with the nozzle opening 610 of the conveying nozzle 611, it becomes possible to take in (supply) the toner T. However, herein, the positional relationship between the toner receiving opening A392 and the lifting portions A382 of the agitating conveyors A380 is desirably set to positions that enable smooth entry of the toner T into the toner receiving opening A392.

Figure 49:
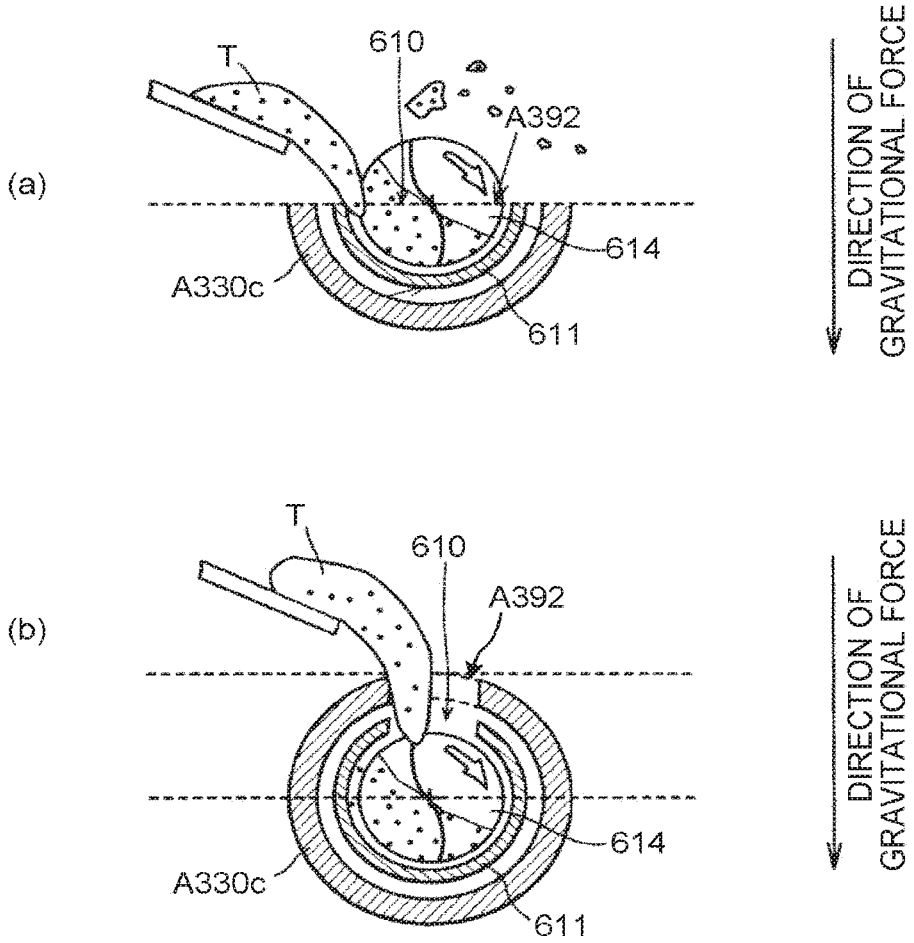
FIG. 49 illustrates a cross-section that is obtained by cutting the nozzle receiver, in which the conveying nozzle has been inserted, at a position of a toner receiving opening.

Illustrated in (b) of FIG. 49 is a cross-section that is obtained by cutting the nozzle receiver A330, in which the conveying nozzle 611 including the conveying screw 614 has been inserted, at the position of the toner receiving opening A392, and viewing the cross-section from the container front end side toward the container rear end side. Illustrated in (a) of FIG. 49 is a comparison diagram illustrating a configuration in which the nozzle opening 610 of the conveying nozzle 611 as well as the toner receiving opening A392 is disposed at the same height as the height of the center of rotation of the conveying screw 614. When the conveying screw 614 rotates in the clockwise direction with reference to FIG. 49, the toner T is conveyed to the toner replenishing device 60.

In the configuration illustrated in (a) of FIG. 49, the nozzle opening 610 and the toner receiving opening A392 open at the same height as the height of the center of rotation of the conveying screw 614 in the direction of gravitational force. Moreover, both those openings are wider than the diameter of the conveying screw 614. When the toner T is dropped from a higher position than the nozzle opening 610 and the toner receiving opening A392, it becomes possible to take in the toner T inside the conveying nozzle 611 from the nozzle opening 610 that is communicated via the toner receiving opening A392. However, the area of the conveying screw 614 that is covered by the conveying nozzle 611 represents the lower half area of the conveying screw 614. Thus, when the conveying screw 614 rotates in order to convey the toner T, which has been supplied via the nozzle opening 610, to the toner replenishing device 60; the toner T moves ahead in an inclined manner along with the rotation of the conveying screw 614. As a result, the toner T falls to the outside from the upper half area of the conveying nozzle 611. Because of that, the amount of toner that is conveyed by the conveying screw 614 to the toner replenishing device 60 decreases as compared to the amount of toner that was supplied into the conveying nozzle 611 via the toner receiving opening A392 and the nozzle opening 610.

In contrast, in the configuration illustrated in (b) of FIG. 49, the nozzle opening 610 and the toner receiving opening A392 open at positions that are not only higher than the center of rotation of the conveying screw 614 in the direction of gravitational force but also higher than the upper end of the conveying screw 614. Moreover, both those openings are narrower than the diameter of the conveying screw 614.

Thus, when the toner T is dropped from a higher position than the nozzle opening 610 and the toner receiving opening A392, it becomes possible to take in the toner T inside the conveying nozzle 611 from the nozzle opening 610 that is communicated via the toner receiving opening A392. In this configuration, the conveying screw 614 is covered by the conveying nozzle 611 up to an area on the upper side (up to the neighborhood of the upper end of the conveying screw 614) as compared to the configuration illustrated in (a) of FIG. 49. For that reason, when the conveying screw 614 rotates in order to convey the toner T, which has been supplied via the nozzle opening 610, to the toner replenishing device 60; the toner T moves ahead in an inclined manner along with the rotations. However, the toner T is held and conveyed inside the conveying nozzle 611 in such a way that the inner surface of the conveying nozzle 611 prevents the toner T from dropping to the outside. Thus, in the configuration illustrated in (b) of FIG. 49, the amount of toner that is conveyed by the conveying screw 614 to the toner replenishing device 60 substantially matches with the amount of toner that was supplied into the conveying nozzle 611 via the toner receiving opening A392 and the nozzle opening 610. That makes it easier to control the amount of toner that is supplied from the toner container A032 to the toner replenishing device 60.

Meanwhile, in the tenth embodiment, the nozzle receiver A330 includes the container shutter supporter A330*a* for supporting the container shutter 332, as well as holds the container shutter spring A336.

In the configuration illustrated in (a) of FIG. 49, the circumferential direction of the container shutter spring A336 is held by the inner surface (the container shutter supporter) A330*a* of the lower half of the nozzle receiver A330 in the direction of gravitational force. Moreover, at the container front end side of the container shutter spring A336 is disposed the container shutter A332, while the container rear end side of the container shutter spring A336 is held by the container spring supporter A330*b* of the nozzle receiver A330. In such a type of the nozzle receiver A330, the conveying nozzle 611 is inserted from the nozzle receiving opening A331. Then, the front end of the conveying nozzle 611 abuts against the container front end side of the container shutter A332. Thus, when the container shutter A332 moves toward the container rear end side; if compression of the container shutter spring A336 is attempted, the force of compression escapes in the upward direction thereby causing buckling of the container shutter spring A336 because the upper side of the container shutter spring A336 is not covered by the inner surface (the shutter supporter) A330*a* of the nozzle receiver A330. If buckling of the container shutter spring A336 occurs, the nozzle receiving opening A331 cannot close on its own. As a result, at the time of removing the toner container A032 from the toner replenishing device 60, the toner flies in all directions from the nozzle receiving opening A331.

In contrast, in the configuration illustrated in (b) of FIG. 49; except for the toner receiving opening A392, the circumferential area of the container shutter spring A336 is covered by the container shutter supporter A330*a*. When the conveying nozzle 611 is inserted from the nozzle receiving opening A331, the front end of the conveying nozzle 611 abuts against the container front end side of the container shutter A332. Then, when the container shutter A332 moves toward the container rear end side; if compression of the container shutter spring A336 is attempted, the force of compression is regulated from escaping in the upward direction because the container shutter spring A336 is held also from the circumferential direction by the inner surface (the shutter supporter) A330*a* of the nozzle receiver A330. Hence, the container shutter spring gets compressed in the direction of movement of the container shutter A332. For that reason, in the configuration illustrated in (b) of FIG. 49, it becomes possible to prevent a situation in which buckling of the container shutter spring A336 occurs and the nozzle receiving opening A331 cannot close on its own.

In this way, as compared to the configuration illustrated in (a) of FIG. 49 in which the nozzle opening 610 and the toner receiving opening A392 open substantially at the same height as the height of the center of rotation of the conveying screw 614 in the direction of gravitational force; in the configuration illustrated in (b) of FIG. 49 in which the nozzle opening 610 and the toner receiving opening A392 open at positions that are higher than the center of rotation of the conveying screw 614 in the direction of gravitational force, it can be expected to have stability in the amount of supplied toner and to achieve prevention of toner scattering. However, it is necessary to lift the toner up to a higher position against the direction of gravitational force. Moreover, as compared to the configuration illustrated in (a) of FIG. 49, in the configuration illustrated in (b) of FIG. 49 in which the nozzle opening 610 and the toner receiving opening A392 are formed at positions that are higher than the center of rotation of the conveying screw 614 in the direction of gravitational force, the openings becomes narrower. For that reason, it becomes possible to run the toner T smoothly into the nozzle opening 610 at the timing at which the nozzle opening 610 and the toner receiving opening A392 become communicated.

As examples of an accumulating portion according to the tenth embodiment, given below is the explanation of a plurality of exemplary configurations for lifting the toner up to the upper side of the toner receiving opening A392 and running the toner into the toner receiving opening A392.

FIGS. 50 to 55 are explanatory diagrams for explaining positional relationships in the direction of rotation between the toner receiving opening A392 and the lifting portions of the agitating conveyor A380 that enable smooth entry of the toner T into the toner receiving opening A392.

In order to ensure that the toner T, which has been conveyed to the container front end side inside the container body A033, is lifted smoothly by the lifting portions A382 of the agitating conveyors A380 and is run into the toner receiving opening A392, it is desirable to have a configuration in which the toner accumulates in the neighborhood of the lifting portions A382. In that regard, the important factor is the mounting angles of the lifting portions A382 with respect to the first outer surface A339*c*, which has the toner receiving opening A392 of the nozzle receiver formed thereon.

Figure 50:
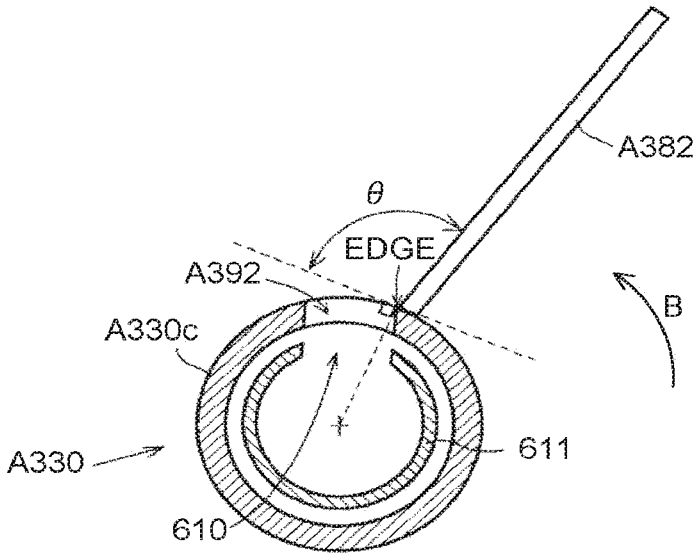
FIG. 50 is a cross-sectional view of the neighborhood of the toner receiving opening according to the tenth embodiment at the time when the toner receiving opening and the lifting portion are viewed from the container rear end side toward the container front end side in the rotational axis direction.

FIG. 50 is a cross-sectional view of the neighborhood of the toner receiving opening A392 of the nozzle receiver A330 at the time when the toner receiving opening A392 and the lifting portions A382 of the agitating conveyors A380 are viewed from the container rear end side toward the container front end side in the rotational axis direction (shaft direction). Herein, the nozzle receiver A330, which has the toner receiving opening A392 formed thereon, and the agitator assembly A390, which includes the agitating conveyors A380, are configured to rotate in the counterclockwise direction with reference to FIG. 50.

In FIG. 50, only a single set of the toner receiving opening A392 and the lifting portion A382, which is included in the agitating conveyor A380, is illustrated as a representative example. However, alternatively, as illustrated in FIG. 45 according to the tenth embodiment, one more set of the toner receiving opening A392 and the lifting portion A382, which is included in the agitating conveyor A380, can be disposed at the point-symmetric position with respect to the center of rotation. Still alternatively, it is also possible to have more than two sets of the toner receiving opening A392 and the lifting portion A382. That is, the number of sets of the toner receiving opening A392 and the lifting portion A382 can be determined according to the desired toner replenishing speed. In the case of having a plurality of sets of the toner receiving opening A392 and the lifting portion A382, which is included in the agitating conveyor A380; it is desirable to arrange the toner receiving openings A392 at equally-spaced intervals. That makes it possible to maintain a regular time interval for running the toner into the toner receiving openings A392.

In the example illustrated in FIG. 50, the agitating conveyor A380 is attached to the nozzle receiver A330 in such a way that the lifting portion A382 makes an angle θ with respect to the tangential direction at the upstream side edge of the toner receiving opening A392 in the direction of rotation of the nozzle receiver A330 (i.e., makes an angle θ with respect to a dashed line illustrated in FIG. 50). More particularly, the angle θ points to the angle made by the base surface on the toner receiving opening side of the lifting portion A382 with respect to a normal line that is perpendicular to the imaginary straight line which links a rotational center of the nozzle receiver A330 and upstream side edge of the toner receiving opening A392 in the direction of rotation of the nozzle receiver A330. As far as the function of running the toner T smoothly into the toner receiving opening A392 using the lifting portion A382 is concerned, the relationship between the surface on the toner receiving opening side of the lifting portion A382 and the toner receiving opening A392 is of paramount importance. In FIG. 50, the angle θ is illustrated to be an obtuse angle. When the toner receiving opening A392 is positioned on the upper side, the configuration is open with respect to the toner receiving opening A392 in such a way that the lifting portion A382 becomes an inclined surface. With that, the lifting portion A382 can be used as the accumulating portion that holds the toner T and lifts it up to a higher position than the toner receiving opening A392 against the direction of gravitational force.

Figure 51:
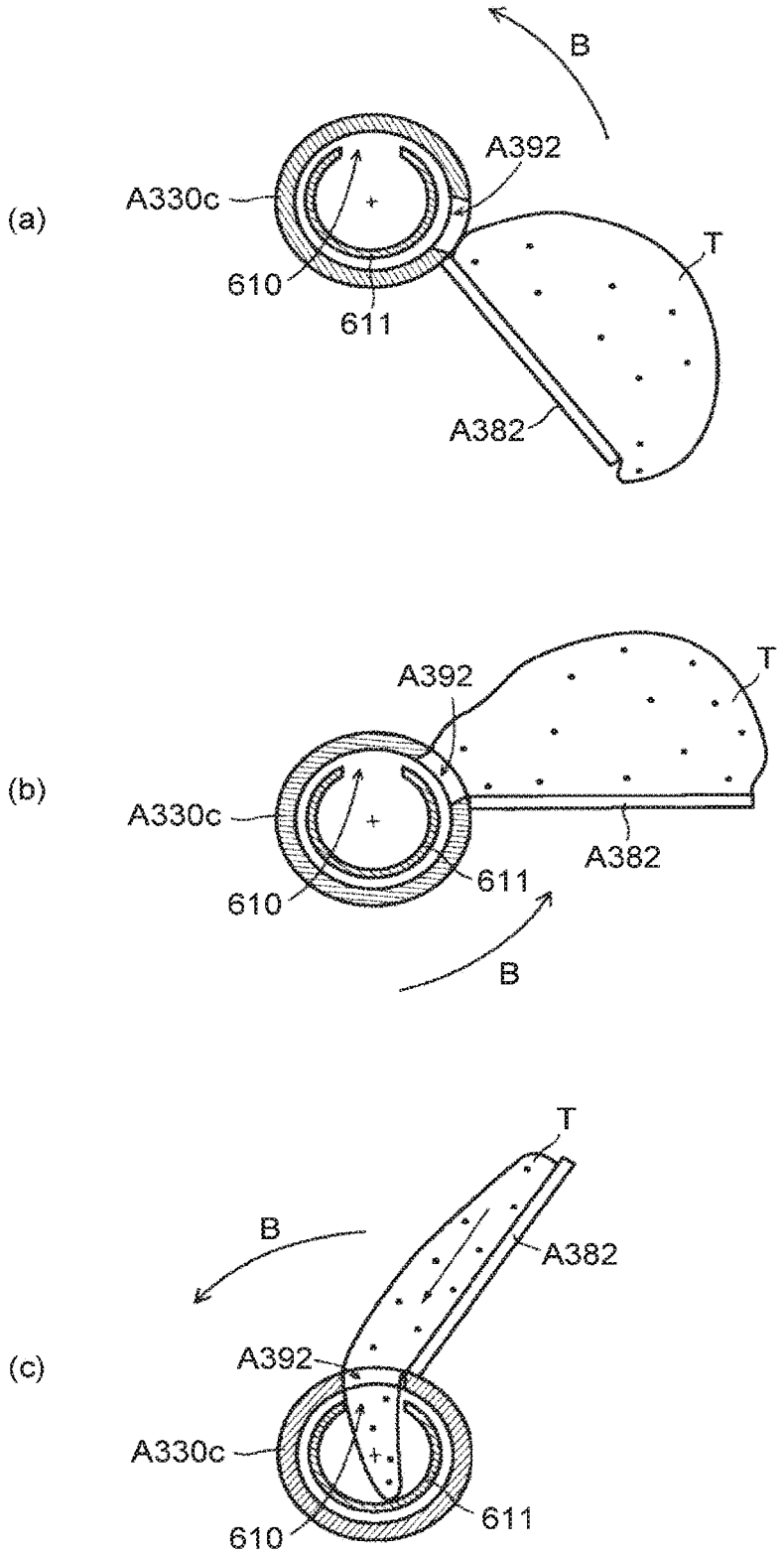
FIG. 51 illustrates sequent conditions in which a toner T is guided into the toner receiving opening using the configuration of the toner receiving opening and the lifting portion as sequentially illustrated in FIG. 50 in which an angle θ is an obtuse angle.

FIG. 51 illustrates conditions in which the toner T is lifted up to a higher position than the toner receiving opening A392 and is then guided into the toner receiving opening A392 using the configuration of the toner receiving opening A392 and the lifting portion A382 as illustrated in FIG. 50 in which the angle θ is an obtuse angle. In chronological order, the condition illustrated in (b) of FIG. 51 is subsequent to the condition illustrated in (a) of FIG. 51, and the condition illustrated in (c) of FIG. 51 is subsequent to the condition illustrated in (b) of FIG. 51. Meanwhile, for the sake of simplicity in the explanation with reference to FIG. 51, the conveying screw 614 of the conveying nozzle 611, which is inserted in the nozzle receiver A330, is not illustrated.

In the condition in which the toner container A032 is attached to the toner replenishing device 60, when the driving motor 603 is driven so that the drive from the container driving gear 601 of the toner replenishing device 60 is transmitted to the container gear A301 thereby resulting in the rotation of the nozzle receiver A330 in the direction of the arrow B illustrated in (a) of FIG. 51; the toner T present in the neighborhood of the lifting portion A382 is lifted. When the nozzle receiver A330 further rotates in the direction of the arrow B illustrated in (a) of FIG. 51, the lifting portion A382 reaches a substantially horizontally-extending condition as illustrated in (b) of FIG. 51 and the toner T gets mounted on the lifting portion A382. When the nozzle receiver A330 further rotates in the direction of the arrow B illustrated in (b) of FIG. 51, the lifting portion A382 reaches a condition in which it makes an inclined surface with respect to the toner receiving opening A392 as illustrated in (c) of FIG. 51 (i.e., reaches the condition illustrated in FIG. 50) and the toner T that had mounted on the lifting portion A382 is further lifted. As a result, the toner T slides along the inclined surface into the toner receiving opening A392.

Then, through the toner receiving opening A392, the toner T falls into the nozzle opening 610 of the conveying nozzle 611 that has been inserted into the nozzle receiver A330. Then, due to the rotation of the conveying screw 614, the toner T is supplied to the toner replenishing device 60. In this way, in the configuration illustrated in FIG. 50 in which the agitating conveyor A380 is attached to the nozzle receiver A330 in such a way that the lifting portion A382 makes an obtuse angle θ with respect to the tangential direction (illustrated by a dashed line in FIG. 50) at the upstream side edge of the toner receiving opening A392 in the direction of rotation of the nozzle receiver A330; since the lifting portion is disposed for lifting the toner against the direction of gravitational force up to a position higher than the toner receiving opening, it becomes possible to guide the lifted toner to the toner receiving opening of the conveying nozzle while preventing the lifted toner from falling out of the conveying nozzle.

Meanwhile, in the cross-section perpendicular to the rotational axis direction, the cross-sectional shape of the lifting portion A382 is not limited to the straight line as illustrated in FIG. 50 and in FIG. 51. Alternatively, as illustrated in (A) OF FIG. 52, the lifting portion A382 of the agitating conveyor A380 can have such a bending shape that the end portion of the lifting portion A382 on the side which is opposite to the side attached in the neighborhood of the toner receiving opening A392 and which extends toward the inner surface of the container body A033 is bent toward the downstream side in the direction of rotation indicated by the arrow B in (a) of FIG. 52. In other words, the lifting portion A382 serves as the accumulating portion and includes a concave portion which is formed to be bent at the portion between the base of the lifting portion A382 and the end of the lifting portion A382. Alternatively, as illustrated in (b) of FIG. 52, the lifting portion A382 of the agitating conveyor A380 can have such a curved shape that the entire lifting portion A382 extending toward the inner surface of the container body A033 is set to have a predetermined curvature that is sunken with respect to the direction of the arrow B illustrated in (b) of FIG. 52. In other words, the lifting portion A382 serves as the accumulating portion and includes a concave portion which is formed to be curved at the portion between the base of the lifting portion A382 and the end of the lifting portion A382. Herein, although the entire lifting portion A382 is illustrated to have a curved shape in (b) of FIG. 52; only some portion such as the portion in the neighborhood of the side extending toward the inner surface of the container body A033 can have a curved shape. Still alternatively, as illustrated in (c) of FIG. 52, the lifting portion can have a multi-bending shape obtained by further bending the end portion of the bending shape illustrated in (a) of FIG. 52. In other words, the lifting portion A382 serves as the accumulating portion and includes a concave portion which is formed to be bent in a same direction at a plurality of positions between the base of the lifting portion A382 and the end of the lifting portion A382.

Figure 52:
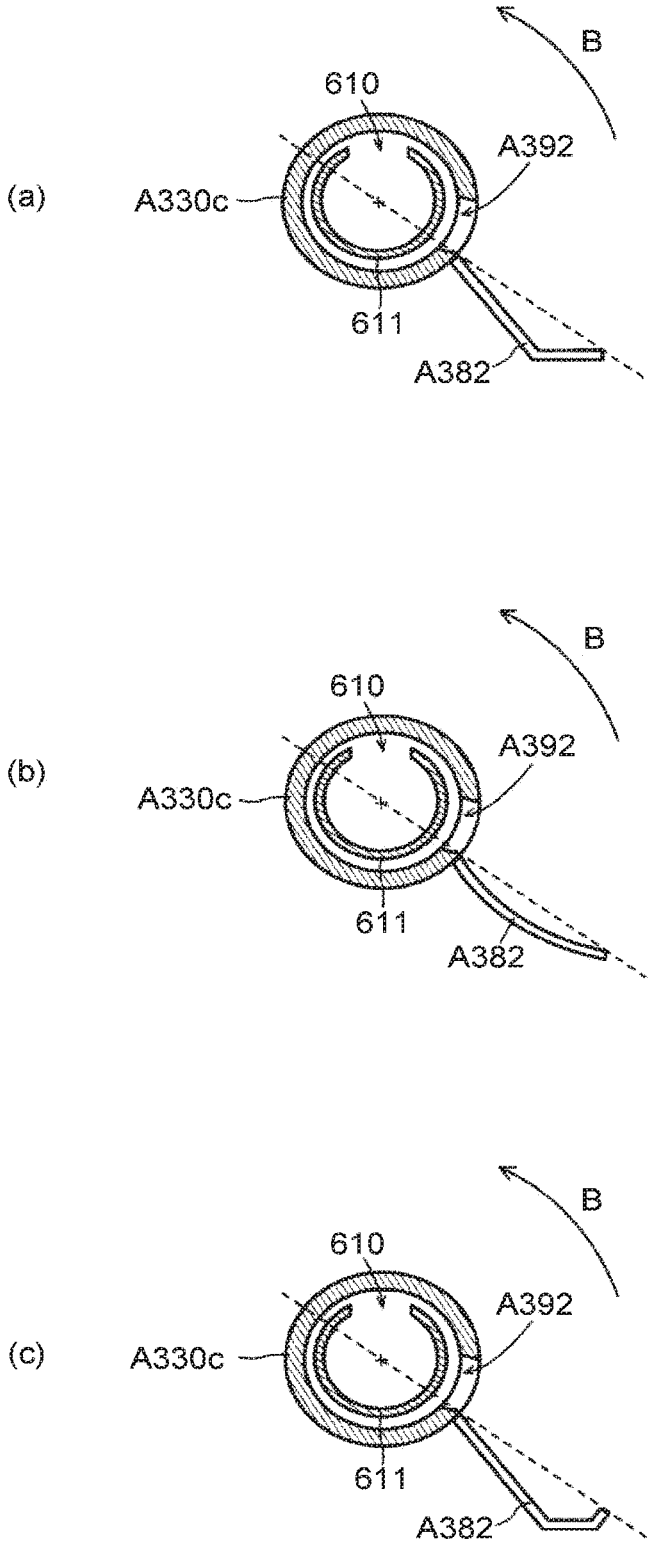
FIG. 52 illustrates configurations in which the lifting portion has bending shapes.

Thus, in FIG. 52, in the cross-section perpendicular to the rotational axis direction, the cross-sectional shape of the lifting portion A382 of the agitating conveyor A380 is a bending shape that is sunken with respect to the direction of the arrow B illustrated in FIG. 52. As a result of such cross-sectional shapes, it becomes easier to hold the lifted toner T on the lifting portion A382. Moreover, in an identical manner to the configuration illustrated in FIG. 50, the agitating conveyor A380 is attached to the nozzle receiver A330 in such a way that the lifting portion A382 makes an obtuse angle θ with respect to the tangential direction at the upstream side edge of the toner receiving opening A392 in the direction of rotation of the nozzle receiver A330. For that reason, the toner T held on the lifting portion A382 can slide more easily into the toner receiving opening A392.

Figure 53:
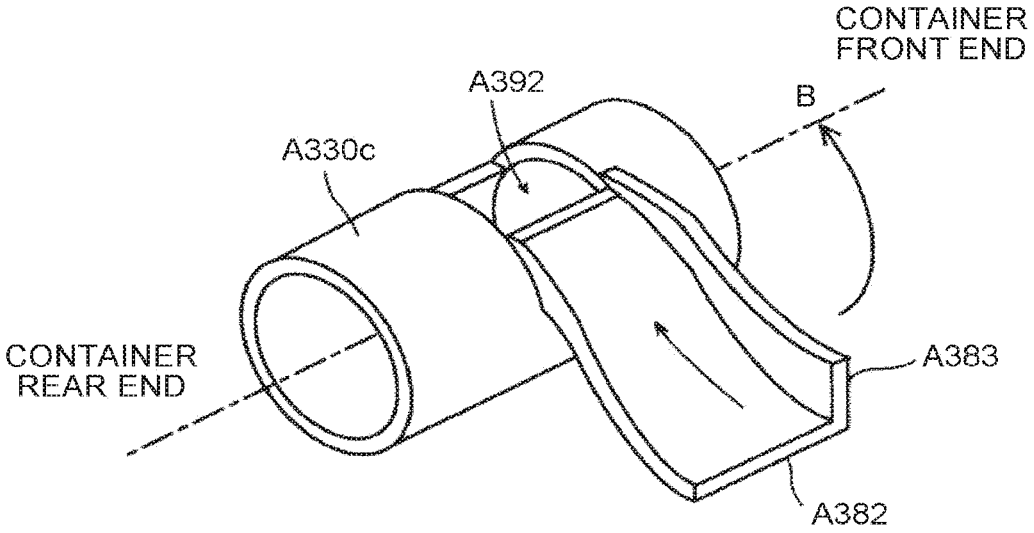
FIG. 53 is an explanatory diagram for explaining a configuration according to the tenth embodiment in which an anti-drop wall is erected from the side surface at the container front end side of the lifting portion.

FIG. 53 is an explanatory diagram for explaining a configuration in which an anti-drop wall A383 is erected from the side surface at the container front end side of the lifting portion A382 of the agitating conveyor A380. Since the agitating conveyor A380 applies a conveying force to the toner T in the direction from the container rear end side toward the container front end side, the toner T present at the position of the lifting portion A382 is also identically subject to a conveying force from the container rear end side toward the container front end side. Because of such conveying force, the toner T present on the lifting portion A382 sometimes falls out from the container front end side of the lifting portion A382. In that regard, the anti-drop wall A383 is erected from the side surface at the container front end side of the lifting portion A382. As a result of erecting the anti-drop wall A383, it becomes possible to effectively reduce the instances in which the toner T present on the lifting portion A382 falls out from the container front end side of the lifting portion A382.

Meanwhile, in FIG. 53, in the cross-section perpendicular to the rotational axis direction, the cross-sectional shape of the lifting portion A382 of the agitating conveyor A380 is a slide-like shape that is curved at two positions, namely, in the neighborhood of the attached portion and in the neighborhood of the end portion. In such a cross-sectional shape too, the bending shapes are sunken with respect to the direction of the arrow B illustrated in FIG. 53. Hence, in an identical manner to the configuration illustrated in FIG. 52, it becomes easier to hold the lifted toner T on the lifting portion A382. Moreover, in an identical manner to the configuration illustrated in FIG. 50, the agitating conveyor A380 is attached to the nozzle receiver A330 in such a way that the lifting portion A382 makes an obtuse angle θ with respect to the tangential direction at the upstream side edge of the toner receiving opening A392 in the direction of rotation of the nozzle receiver A330. For that reason, the toner T held on the lifting portion A382 can slide more easily into the toner receiving opening A392.

Herein, the anti-drop wall A383 explained with reference to FIG. 53 can also be erected on the lifting portion A382 of the agitating conveyor A380 illustrated in FIG. 50 or in FIG. 52. In that case, in an identical manner to the configuration illustrated in FIG. 53, it becomes possible to effectively reduce the instances in which the toner T present on the lifting portion A382 falls out from the container front end side of the lifting portion A382.

Figure 54:
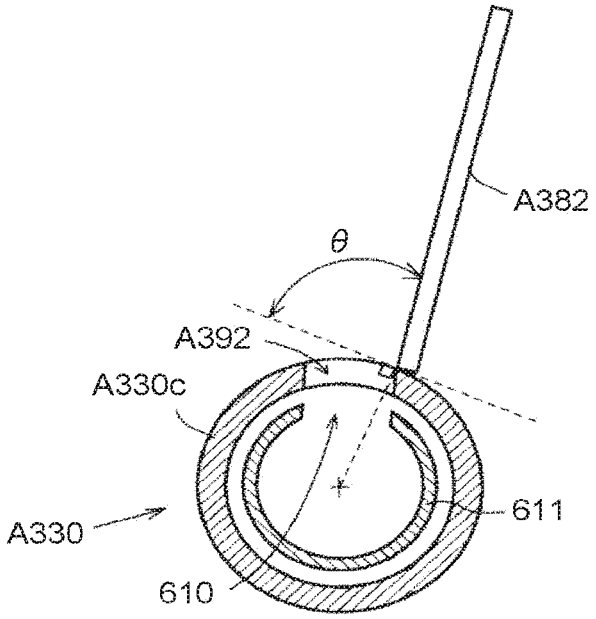
FIG. 54 is a cross-sectional view of the neighborhood of the toner receiving opening according to the tenth embodiment at the time when the toner receiving opening and the lifting portion are viewed from the container rear end side toward the container front end side in the rotational axis direction.

In an identical manner to FIG. 50; FIG. 54 is a cross-sectional view of the neighborhood of the toner receiving opening A392 of the nozzle receiver A330 at the time when the toner receiving opening A392 and the lifting portion A382 of the agitating conveyor A380 are viewed from the container rear end side toward the container front end side in the rotational axis direction.

The configuration illustrated in FIG. 54 is identical to the configuration illustrated in FIG. 50 except for the point that the lifting portion A382 makes an acute angle θ with respect to the tangential direction (illustrated by a dashed line in FIG. 54) at the upstream side edge of the toner receiving opening A392 in the direction of rotation of the nozzle receiver A330.

Figure 55:
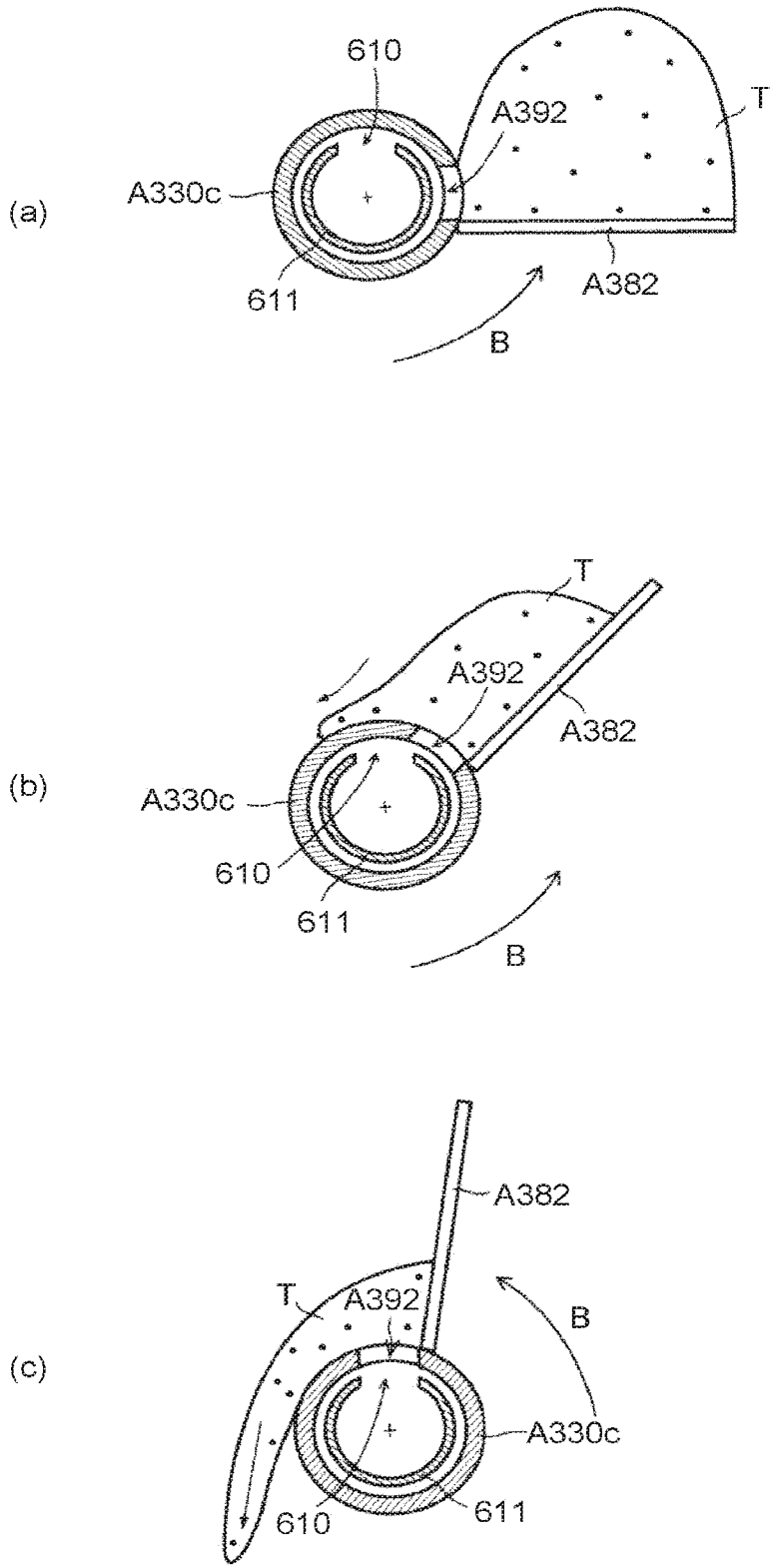
FIG. 55 illustrates sequent conditions in which the toner T is guided into the toner receiving opening using the configuration of the toner receiving opening and the lifting portion as sequentially illustrated in FIG. 54 in which the angle θ is an acute angle.

FIG. 55 illustrates conditions in which the toner T is guided into the toner receiving opening A392 using the configuration of the toner receiving opening A392 and the lifting portion A382 as illustrated in FIG. 54 in which the angle θ is an acute angle. In chronological order, the condition illustrated in (b) of FIG. 55 is subsequent to the condition illustrated in (a) of FIG. 55, and the condition illustrated in (c) of FIG. 55 is subsequent to the condition illustrated in (b) of FIG. 55. Meanwhile, for the sake of simplicity in the explanation with reference to FIG. 55, the conveying screw 614 of the conveying nozzle 611, which is inserted in the nozzle receiver A330, is not illustrated.

In the condition in which the toner container A032 is attached to the toner replenishing device 60, when the driving motor 603 is driven so that the drive from the container driving gear 601 of the toner replenishing device 60 is transmitted to the container gear A301, the nozzle receiver A330 starts rotating and the lifting portion A382 of the nozzle receiver A330 starts rotating. In the condition illustrated in (a) of FIG. 55 in which the lifting portion A382 extends in a substantially horizontal direction, the toner T gets mounted on the lifting portion A382. When the nozzle receiver A330 further rotates in the direction of the arrow B illustrated in (a) of FIG. 55, the lifting portion A382 reaches a condition in which it makes an inclined surface with respect to the toner receiving opening A392 as illustrated in (b) of FIG. 55. However, in order to receive the toner T falling down by gravity, the nozzle opening 610 of the conveying nozzle 611 is open upward with reference to FIG.

55. Hence, in the condition illustrated in (b) of FIG. 55, the toner receiving opening A392 and the nozzle opening 610 are not communicated. As a result, the toner T cannot be supplied into the conveying nozzle 611 via the toner receiving opening A392 and the nozzle opening 610.

When the nozzle receiver A330 further rotates in the direction of the arrow B illustrated in (b) of FIG. 55, the toner T starts falling down due to its own gravity before the toner receiving opening 393 and the nozzle opening 610 become communicated. Hence, in the condition illustrated in (c) of FIG. 55 in which the toner receiving opening A392 and the nozzle opening 610 become communicated, the toner T that was lifted by the lifting portion A382 remains only in a small amount in the neighborhood of the toner receiving opening A392. As a result, only a small amount of toner gets supplied to the toner replenishing device 60 through the nozzle opening 610.

As explained with reference to FIG. 55, if the lifting portion A382 makes an acute angle θ with respect to the tangential direction (illustrated by a dashed line in FIG. 55) at the upstream side edge of the toner receiving opening A392 in the direction of rotation of the nozzle receiver A330, then only a small amount of toner gets supplied to the toner replenishing device 60 through the nozzle opening 610 as compared to the configurations illustrated in FIG. 50, FIG. 51, and FIG. 52 in which the angle θ is an obtuse angle.

Still, if a plurality of sets of the toner receiving opening A392 and the lifting portion A382 of the agitating conveyor A380 is disposed, then the amount of supplied toner per rotation of the agitator assembly A390 can be increased. Moreover, if a sufficient amount of supplied toner can be ensured according to the relationship between the number of rotations of the agitator assembly A390 and the amount of supplied toner, then it is possible to adopt the configuration illustrated in FIG. 55.

Given below is the explanation of the operation of fitting the toner container A032 into the toner replenishing device 60.

As indicated by the arrow Q illustrated in FIG. 44 or FIG. 42, when the toner container A032 is moved in the direction of the toner replenishing device 60, the nozzle front end of the conveying nozzle 611 gets inserted in the nozzle receiving opening A331. When the toner container A032 is further moved in the direction of the toner replenishing device 60, the front end 611*a* of the conveying nozzle 611 comes in contact with the end surface at the container front end side of the container shutter A332. When the toner container A032 is further moved in the direction of the toner replenishing device 60, the conveying nozzle 611 presses the end surface at the container front end side of the container shutter A332. Because of that, the container shutter spring A336 undergoes compression. Consequently, the container shutter A332 is pressed to the inward side of the toner container A032 (i.e., pressed to the container rear end side). At that time, the nozzle shutter tube 612*e*, which is positioned more toward the nozzle front end as compared to the nozzle shutter flange 612*a* in the nozzle shutter 612, gets inserted in the nozzle receiving opening 331 along with the conveying nozzle 611.

When the toner container A032 is further moved in the direction of the toner replenishing device 60, the surface of the nozzle shutter flange 612*a* that is opposite to the nozzle shutter spring receiving surface 612*f* comes in contact with the container front end side of the container seal A333. As a result, the relative position in the rotational axis direction (shaft direction) of the nozzle shutter 612 with respect to the toner container A032 gets fixed.

When the toner container A032 is further moved in the direction of the toner replenishing device 60, the conveying nozzle 611 gets further inserted on the inward side of the toner container A032. At that time, the nozzle shutter 612 that had come into contact with the container front end side of the container seal A333 is pushed back to the nozzle base end with respect to the conveying nozzle 611. As a result, the nozzle shutter spring 613 undergoes compression and the relative position of the nozzle shutter 612 with respect to the conveying nozzle 611 moves to the nozzle base end. Accompanying the movement of the relative position, the nozzle opening 610 that was covered by the nozzle shutter 612 gets exposed inside the container body A033, and the inside of the container body A033 becomes communicated with the inside of the conveying nozzle 611.

In the condition in which the conveying nozzle 611 is inserted in the nozzle receiving opening A331; due the biasing force of the container shutter spring A336 in the compressed state or the biasing force of the nozzle shutter spring 613 in the compressed state, a force acts in the direction of pushing back the toner container A032 with respect to the toner replenishing device 60 (i.e. a force acts in the opposite direction to the direction of the arrow Q illustrated in FIG. 44 or FIG. 42). However, at the time of fitting the toner container A032 into the toner replenishing device 60, the toner container A032 is moved in the direction of the toner replenishing device 60 against the abovementioned force until the container engaged portions A339 get engaged with the replenishing device engaging members 609. As a result, there is an action of the biasing force of the container shutter spring A336 and the biasing force of the nozzle shutter spring 613; as well as there is an action of the engagement of the container engaged portions A339 with respect to the replenishing device engaging members 609. Because of such action of the biasing force and the engagement, in the condition illustrated in FIG. 45, the positioning in the rotational axis direction (shaft direction) of the toner container A032 with respect to the toner replenishing device 60 is done.

As illustrated in FIG. 44, each container engaged portion A339 includes a guiding protrusion A339*a*, a guiding gutter A339*b*, a bump A339*c*, and a quadrangular engaged hole A339*d*. With these constituent elements forming a single set, two such sets are arranged to form a pair of container engaged portions A339 on both sides of the container front end cover A034 with respect to an imaginary vertical line passing through the nozzle receiving opening A331. Each guiding protrusion A339*a* is disposed on the vertical plane at the front end side of the container front end cover A034. And guiding protrusions A339*a* are on the imaginary horizontal line passing through the center of the nozzle receiving opening A331. Moreover, each guiding protrusion A339*a* has an inclined surface that is linked to the corresponding guiding gutter A339*b* in such a way that, at the time of fitting the toner container A032, the replenishing device engaging members 609 abut against the guiding protrusions A339*a* and are guided toward the guiding gutter A339*b*. Herein, each guiding gutter A339*b* is formed at a lower level than the side peripheral surface of the container front end cover A034.

Moreover, the gutter width of the guiding gutters A339*b* is slightly greater than the width of the replenishing device engaging members 609, and is set to such an extent that the replenishing device engaging members 609 do not drop out from the gutters.

The container rear end side of each guiding gutter 339*b* is not directly linked to the corresponding engaged hole A339*d*; but has a dead end. Moreover, the container rear end side of each guiding gutter 339*b* has the same height as the height of the side peripheral surface of the container front end cover A034. That is, between each guiding gutter A339*b* and the corresponding engaged hole A339*d* is present the outer surface of about 1 mm thickness of the container front end cover A034. That portion corresponds to the corresponding bump A339*c*. The replenishing device engaging members 609 climb over the bumps A339*c* and land into the engaged holes A339*d*. With that, the engagement of the toner container A032 with respect to the toner replenishing device 60 is accomplished.

In the toner container A032 according to the tenth embodiment, the container front end cover A034 includes the first container cover A308*a*. Since the first container cover A308*a* is attached to the container front end cover A034 from the container front end side, the first container cover A308*a* covers the container front end cover A034 from the outside. Thus, when slits are formed on the first container cover A308*a* and when those slits fit with the engaged holes A339*d* formed on the container front end cover A034, the slits can also serve as the guiding gutters A339*b*.

The toner container A032 is configured in such a way that, on an imaginary plane that is orthogonal to the rotational axis, the container shutter A332 is positioned in the center of the line segment that joins the two container engaged portions A339. If the container shutter A332 is not positioned on the line segment that joins the two container engaged portions A339, then there arises the following possibility. That is, due to the biasing force of the container shutter spring 336 and the nozzle shutter spring 613, the distance from the line segment to the container shutter A332 functions as the arm of moment and there occurs an action of the moment of force which rotates the toner container A032 around the line segment. Because of the action of the moment of the force, there is a possibility that the toner container A032 tilts with respect to the toner replenishing device 60. In that case, there occurs an increase in the fitting load of the toner container A032, and the nozzle receiver A330 that holds and guides the container shutter A332 comes under strain.

Particularly, in the case of a new toner container A032 sufficiently filled with the toner, when the horizontally-protruding conveying nozzle 611 is pushed from the rear end of the toner container A032 for insertion in the toner container A032, the moment of force for rotating the toner container A032 acts by also taking into account the toner weight. As a result, there is a possibility that the nozzle receiver A330, in which the conveying nozzle 611 is inserted, comes under strain and, at worst, undergoes deformation or breaks down. In contrast, in the toner container A032 according to the tenth embodiment, the container shutter A332 is positioned on the line segment of the two container engaged portions A339. For that reason, due to the biasing force of the container shutter spring A336 and the nozzle shutter spring 613 acting at the position of the container shutter A332, it becomes possible to prevent the toner container A032 from tilting with respect to the toner replenishing device 60.

Meanwhile, as illustrated in FIG. 45, in the condition in which the toner container A032 is attached to the toner replenishing device 60, the end surface at the container front end side of the toner receiver A330 in the toner container A032 does not come in contact with the end surface 615*b* of the container setting section 615. That is because of the following reason. Assume a configuration in which the end surface at the container front end side of the nozzle receiver A330 comes in contact with the end surface 615*b* of the container setting section 615. In such a case, before the engaged holes A339*d* of the container engaged portions A339 get hooked in the replenishing device engaging members 609, there is a possibility that the end surface at the container front end side of the nozzle receiver A330 makes contact against the end surface 615*b* of the container setting section 615. If such a contact occurs, then the toner container A032 cannot be moved any further in the direction of the toner replenishing device 60. In order to prevent such a case, in the condition in which the toner container A032 is attached to the toner replenishing device 60, a small clearance gap is maintained between the end surface at the container front end side of the nozzle receiver A330 and the end surface 615*b* of the container setting section 615.

In the condition in which the positioning in the rotational axis direction (shaft direction) is done in the abovementioned manner, the second outer surface A330*d* of the nozzle receiver A330 fits in a slidable manner in the inner surface 615*a* of the container setting section 615. For that reason, as described above, the positioning of the toner container A032 with respect to the toner replenishing device 60 is done in the planar direction orthogonal to the rotational axis (the planar direction is corresponding to a radial direction of the nozzle receiver A330). With that, the fitting of the toner container A032 into the toner replenishing device 60 is completed.

Once the fitting of the toner container A032 is completed, when the driving motor 603 is rotary-driven, the agitator assembly A390 of the toner container A032 rotates as well as the conveying screw 614 in the conveying nozzle 611 rotates.

Because of the rotation of the agitating conveyors A380 in the agitator assembly A390, the toner T inside the container body A033 is conveyed to the container front end side of the container body A033 and reaches the lifting portions A382. Then, the rotation of the agitating conveyors A380 makes the lifting portions A382 to lift the toner T to the upper side of the toner receiving opening A392. The toner T that has been lifted up to the upper side of the toner receiving opening A392 falls into the nozzle opening 610 that is communicated with the toner receiving opening A392. As a result, the toner T is supplied in the conveying nozzle 611. Subsequently, the toner T supplied in the conveying nozzle 611 is conveyed ahead by the conveying screw 614 through the toner dropping passage 64 to the developing device 50. The flow of the toner T from the inside of the container body A033 up to the toner dropping passage 64 is indicated by the arrow β illustrated in FIG. 45.

Moreover, as described above, the position at which the second outer surface A330*d* of the nozzle receiver A330 comes in contact in a slidable manner with the container setting section 615 and at which the positioning of the toner container A032 with respect to the toner replenishing device 60 is done is indicated by α in FIG. 45. However, the position indicated by α in FIG. 45 is not limited to having the function of a sliding portion as well as a position determining portion. Alternatively, the configuration can be such that the position indicated by α in FIG. 45 has the function of either a sliding portion or a position determining portion.

Furthermore, as described above, when the toner container A032 is attached to the toner replenishing device 60, the container seal A333 is flattened out by the nozzle shutter flange 612*a*. As a result, the nozzle shutter flange 612*a* fits tightly and with pressure to the container seal A333. That enables achieving prevention of toner leakage in a more reliable manner. By having the configuration in which the container shutter A332 is disposed more toward the inward side in the longitudinal direction (toward the container front end side) as compared to the opening position, a cylindrical space is formed from the front end of the nozzle receiver A330 to the end surface at the container front end side of the container shutter A332 and the container seal A333.

In the condition in which the toner container A032 is not attached to the toner replenishing device 60, the nozzle opening 610 of the conveying nozzle 611 is shut by the nozzle shutter 612. In the condition in which the toner container A032 is attached to the toner replenishing device 60, it becomes necessary to open the nozzle shutter 612 so that the toner can be received.

In the toner replenishing device 60, a cylindrical space (the front end opening A305) is formed from the end portion at the container front end side of the nozzle receiver A330 to the end surface at the container front end side of the container shutter A332 and the container seal A333. Inside that space is formed a withdrawal space in which the withdrawal space of the nozzle shutter 612 in the open state fits entirely or partially. Moreover, in that withdrawal space, the nozzle shutter spring 613 used for closing the nozzle shutter 612 fits entirely or partially. With such a configuration, it becomes possible to reduce the space required to dispose the nozzle shutter 612 and the nozzle shutter spring 613.

As illustrated in FIG. 45, in the tenth embodiment, in the condition in which the toner container A032 is attached to the toner replenishing device 60, the withdrawal position of the nozzle shutter 612 has the nozzle front end positioned more on the inward side of the container seal A333 as compared to the nozzle shutter flange 612*a*. Moreover, the portion of the withdrawal position that is more toward the nozzle base end than the nozzle shutter flange 612*a* substantially fits in the cylindrical space formed between the opening position of the front end opening A305 (the end portion at the container front end side) and the end surface at the container front end side of the container seal A333. Furthermore, the nozzle shutter spring 613 in the compressed state also substantially fits in that cylindrical space.

With such a configuration, the distance from the opening position of the front end opening A305, which is the foremost end of the toner container A032, to the toner falling portion in the toner replenishing device 60 (i.e., the position at which the toner dropping passage 64 is connected to the conveying nozzle 611) can be shortened. As a result, it becomes possible to downsize the main body of the copier 500.

Given below is the explanation regarding the holding mechanism of the IC tag (the ID tag, the ID chip, or the IC chip) 700 that is disposed in the toner container A032 according to the tenth embodiment. Herein, in the tenth embodiment, an IC tag (an ID tag or an information memory device) and a holding mechanism identical to that explained in the first embodiment is adopted.

Figure 58:
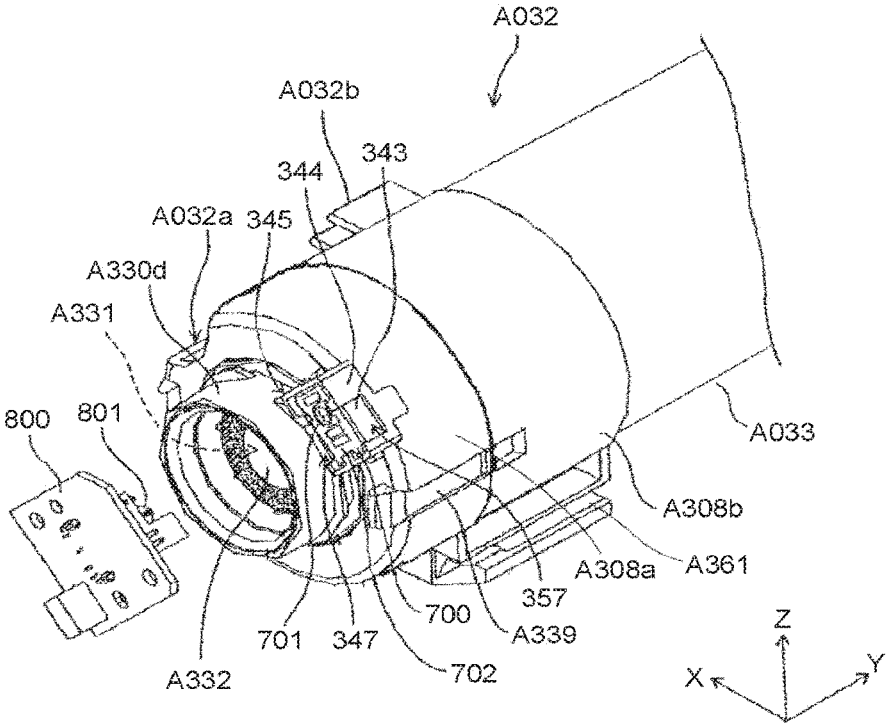
FIG. 58 is an explanatory perspective view of the connector that is fixed to the toner replenishing device according to the tenth embodiment to thirteenth embodiment, and an explanatory perspective view of the end portion at the container front end side of the toner container according to the tenth embodiment.

FIG. 58 is an explanatory perspective view of the connector 800 that is fixed to the toner replenishing device 60, and an explanatory perspective view of the end portion at the container front end side of the toner container A032. As illustrated in FIG. 58, the toner container A032 includes the container body A033; and includes the container front end cover A034 that is attached to the container body A033 in such a way that the front end opening A305, which is held in the container body A033 and which has the nozzle receiving opening A331 formed thereon, is exposed. Moreover, the toner container A032 includes the IC tag 700, which is attached as an information memory device to the front end of the container front end cover A034; and includes the IC tag holding structure 345 that holds the IC tag 700. The connector 800 is disposed at a position opposite to the first container cover A308*a* of the container front end cover A034.

Given below is the explanation regarding a protecting unit for protecting the toner container A032 when not in use.

Figure 56:
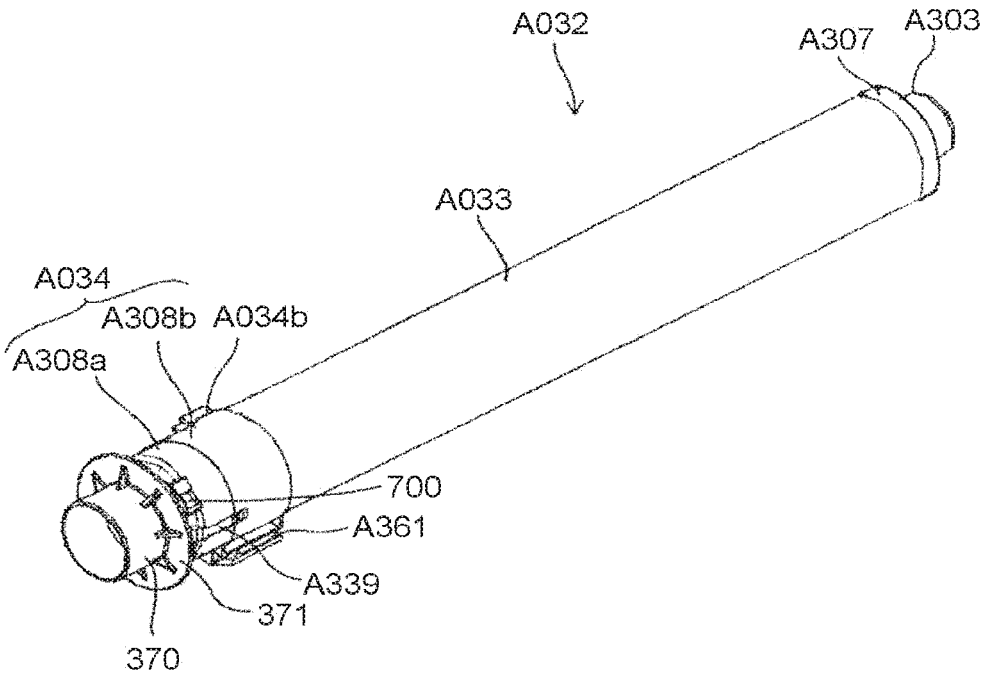
FIG. 56 is an explanatory perspective view of the toner container according to the tenth embodiment in the condition being stored.

FIG. 56 is an explanatory perspective view of the toner container A032 at the time of storage. In FIG. 56 is illustrated a condition in which the cap 370 is attached that serves as a seal for sealing the opening of the front end opening A305 of the toner container A032 illustrated in FIG. 43.

As described above, the front end opening A305 is a part of the nozzle receiver A330. As illustrated in FIGS. 42, 43, and 44; in the nozzle receiver A330, the front end opening A305 is formed to penetrate the container front end cover A034 that is required in fixing the toner container A032 to the toner replenishing device 60. As a result, it becomes possible to expose the front end opening A305 of the container body A033 from the container front end cover A034. Consequently, the front end opening A305, which is a part of the container body A033 in which the toner is stored, can be sealed directly by the cap 370. That enables achieving an enhanced sealing result and preventing toner leakage in a more reliable manner. In this way, in the tenth embodiment too, the cap 370 is attached in an identical manner to the first embodiment. Hence, it becomes possible to achieve the same effect as the effect achieved in the first embodiment.

Figure 57:
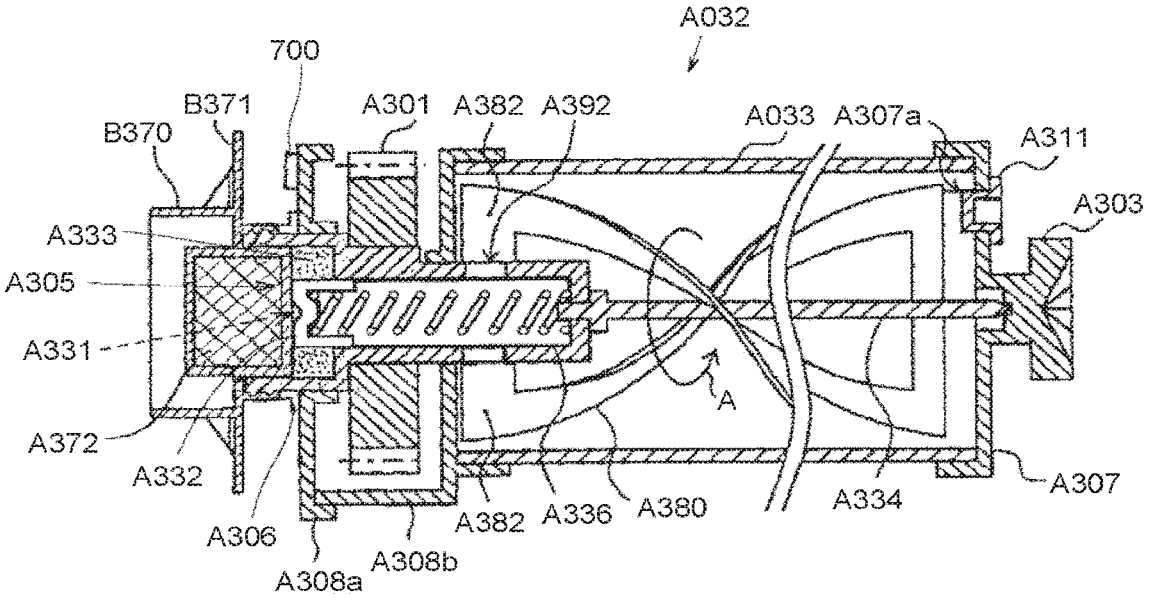
FIG. 57 is an explanatory cross-sectional view of the toner container according to the tenth embodiment in which an adsorption agent is disposed on the cap illustrated in FIG. 56.

FIG. 57 is an explanatory cross-sectional view of a condition in which a cap B370 has adsorption agent B372 disposed thereon in an identical manner to the second embodiment, and in which the cap B370 is attached to the toner container A032 according to the tenth embodiment. In the configuration illustrated in FIG. 57 too, because of the adsorption agent B372 disposed on the cap B370, it becomes possible to achieve the same effect as the effect achieved in the second embodiment.

Eleventh Embodiment

In an eleventh embodiment, since the toner replenishing device 60 is identical to the toner replenishing device 60 according to the tenth embodiment, the constituent elements thereof are referred to by the same reference numerals.

Usually, during the toner filling operation, a toner container D032 that is a powder container is filled with the toner T that has been fluidized. Since the toner T is mixed with air during the toner filling operation; deaeration occurs after the elapse of a predetermined period of time, and thus the volume of toner powder decreases. For example, the volume of toner powder decreases to about 70% to 90% of the capacity of a container body D033.

When a new toner container D032 that contains the toner T is attached to the toner replenishing device 60 for use, a large amount of the toner T is present in the neighborhood of a toner receiving opening D392. Hence, even without fluidizing the toner T by rotating an agitating conveyor D380 and then conveying the toner T to the container front end side, the toner T can still be taken in the conveying nozzle 611 via the toner receiving opening D392 and the nozzle opening 610. Rather, if it is attempted to rotate the agitating conveyor D380 when the toner T is present in large amount, then the rotational load increases due to the presence of a large amount of the toner T in the container body D033.

On the other hand, when the amount of toner T inside the container body D033 decreases, it becomes necessary to rotate the agitating conveyor D380 for conveying the toner T toward the container front end side and to use lifting portions D382 for lifting the toner T up to the toner receiving opening D392 and running the toner T into the toner receiving opening D392.

For that reason, in the toner container D032 according to the eleventh embodiment, the configuration is such that an agitator assembly D390 and a shaft D334 are coupled via a torque limiter D900. With such a configuration, at the time of starting to use a new toner container D032, if the toner T is present in large amount in the neighborhood of the toner receiving opening D392, the agitating conveyor D380 is subjected to rotation restriction.

Figure 59:
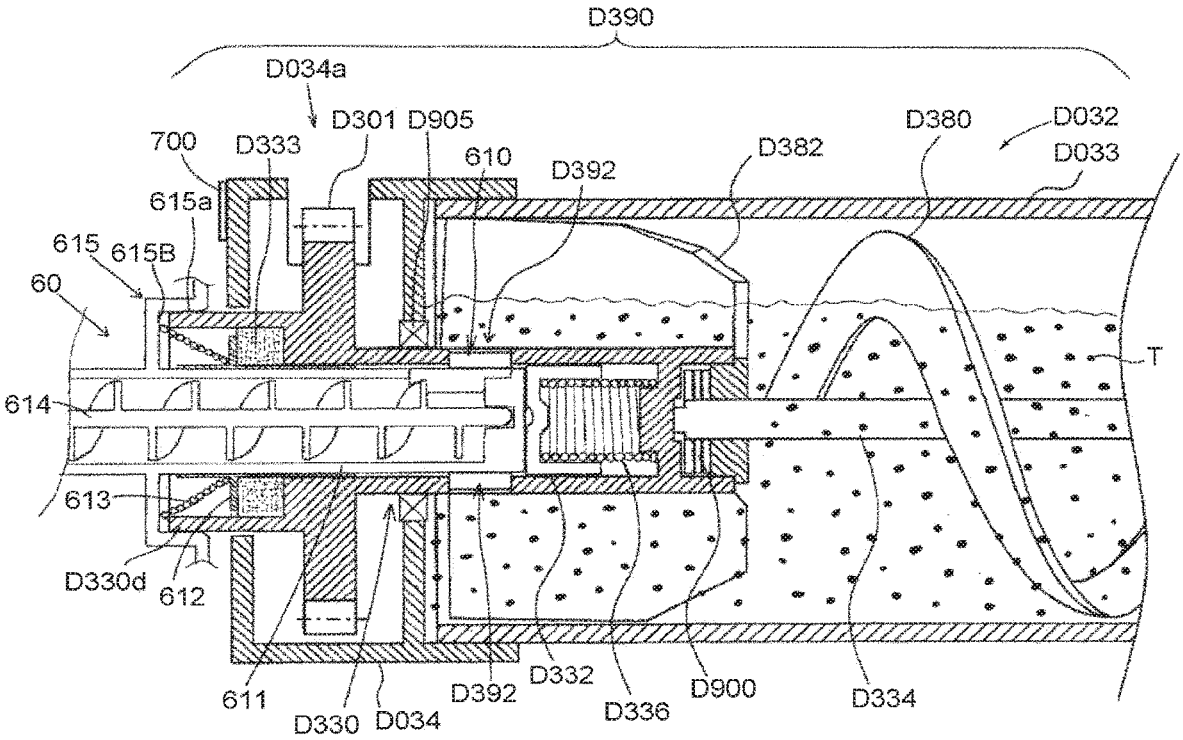
FIG. 59 is an explanatory diagram illustrating a condition in which a toner container according to an eleventh embodiment having the configuration for restricting the rotary driving of an agitating conveyor using a torque limiter is sufficiently filled with the toner.
Figure 60:
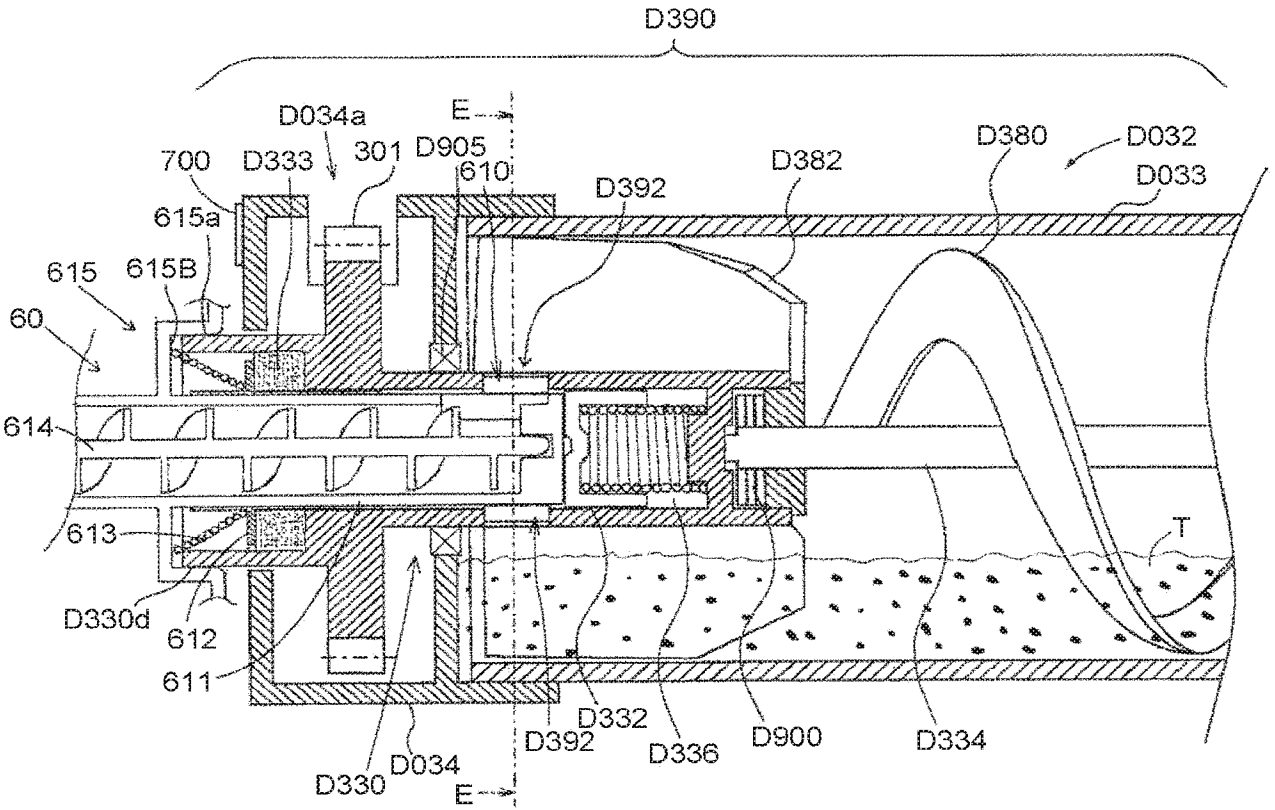
FIG. 60 is an explanatory diagram illustrating a condition in which the amount of toner inside the toner container illustrated in FIG. 59 has decreased.
Figure 61:
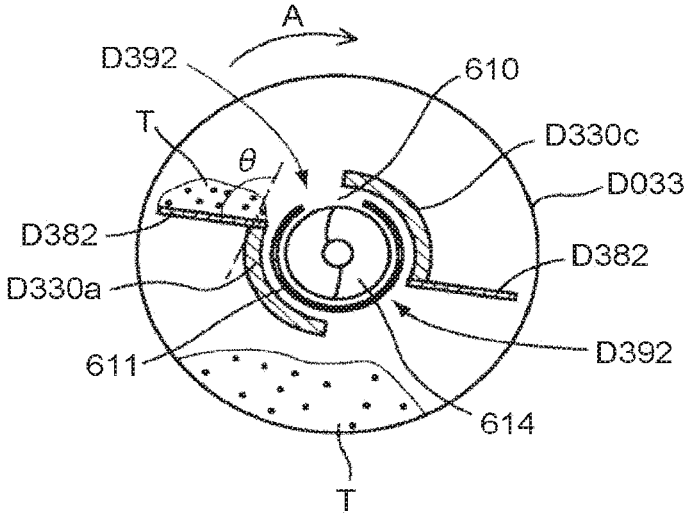
FIG. 61 illustrates E-E cross-sectional views of the toner container illustrated in FIG. 60.
Figure 61:
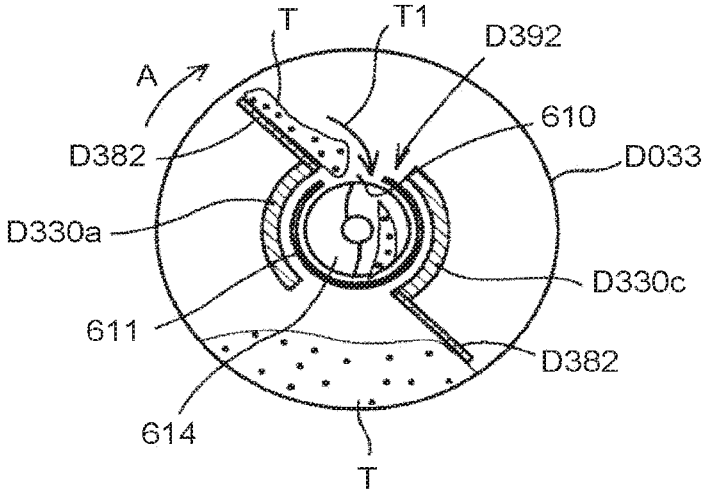
Figure 62:
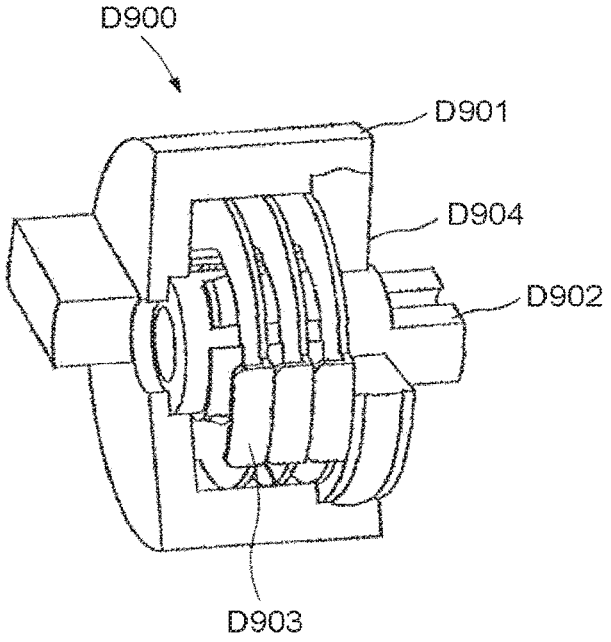
FIG. 62 is a cross-sectional perspective view of the torque limiter.

FIG. 59 is an explanatory diagram illustrating a condition in which the toner container D032 that has the configuration for restricting the rotary driving of the agitating conveyor D380 is sufficiently filled with the toner T and is attached to the toner replenishing device 60. FIG. 60 is an explanatory diagram illustrating a condition in which the amount of toner T inside the toner container D032 has decreased. FIG. 61 illustrates the toner supply performed by the lifting portions (conveying vanes) D382 when the amount of toner T decreases, where which E-E cross-section in FIG. 60 is viewed from the container front end side. FIG. 62 is a cross-sectional perspective view of the torque limiter D900.

As illustrated in FIG. 59, as compared to the toner container A032 according to the tenth embodiment, the toner container D032 according to the eleventh embodiment differs in the way that the agitator assembly D390 and the shaft D334 are coupled via the torque limiter D900. Moreover, the toner container D032 according to the eleventh embodiment differs in the way that, in the agitator assembly D390, a nozzle receiver D330 and a container gear D301 are configured in an integrated manner; while the agitating conveyor D380 and the lifting portions (conveying vanes) D382 are configured separately. Furthermore, the toner container D032 according to the eleventh embodiment differs in the way that the first container cover A308*a* and the second container cover A308*b* constitute a container front end cover D034 in an integrated manner, and support the nozzle receiver D330 via a bearing D905. Meanwhile, in the eleventh embodiment too, the IC tag 700 is disposed on the container front end cover D034 in an identical manner to the tenth embodiment.

As described above, on the end portion at the container front end side of the nozzle receiver D330 of the agitator assembly D390, the torque limiter D900 is disposed in a coupled manner with the shaft D334. Moreover, the agitating conveyor D380 is disposed on the shaft D334 in such a way that it rotates in an integrated manner with the shaft D334.

As illustrated in FIG. 62, the torque limiter D900 includes a housing D901; an inner ring D902 to which the shaft D334 is connected; a flat spring D903 that controls the drive torque; and a shielding member D904. The torque setting is done in such a way that, when the container body D033 is sufficiently filled with the toner T, the torque limiter D900 restricts the drive transmission; and when the toner T gets consumed thereby resulting in a decrease in the amount of toner T, the torque limiter D900 performs the drive transmission.

More particularly, when the toner T is present in large amount in the container body D033 as illustrated in FIG. 59, a driving force acts on the container gear D301 of the agitator assembly D390, and the nozzle receiver D330 and the lifting portions D382 rotate in an integrated manner. However, the torque setting is such that the torque limiter D900 slips and the shaft D334 and the agitating conveyor D380 do not rotate. In contrast, when only a small amount of the toner T is present in the container body D033 as illustrated in FIG. 60, the torque setting of the torque limiter D900 is such a way that the nozzle receiver D330 and the shaft D334 of the agitator assembly D390 rotate in an integrated manner.

In such a configuration, as illustrated in FIG. 59, consider the case when the toner T is sufficiently filled up to the upper portion of the toner receiving opening D392. In that case, even if a toner supply command is received from the toner replenishing device 60 and the agitator assembly D390 rotates in response to the request, the shaft D334 and the agitating conveyor D380 do not rotate because of the slipping of the torque limiter D900. For that reason, although the toner T is not conveyed from the container rear end side to the container front end side, the toner T present in the neighborhood of the toner receiving opening D392 is unhardened and lifted by the lifting portions D382, which rotate in an integrated manner with the nozzle receiver of the agitator assembly D390. Then, the lifted toner T falls in the nozzle opening 610 of the conveying nozzle 611 via the toner receiving opening D392.

In contrast, consider the case when only a small amount of the toner T is present inside the container body D033 as illustrated in FIG. 60. In that case, if a toner supply command is received from the toner replenishing device 60 and the agitator assembly D390 rotates in response to the request, the torque limiter D900 does not slip and drive-connects the shaft D334 and the agitating conveyor D380 to be rotatable in an integrated manner. For that reason, the toner T is conveyed from the container rear end side to the container front end side, and the toner T that has been conveyed to the container front end side gets lifted by the lifting portions D382 up to the toner receiving opening D392. Then, the lifted toner T falls in the nozzle opening 610 of the conveying nozzle 611 via the toner receiving opening D392. Thus, as illustrated in FIGS. 61A and 61B, since the toner T present inside the container body D033 is lifted by the lifting portions (conveying vanes) D382 and is supplied into the conveying nozzle 611 via the toner receiving opening D392, it becomes possible to use up all of the toner T present inside the container body D033. Meanwhile, in an identical manner to the configuration according to the tenth embodiment described with reference to FIG. 50, the agitating conveyor A380 is attached to the nozzle receiver A330 in such a way that the lifting portions D382 make the angle θ with respect to the tangential direction (illustrated by a dashed line in FIG. 50) at the upstream side edge of the toner receiving opening D392 in the direction of rotation of the nozzle receiver D330. With reference to FIGS. 61A and 61B too, the angle θ is an obtuse angle. Thus, when the toner receiving opening D392 is positioned on the upper side, the configuration is open with respect to the toner receiving opening D392 in such a way that the lifting portions A382 become inclined surfaces. In this configuration, since the lifting portions are disposed for lifting the toner against the direction of gravitational force up to a position higher than the toner receiving opening, it becomes possible to guide the lifted toner to the toner receiving opening of the conveying nozzle while preventing the lifted toner from falling out of the conveying nozzle. Hence, in this configuration, the lifting portions D382 function as accumulating portions.

Meanwhile, in the toner T, toner base particles are dusted with additive agents of submicron size that are used as auxiliary agents for facilitating fluidity and charging. However, due to movements such as the rotation of the agitating conveyor D380; there are times when the additive agents get immersed in the toner T or become detached from the toner T, and fail to fulfill their original functionality at the time when the toner T is supplied to the developing device 50. In that regard, in the configuration according to the eleventh embodiment, because of the torque limiter D900, the toner T stored in the container body D033 can be supplied to the developing device 50 without excessively exerting force on the toner T inside the container body D033.

Meanwhile, the bearing D905 supports the nozzle receiver D330 in a rotatable manner, as well as has the function of preventing toner leakage from the inside of the container body D033.

Figure 63A:
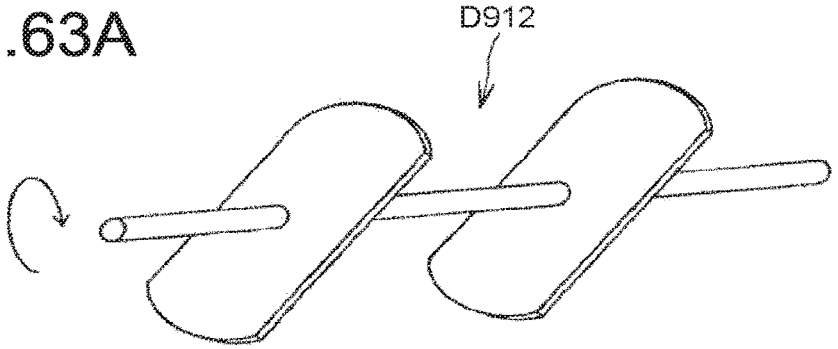
FIG. 63A is an explanatory diagram of a vane shape conveyor that can be used in the toner container illustrated in FIG. 59.
Figure 63B:
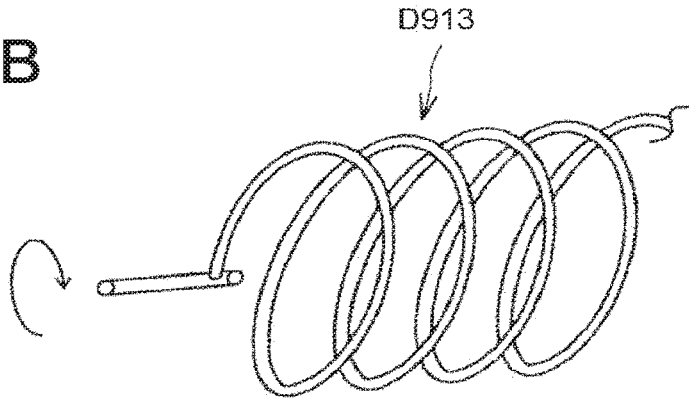
FIG. 63B is an explanatory diagram of a coil shape conveyor that can be used in the toner container illustrated in FIG. 59.
Figure 64:
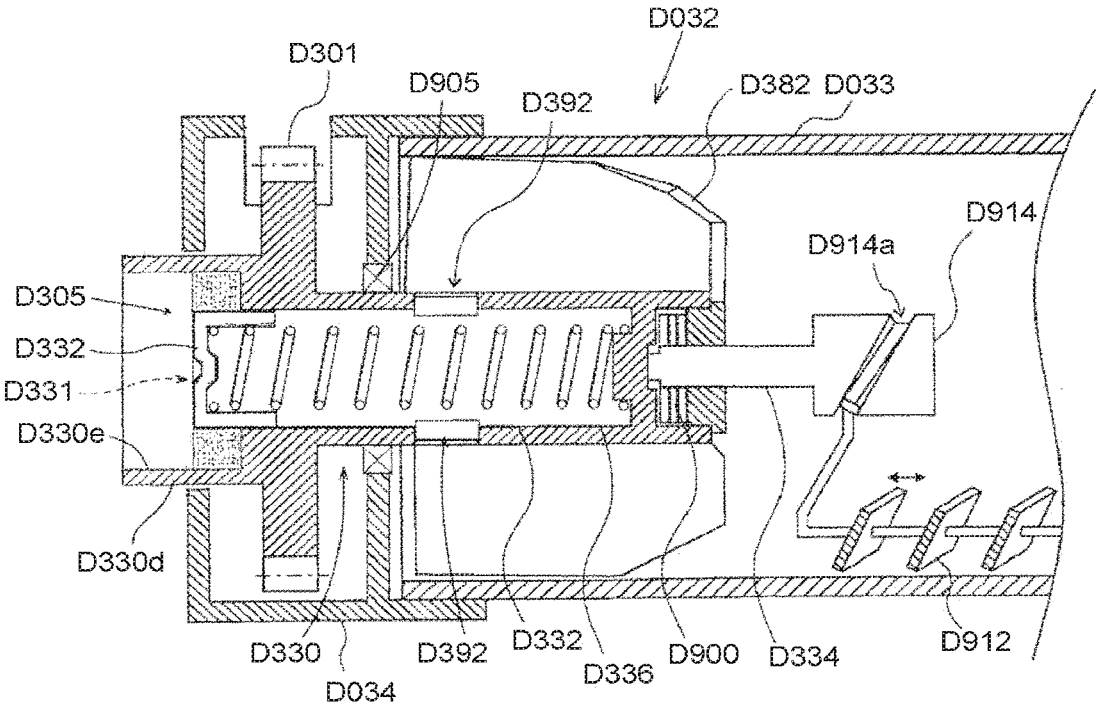
FIG. 64 is an explanatory diagram illustrating a configuration in which a conveyor holder having a cam groove formed thereon is disposed on the torque limiter which is usable in the toner container illustrated in FIG. 59, and in which the vane shape conveyor is made to perform reciprocal motion in the longitudinal direction of the container body.

Herein, in FIG. 59, the agitating conveyor D380 is illustrated to have a screw-like shape. However, that is not the only possible case. That is, as long as it is possible to move the toner T up to the lifting portions D382 disposed at the container front end side, the agitating conveyor D380 can have any other shape. For example, it is possible to use a vane shape conveyor D912 illustrated in FIG. 63A or to use a coil shape conveyor D913 that is spring-shaped without having a rotational axis as illustrated in FIG. 63B. In the case of using the vane shape conveyor D913, as illustrated in FIG. 64, a conveyor holder D914 having a cam groove D914*a* formed thereon is disposed on the torque limiter D900 so as to convert the rotational motion into reciprocal motion. Then, the vane shape conveyor D913 can be made to perform reciprocal motion in the longitudinal direction (the shaft direction) of the container body D033 so that the toner T is moved to the container front end side.

Twelfth Embodiment

Figure 65:
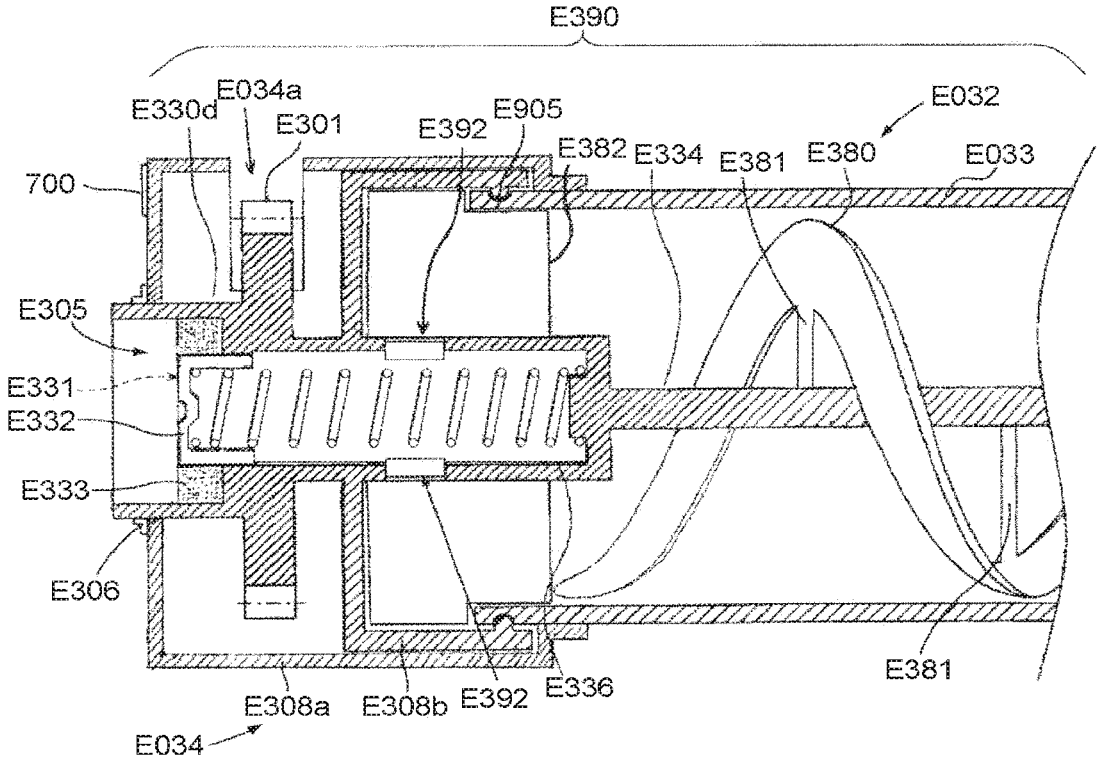
FIG. 65 is a cross-sectional view of a toner container according to a twelfth embodiment in which an agitator assembly is configured with the container front end cover in an integrated manner.

According to a twelfth embodiment, FIG. 65 is a cross-sectional view of a toner container E032 in which an agitator assembly E390 is configured by integrating the agitator assembly A390 according to the tenth embodiment with the second container cover A308*b* according to the tenth embodiment.

Herein, unlike the tenth embodiment, a first container cover E308*a* (a container front end cover E034) supports in a rotatable manner a second outer surface E330*d* of a nozzle receiver E330 of the agitator assemble E390, and has the container rear end side thereof fixedly attached to the periphery of a container body E033.

In the toner container E032 according to the twelfth embodiment, the agitator assembly E390 mainly includes the nozzle receiver E330 that is cylindrical in shape; a container cover portion E308*b*; a gear portion E301; and a shaft portion E334. In the agitator assembly E390, a container shutter spring E336 and a container shutter E332 are disposed at the reverse side of a receiving opening E331. In the example illustrated in FIG. 65, a condition is illustrated in which the container shutter E332 is positioned to seal the nozzle receiving opening E331 due to the biasing force of the container shutter spring E336. Moreover, lifting portions E382 are disposed on an outer surface E330*c* of the nozzle receiver E330 on which a toner receiving opening E392 is formed, and an agitating conveyor E380 is attached to the shaft portion E334.

In the toner container E032, the gear portion E301 receives a rotary drive force from the toner replenishing device 60, and the agitator assembly E390 gets rotary-driven. As a result, the agitating conveyor E380 rotates via the shaft portion E334 and moves the toner T present inside the container body E033 from the container rear end side to the container front end side. Then, the lifting portions E382 rotate via the nozzle receiver E330, and lift the toner T that has moved to the container front end side and run the toner T into the toner receiving opening E392. Then, at the timing at which the toner receiving opening E392 and the nozzle opening 610 become communicated, the toner T gets supplied into the conveying nozzle 611. Meanwhile, in the example illustrated in FIG. 65, although the container body E033 is configured not to rotate, it is also possible to have a configuration in which the container body E033 rotates along with the agitator assembly E390. In the case when the container body E033 does not rotate along with the agitator assembly E390, the container body E033 can have a not-easily-rotatable cross-sectional shape such as a reverse semi-cylindrical shape along the shaft direction.

As far as the mounting angles of the lifting portions E382 with respect to the agitator assembly E390 is concerned; in an identical manner to the configuration described with reference to FIG. 50 according to the tenth embodiment, the lifting portions E382 make an obtuse angle θ with respect to the tangential direction at the upstream side edge of the toner receiving opening E392 in the direction of rotation of the agitator assembly E390. In this configuration, since the lifting portions E382 are disposed for lifting the toner against the direction of gravitational force up to a position higher than the toner receiving opening E392, it becomes possible to guide the lifted toner to the toner receiving opening E392 of the conveying nozzle while preventing the lifted toner from falling out of the conveying nozzle. Hence, in this configuration, the lifting portions E382 function as accumulating portions in an identical manner to the tenth embodiment.

Thirteenth Embodiment

Figure 66:
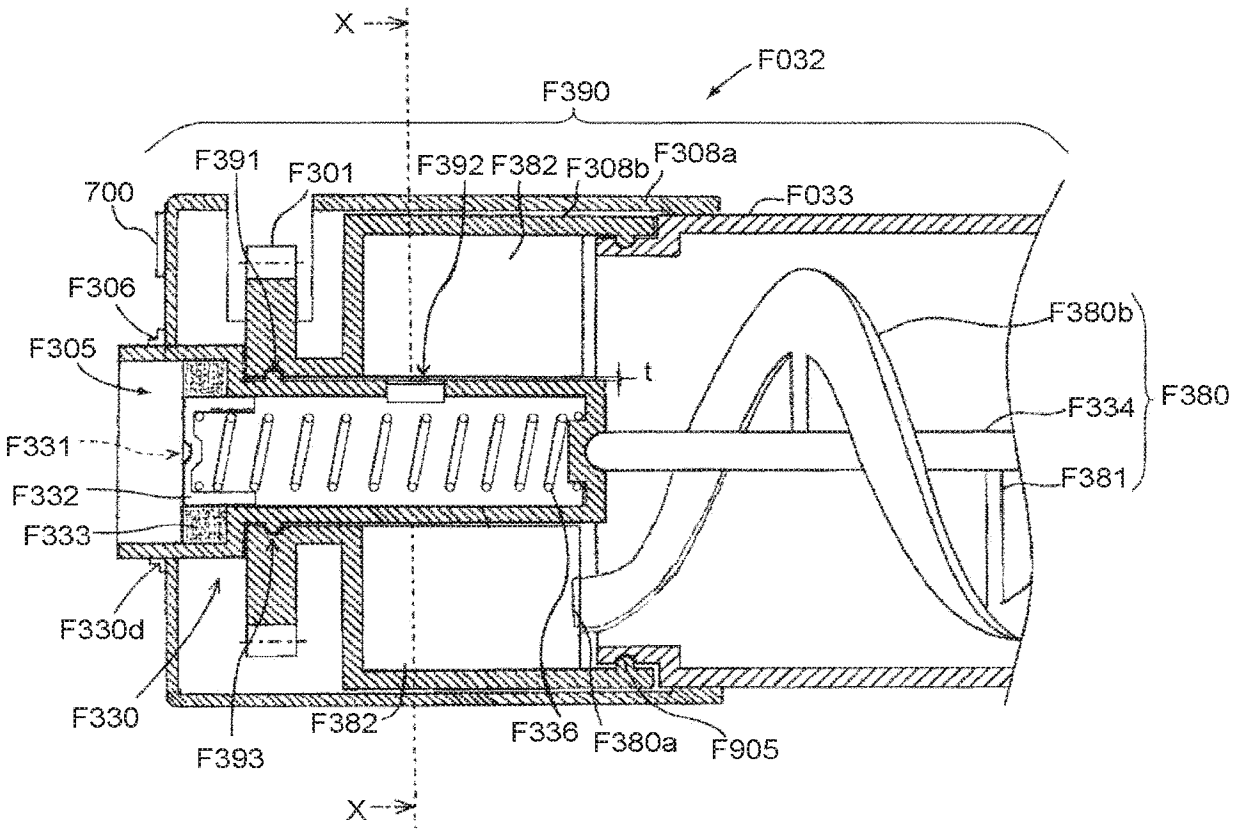
FIG. 66 is a cross-sectional view of a toner container according to a thirteenth embodiment in which a container front end cover is configured in an integrated manner with a container gear.

According to a thirteenth embodiment, FIG. 66 is a cross-sectional view of a toner container F032 in which the second container cover A308*b* of the container front end cover A034 according to the tenth embodiment is configured in an integrated manner with the container gear A301 according to the tenth embodiment.

In the toner container F032 according to the thirteenth embodiment, an agitator assembly F390 includes an agitating conveyor F380, a prop F381, a shaft F334, lifting portions F382, a second container cover F308*b*, and a container gear F301.

The second container cover F308*b* is covered from outside in the radial direction by a first container cover F308*a* that has the container rear end side thereof fixed to a container body F033. The first container cover F308*a* and the second container cover F308*b* constitute a container front end cover F034. On the inner surface of the second container cover F308*b* are attached the lifting portions F382 that extend toward the rotational axis. Meanwhile, rotating sliding portions F905 serve as the connecting portions between the container body F033 and the second container cover F308*b*, and have a sealed configuration. Herein, as the rotating sliding portions F905, it is possible to use bearings having sealability.

With reference to FIG. 66, a nozzle receiver F330 is configured not to rotate with respect to the container body F033, and is fixed to the first container cover 308*a* of the container front end cover F034 by a holding ring F306. For that reason, in the condition in which the toner container F032 is set into the container setting section 615 of the toner replenishing device 60, although an outer surface F330*d* of the nozzle receiver F330 fits into the inner surface 615*a* of the container setting section 615, there is no sliding.

Meanwhile, in an identical manner to the nozzle receiver A330 according to the tenth embodiment, the nozzle receiver F330 includes a receiving opening F331 on the container front end side; includes a container seal F333; includes a container shutter F332; and includes a container shutter spring F336.

Moreover, in an identical manner to the tenth embodiment, the first container cover F308*a* of the container front end cover F034 holds the IC tag 700, as well as includes container engaged portions F339 and sliding guides F361.

In the configuration illustrated in FIG. 66, a condition is illustrated in which the container shutter F332 is positioned to seal the nozzle receiving opening F331 due to the biasing force of the container shutter spring F336.

On a first outer surface F330*c* of the nozzle receiver F330 is formed a key convex F391 that fits in a concave F393 formed on the inner perimeter of the container gear F301, which is integrated with the second container cover F308*b* that performs relative rotation with respect to the nozzle receiver F330. With that, the key convex F391 and the concave F393 serve as a seal and a hook. Herein, in an identical manner to the rotating sliding portions F905, bearings having sealability can be substituted for a sealing configuration including the key convex F391 and the concave F393.

The lifting portions F382, which extend from the inner surface of the second container cover F308*b*, and which couple with a front end portion F380*a* of the agitating conveyor F380. The agitating conveyor F380 includes a screw F380*b*, a prop F381, and a shaft portion F334. Moreover, the agitating conveyor F380 rotates via the lifting portions F382 and along with the second container cover 308*b*. Due to the rotation of the agitating conveyor F380, the toner T is moved from the container rear end side to the container front end side. Then, the toner T that has been moved to the container front end side is lifted by the lifting portions F382 and is dropped into the toner receiving opening F392. Consequently, the toner T is supplied into the nozzle opening 610 of the conveying nozzle 611. In the configuration illustrated in FIG. 66 according to the thirteenth embodiment, since the nozzle receiver F330 does not rotate with respect to the nozzle opening 610, the toner receiving opening F392 of the nozzle receiver F330 can be kept aligned with the nozzle opening 610 on a constant basis.

Meanwhile, in order to prevent toner leakage, a gap t between the end portions of the lifting portions F382 on the side of the nozzle receiver F330 and the first outer surface F330*c* of the nozzle receiver F330 is desirably equal to or smaller than 2 mm, or more desirably equal to or smaller than 1 mm. In the thirteenth embodiment, the gap t is set to be 0.75 mm. With that, it becomes possible not only to prevent toner leakage but also to enable smooth rotation of the lifting portions F382 without any interference.

Figure 67A:
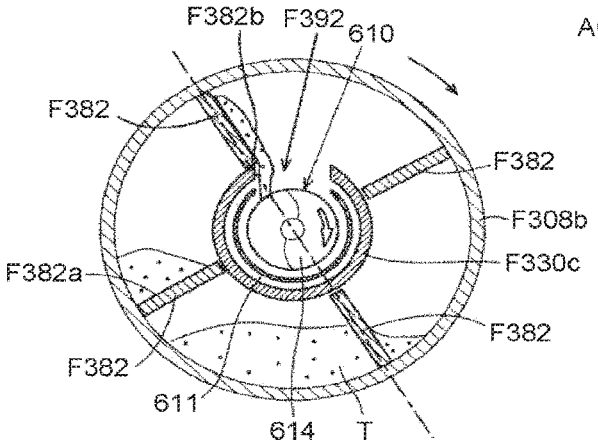
FIG. 67A is an X-X cross-sectional view of the toner container illustrated in FIG. 66.
Figure 67B:
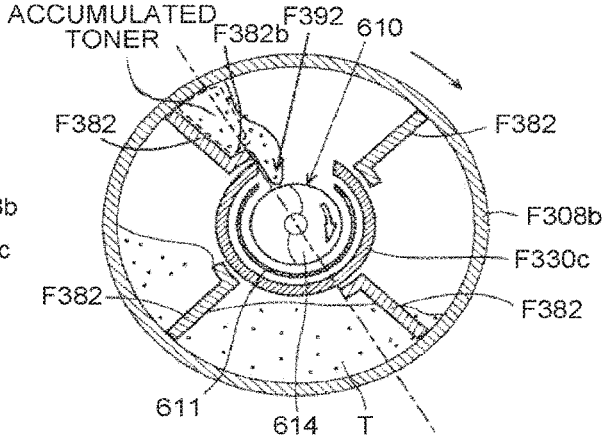
FIG. 67B is a cross-sectional view of the container front end cover according to the thirteenth embodiment in which lifting portions have an inclined surface at the front end thereof.
Figure 67C:
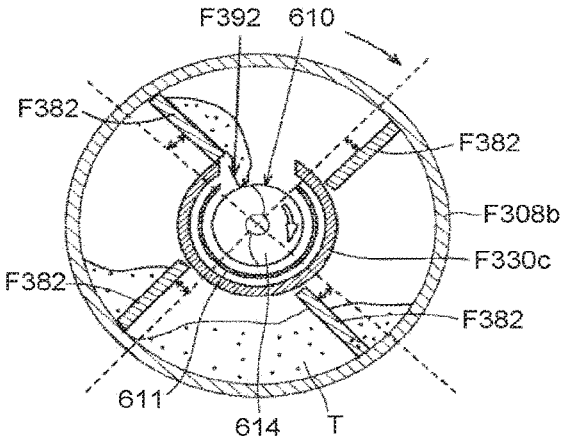
FIG. 67C illustrates the container front end cover according to the thirteenth embodiment in which the lifting portions are disposed in an offset manner.
Figure 67C:
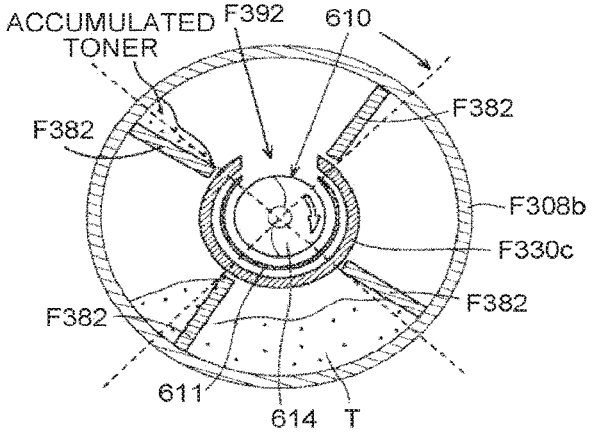

FIG. 67A is an explanatory diagram in which X-X cross-section of FIG. 66 is viewed from the container front end side. FIGS. 67B and 67C are modification examples of FIG. 67A. Illustrated in (b) of FIG. 67C is a condition that is prior to (a) of FIG. 67C in chronological order. In FIGS. 67A to 67C, the first container cover F308*a* that is present on the outer perimeter of the second container cover F308*b* is not illustrated. Moreover, the nozzle opening 610 and the toner receiving opening F392 open at positions that are not only higher than the center of rotation of the conveying screw 614 in the direction of gravitational force but also higher than the upper end of the conveying screw 614. Moreover, both those openings are narrower than the diameter of the conveying screw 614. In the configurations illustrated in FIGS. 67A to 67C, the lifting portions F382 lift the toner T up to a position that is higher than the nozzle opening 610 and the toner receiving opening F392, and then runs the toner T downward.

With reference to FIG. 67A, when the drive is transmitted from the container driving gear 601 of the toner replenishing device 60 to the container gear F301 configured in an integrated manner with the second container cover 308*b*, then the second container cover 308*b* rotates in the clockwise direction with reference to FIG. 67A. Along with the rotation of the second container cover 308*b*, the lifting portions F382 that extend from the inner surface of the second container cover 308*b* also rotate in the clockwise direction with reference to FIG. 67A.

When positioned in the lower side with reference to FIG. 67A, each lifting portion F382 holds the toner T, which has been conveyed to the container front end side by the agitating conveyor F380, within the space between the lifting portion F382 and the inner surface of the second container cover 308*b* that is more on the rotational direction downstream side than a root portion F382*a* of the lifting portion F382; and lifts the toner T. Due to further rotation in the clockwise direction with reference to FIG. 67A, each lifting toner F382 drops the toner T into the toner receiving opening F392. As a result, the toner gets supplied to the toner replenishing device 60 from the nozzle opening 610 of the conveying nozzle 611 that is communicated with the toner receiving opening 392.

In the example illustrated in FIG. 67B, an end portion F382*b* of each lifting portion F382 illustrated in FIG. 67A is bent in the rotational direction downstream side and a curvature is formed along the first outer surface F330*c* of the nozzle receiver F330. In other words, the lifting portion F382 serves as the accumulating portion and includes a concave portion, which includes an extending portion that is configured to extend from an inner surface of the container cover F034 toward an outer surface of the nozzle receiver F330 and a bent portion that is formed to be bent along the outer surface of the nozzle receiver F330 in a rotational direction downstream side. And the bent portion is shorter than the extending portion. As a result of the bent shape, the lifting portions F382 become capable of holding a larger amount of the toner T as compared to the example illustrated in FIG. 67A. Moreover, the bent shape also is an inclined surface that acts as a bridge at the time of running the toner T into the toner receiving opening F992. Regarding the lifting portions F382 illustrated in FIG. 67A, when the second container cover F308*b* rotates more toward the rotational direction downstream side than the position at which each lifting portion F382 extends in the horizontal direction, the toner T present on the lifting portion F382 starts falling from the gap between the first outer surface F330*c* of the nozzle receiver F300 and the end portion F382*b* of that lifting portion F382. For that reason, at the timing at which the end portion F382*b* of that lifting portion F382 is opposite to the edge of the toner receiving opening F392, the toner T present on the lifting portion F382 is somewhat smaller in amount.

In contrast, in the example illustrated in FIG. 67B, even if the second container cover F308*b* rotates more toward the rotational direction downstream side than the position at which each lifting portion F382 extends in the horizontal direction, the lifting portion F382 can hold the toner T because of the bent shape. Hence, as illustrated in FIG. 67B, at the timing at which the bent end portion F382*b* of the lifting portion F382 is opposite to the edge of the toner receiving opening F392, a larger amount of the toner T can be held on the lifting portion F382 as compared to the example illustrated in FIG. 67A. At that time, in an identical manner to the configuration illustrated in FIG. 50 according to the tenth embodiment, the lifting portion F382 functions as an accumulating portion for lifting the toner T to a position higher than the toner receiving opening 392. Meanwhile, in the example illustrated in FIG. 67B, the width of each end portion F382*b* (i.e., the length along the rotational direction of the second container cover F308*b*) is set to be about 5 mm.

As illustrated in (a) of FIG. 67C, instead of extending the lifting portions F382 toward the center of rotation of the second container cover F308*b*, each lifting portion F382 can be configured to extend from a position that is offset by a small amount in the rotational direction downstream side. And the offset means such a condition that, when the lifting portion F382 is substantially horizontal, the lifting portion F382 extends along a slightly upward position than the center of rotation of the second container cover F308*b*. In short, the lifting portion F382 serve as an accumulating portion is extended with an offset in a downstream side of a rotational direction of the second container cover F308*b*. With such a configuration, as illustrated in (b) of FIG. 67C, the base of the lifting portions F382 can be positioned more on the rotational direction upstream side of the second container cover F308 than the end portions of the lifting portions F382 on the side opposite to the nozzle receiver F330. Hence, as compared to the configuration illustrated in FIG. 67A, a cross-sectional shape is obtained in which the base is sunken in the upstream side. At that time, in an identical manner to the configuration illustrated in FIG. 50 according to the tenth embodiment, lifting portion F382 functions as an accumulating portion for lifting the toner T to a position higher than the toner receiving opening 392.

In the configurations illustrated in FIGS. 67A to 67C, in an identical manner to the tenth embodiment, the conveying nozzle 611 is inserted substantially in the center of rotation of the second container cover F308*b*. Hence, the nozzle opening 610 and the toner receiving opening F392 open above the center of rotation of the second container cover F308*b* (i.e., the center of rotation of the conveying screw 614). According to the configurations illustrated in FIGS. 67B and 67C, the toner T present on each lifting portion F382 can be lifted above the center of rotation of the second container cover F308*b* (i.e., the center of rotation of the conveying screw 614) and can be run toward the toner receiving opening F392. In this way, according to the configurations illustrated in FIGS. 67B and 67C, since the lifting portions F382 are disposed for lifting the toner against the direction of gravitational force up to a position higher than the toner receiving opening F392, it becomes possible to guide the lifted toner to the nozzle opening 610 of the conveying nozzle 611 while preventing the lifted toner from falling out of the conveying nozzle 611. Hence, in these configurations, the lifting portions F382 function as accumulating portions in an identical manner to the tenth embodiment.

Explanation of a toner container fitting mechanism implemented in common in the first embodiment to the thirteenth embodiment Hereinafter, in order to explain a toner container fitting mechanism, the configuration of the first embodiment is used as a representative embodiment for the other embodiments.

Figure 38:
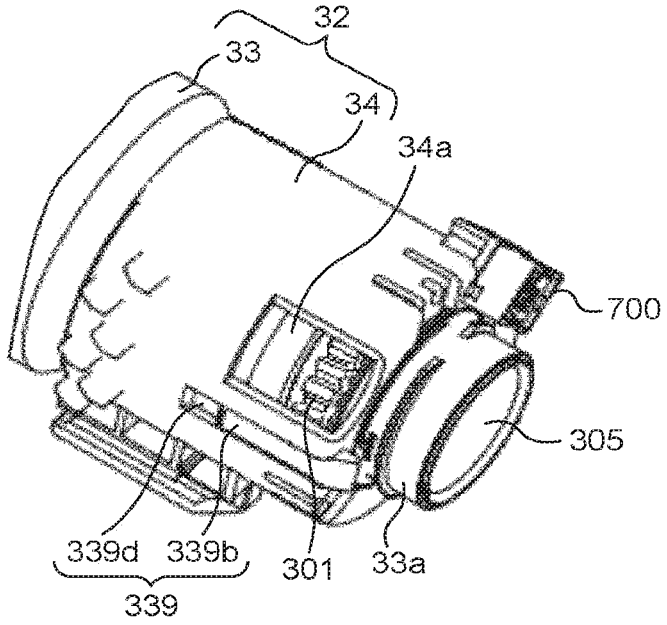
FIG. 38 is an explanatory perspective view of a container front end cover according to all embodiments.
Figure 40:
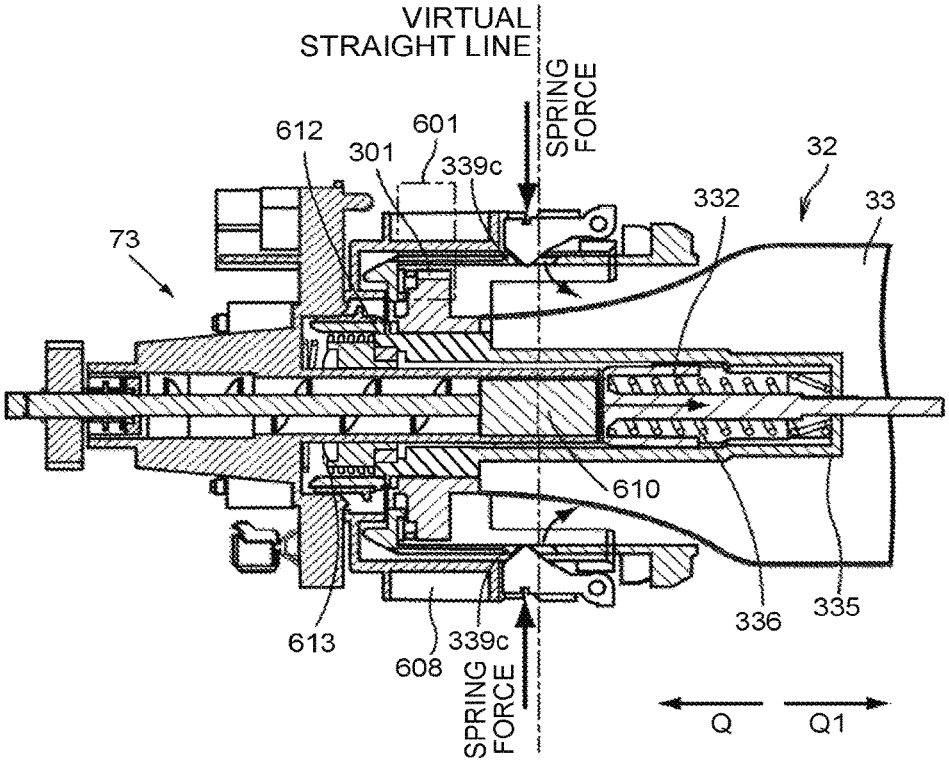
FIG. 40 is an explanatory cross-sectional view of the condition in which the toner container according to the first embodiment is attached to the toner replenishing device.

FIG. 38 is an explanatory perspective view of the container front end cover 34, which is implemented in common in all of the first to thirteenth embodiments, when viewed from the side of the gear exposing hole 34*a*. FIG. 39 is a cross-sectional view cut at the horizontal plane including the rotational axis of the container body 33 according to the first embodiment, and is an explanatory cross-sectional view of the toner replenishing device 60 and the toner container 32 before the toner container 32 is attached to the toner replenishing device 60. FIG. 40 is an explanatory cross-sectional view of the condition in which the toner container illustrated in FIG. 39 is attached to the toner replenishing device.

As illustrated in FIG. 38, on the outer surface of the container front end cover 34, the container opening 33*a* is formed above the container engaged portions 339, which cross over the container gear 301 from the container front end side and extend in the container longitudinal direction (i.e., the horizontal direction in the condition in which the toner container is attached to the toner replenishing device). Each container engaged portion 339 serves as a container portion to be engaged, and the quadrangular engaged hole 339*d* serves as a part to be engaged.

Explained below with reference to FIGS. 39 and 40 are various conditions until the toner container 32 is attached to the toner replenishing device 60. In the condition illustrated in FIG. 39, the toner replenishing device 60 includes the conveying nozzle 611 in the center thereof, and includes the pair of replenishing device engaging members 609 on both sides of the conveying nozzle 611. The replenishing device engaging members 609 are held on the setting cover 608 in a rotatable manner and are biased toward the conveying nozzle 611 by springs. When the toner container 32 is moved in the direction of the arrow Q from the condition illustrated in FIG. 39, each replenishing device engaging member 609 firstly runs upon the tapered surface of the corresponding guiding protrusion 339*a* that is configured on the container front end side of each container engaged portion 339 in the toner container 32. When the toner container 32 is moved further, each replenishing device engaging member 609 slides over the corresponding guiding gutter 339*b* and crosses over the container gear 301 without interfering with the container gear 301. Then, each replenishing device engaging member 609 runs upon the corresponding bump 339*c* and engages in the corresponding engaged hole 339*d* due to the biasing force of springs as illustrated in FIG. 40. The part to be engaged may be engaged with the container portion to be engaged, and may correspond to a step such as the periphery of the quadrangular engaged hole 339*d*. In a simultaneous manner to the engaging operation of the replenishing device engaging members 609, the container shutter 332 is pushed by the conveying nozzle 611 and recedes to the inside of the container body 33 against the reaction force that accompanies the compression of the container shutter spring 336. Moreover, the nozzle shutter flange 612*a* also abuts against the nozzle shutter positioning ribs 337*a* and compresses the nozzle shutter spring 613. The replenishing device engaging members 609 engage with the engaged holes 339*d* and receive the restoring force of the container shutter spring 336 and the nozzle shutter spring 613. With that, it becomes possible to hold the toner container 32 at a replenishable position.

Moreover, the toner replenishing device 60 includes the container driving gear 601. In the condition illustrated in FIG. 40 in which the toner container 32 has been attached to the toner replenishing device 60, the container driving gear 601 engages with the container gear 301.

When viewed in the longitudinal axis direction of the toner container 32, the container engaged portions 339, which make the replenishing device engaging members 609 run upon and slide and then engage with engaged holes, are disposed on the outside of the outer diameter of the container gear 301. In other words, each of the container engaged portions 339 is provided outer than the tooth of the container gear 301 in a radial direction of the container gear 301. Hence, the container engaged portions 339 do not interfere with the container gear 301. Moreover, when viewed in the longitudinal axis direction of the toner container 32 from the container opening 33*a* at the container front end side, the engaged hole 339*d* is formed at the container rear end side of the container front end cover 34. And the engaged hole 339*d* is provided beyond the container gear 301 in the longitudinal direction of the toner container 32. Hence, when the toner container 32 is fit into the replenishing device 60, the toner container 32 is held at the positions where the container setting section 615 and the replenishing device engaging members 609 are. And the positions are sandwiching the container gear 301 in the longitudinal direction. Thus, the drive of the container gear 301 can be sufficiently received, and conveying of the toner inside the container body 33 can be performed in a stable manner.

Furthermore, as illustrated in FIG. 40, in the condition in which the toner container 32 is attached to the toner replenishing device 60; the engaged holes 339*d*, in which engaging members engage, are positioned corresponding to the nozzle opening 610 of the conveying nozzle 611, which is inserted in the nozzle receiver 330 in the container longitudinal direction, (i.e., the engaged holes 339*d* are positioned across an area hatched with oblique lines in FIG. 40). In other words, the positional relationship is such that the centers of the pair of engaged holes 339*d* (in the case of holes 330*d* having an oblong shape according to the first embodiment, the intersection points of the respective diagonal lines) are joined by a virtual straight line that passes through the nozzle opening 610. In such a positional relationship, the portion in the neighborhood of the conveying nozzle 611 (i.e., the portion in which the nozzle opening 610 is formed) is deeply inserted in the nozzle receiver 330 up to a position that is beyond the container gear 301 and opposite to the engaged holes 339*d*. Consequently, it becomes possible to prevent a situation in which the rotating container body 33 is inclined due to the weight of the toner stored therein and due to its own weight, and to prevent a misalignment in the engagement of the container gear and the container driving gear 601. If there is a considerable misalignment in that engagement, then that causes an increase in the drive load thereby resulting in abnormal noise and gear friction. However, in the toner container according to an aspect of the present invention, it becomes possible to prevent such malfunctioning from occurring.

The embodiments described above include power containers as set forth in Aspects 1 to 18 below and an image forming apparatus as set forth in Aspect 19 below.

Aspect 1. A powder container (A032; D032; E032; F032) attachable to a powder replenishing device (60) in a horizontal longitudinal direction, the powder replenishing device (60) including a conveying nozzle (611) for conveying a powder, a nozzle opening (610) formed on the conveying nozzle (611) to receive the powder from the powder container (A032; D032; E032; F032), and a conveying screw (614) provided on the conveying nozzle (611) to convey the powder received from the nozzle opening (610), the nozzle opening (610) having a smaller width than a diameter of the conveying screw (614) in a direction orthogonal to a rotational axis of the conveying screw (614), the powder container (A032; D032; E032; F032) including a container body (A033; D033; F033) configured to contain a powder for image formation, the powder being supplied to the powder replenishing device (60);

a conveyor (A380; D380; E380; F380) configured to convey the powder from one end in the longitudinal direction to the other end at which a cylindrical container opening is formed, the conveyor (A380; D380; E380; F380) being provided inside the container body (A033; D033; F033);

a nozzle receiver (A330; D330; E330; F330) configured to guide the conveying nozzle (611) inside of the container body (A033; D033; F033), the nozzle receiver (A330; D330; E330; F330) being provided on the container opening;

a powder receiving opening (A392; D392; E392; F392) configured to communicate the nozzle opening (610) with an inside of the container body (A033; D033; F033); and a lifting portion (A382; D382; E382; F382) configured to lift the powder that has been conveyed to the other end by the powder conveyor (A380; D380; E380; F380) to run the powder into the powder receiving opening (A392; D392; E392; F392).

According to the powder container as set forth in Aspect 1, since the lifting portion is provided to lift the powder (toner) against the direction of gravitational force up to a position higher than the powder receiving opening, it becomes possible to guide the lifted toner to the powder receiving opening of the conveying nozzle while preventing the lifted toner from falling out of the conveying nozzle.

Aspect 2. The powder container according to Aspect 1, wherein the nozzle receiver further includes a nozzle receiving opening configured to receive the conveying nozzle, a container shutter (A332; E332; D332; F332) configured to open or shut the nozzle receiving opening, and a biasing member (A336; E336; D336; F336) configured to bias the container shutter toward the position of shutting the nozzle receiving opening.

According to the powder container as set forth in Aspect 2, it is possible to provide stability in the amount of supplied powder (toner) and to achieve prevention of toner scattering.

Aspect 3. The powder container according to Aspect 1 or Aspect 2, wherein the lifting portion has an accumulating portion in which the powder accumulates while being lifted.

According to the powder container as set forth in Aspect 3, the powder (toner) accumulates near the lifting portion. Hence, the toner T, which has been conveyed to the container front end side inside the container body, is lifted smoothly by the lifting portion of the powder conveyor and is then run into the powder receiving opening.

Aspect 4. The powder container according to any one of Aspect 1 to Aspect 3, wherein the nozzle receiver has an outer surface that serves as a positioning portion between the powder container and the powder replenishing device.

Aspect 5. The powder container according to Aspect 3, wherein the nozzle receiver further includes a powder receiving opening formed thereon and to rotate so that the powder receiving opening passes over the nozzle opening, and the lifting portion is configured to extend toward an inner surface of the container body from a periphery of the nozzle receiver, the periphery being disposed at more upstream side of the nozzle receiver than the powder receiving opening in a rotational direction of the nozzle receiver.

Aspect 6. The powder container according to Aspect 5, wherein the lifting portion is configured to have a base making an obtuse angle with respect to a tangential direction at an upstream side edge of the powder receiving opening in a direction of rotation of the nozzle receiver.

According to the powder container as set forth in Aspect 6, it becomes possible to enhance the function of lifting the powder (toner T) using the lifting portion that is fulfilled according to Aspect 3 and Aspect 5.

Aspect 7. The powder container according to Aspect 6, wherein the lifting portion is configured to extend from the periphery of the nozzle receiver that is adjacent to an edge of the powder receiving opening.

According to the powder container as set forth in Aspect 7, it becomes possible to enhance the function of running the powder (toner T) smoothly into the powder receiving opening.

Aspect 8. The powder container according to Aspect 6 or Aspect 7, wherein the accumulating portion has an inclined surface made by the lifting portion with respect to the powder receiving opening when the powder receiving opening of the nozzle receiver and the nozzle opening of the conveying nozzle are communicated in the direction of rotation.

According to the powder container as set forth in Aspect 8, it becomes possible to enhance the function of lifting the powder (toner T) using the lifting portion and running the lifted toner T smoothly into the powder receiving opening that is fulfilled according to Aspect 3 and Aspect 5.

Aspect 9. The powder container according to Aspect 6 or Aspect 7, wherein the accumulating portion has a concave portion which is formed to be bent at the portion between the base and the end of the lifting portion.

Aspect 10. The powder container according to Aspect 6 or Aspect 7, wherein the accumulating portion has a concave portion which is formed to be curved at the portion between the base and the end of the lifting portion.

Aspect 11. The powder container according to Aspect 9, wherein the concave portion which is formed to be bent in a same direction at a plurality of positions between the base and the end of the lifting portion.

According to the powder container as each set forth in Aspect 9, Aspect 10, and Aspect 11; it becomes possible to further enhance the function of lifting the powder (toner T) using the lifting portion that is fulfilled according to Aspect 6 and Aspect 7.

Aspect 12. The powder container according to any one of Aspect 1 to Aspect 11, wherein the nozzle receiver is connected to the conveying nozzle, and the conveyor is connected to one end of the nozzle receiver via a torque limiter.

Aspect 13. The powder container according to Aspect 12, wherein torque setting of the torque limiter is done in such a way that the torque limiter restricts a drive transmission when the container body is sufficiently filled with the powder, and the torque limiter performs the drive transmission when the powder gets consumed thereby resulting in a decrease in an amount of powder.

According to the powder container as each set forth in Aspect 12 and Aspect 13, in the condition in which the powder (toner T) is present in large amount in the container body, it becomes possible to reduce the rotational load of the powder conveyor.

Aspect 14. The powder container according to Aspect 3, further including a second container cover which is rotatable with respect to the container body, the second container cover being provided on the other end of the container body, wherein the lifting portion is configured to extend from an inner surface of the second container cover toward an inside of the second container cover.

Aspect 15. The powder container according to Aspect 14, wherein the accumulating portion has a concave portion in the lifting portion, the concave portion including an extending portion which is configured to extend from an inner surface of the second container cover toward an outer surface of the nozzle receiver, and a bent portion which is formed to be bent along the outer surface of the nozzle receiver in a rotational direction downstream side.

According to the powder container as set forth in Aspect 15, it becomes possible to enhance the function of lifting the powder (toner T) using the lifting portion that is fulfilled according to Aspect 3 and Aspect 14.

Aspect 16. The powder container according to Aspect 15, wherein the bent portion is shorter than the extending portion.

Aspect 17. The powder container according to Aspect 14, wherein the accumulating portion is the lifting portion that is extended with an offset in a downstream side of a rotational direction of the second container cover.

According to the powder container as each set forth in Aspect 16 and Aspect 17, it becomes possible to enhance the function of lifting the powder (toner T) using the lifting portion and running the lifted toner T smoothly into the toner receiving opening.

Aspect 18. The powder container according to any one of Aspect 13 to Aspect 17, wherein a gap between an end portion of the lifting portion and an outer surface of the nozzle receiver is 2 mm or smaller.

According to the powder container as set forth in FIG. 18, while lifting the powder (toner T), toner leakage can be prevented from occurring from the gap between the nozzle receiver and the end portion of the lifting portion on the side of the nozzle receiver.

Aspect 19. An image forming apparatus including an image forming unit configured to perform image formation with a powder for image formation; and a powder replenishing device configured to hold the powder container according to any one of Aspect 1 to Aspect 17, wherein the powder replenishing device conveys the powder from the powder container to the image forming unit when the powder container is attached to the powder replenishing device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

Aspect 20. A powder container attachable to a powder replenishing device in a longitudinal direction, the powder replenishing device including a conveying nozzle for conveying a powder, a nozzle opening formed on the conveying nozzle to receive the powder from the powder container, and a replenishing device engaging member for holding the powder container by laterally biasing the powder container, the powder container comprising:

a conveyor configured to convey the powder from one end in the longitudinal direction to the other end at which a container opening is formed;

a gear configured to rotate the conveyor with an external driving force;

a nozzle receiver provided on the container opening and configured to receive the conveying nozzle insertable; and a container engaged portion that is provided outer than a tooth of the gear in a radial direction and includes an engaged hole with which the replenishing device engaging member engages, wherein the engaged hole is arranged at a position to correspond with the nozzle opening of the conveying nozzle in the longitudinal direction when the powder container is attached to the powder replenishing device.

Aspect 21. The powder container according to Aspect 20, wherein the container engaged portion is configured to cross the gear in the longitudinal direction of the powder container.

Aspect 22. The powder container according to Aspect 20 or 21, wherein the engaged hole is arranged at a position beyond the gear when viewed from the container opening in the longitudinal direction of the powder container.

Aspect 23. The powder container according to any one of Aspects 20 to 22, wherein the container engaged portion includes a sliding portion configured to cause the powder replenishing device engaging member to slide.

Aspect 24. The powder container according to any one of Aspects 20 to 22, further comprising a container cover configured to cover the gear and include the container engaged portion.

Aspect 25. The powder container according to Aspect 24, wherein the container cover includes a gear exposing hole for partially exposing a gear tooth.

Aspect 26. The powder container according to any one of Aspects 20 to 25, wherein the engaged hole includes a through hole.

Aspect 27. The powder container according to any one of Aspects 20 to 26, wherein an outer surface of the container opening serves as a positioning portion between the powder container and the powder replenishing device.

Aspect 28. The powder container according to any one of Aspects 20 to 27, further comprising:

an information storage device; and a holding structure configured to hold the information storage device.

Aspect 29. The powder container according to Aspect 28, wherein the information storage device is held to be movable within the holding structure.

Aspect 30. The powder container according to any one of Aspects 20 to 29, wherein an outer surface of the nozzle receiver and an inner surface of the container opening have screws formed thereon for mutual screwing.

Aspect 31. The powder container according to any one of Aspects 20 to 30, wherein the nozzle receiver includes a lifting portion configured to lift the powder by rotation of the nozzle receiver to convey the powder to the nozzle opening of the conveying nozzle.

Aspect 32. The powder container according to Aspect 31, wherein the lifting portion has an accumulating portion in which the powder accumulates while being lifted.

Aspect 33. The powder container according to Aspect 31 or 32, wherein the nozzle receiver has an outer surface that serves as a positioning portion between the powder container and the powder replenishing device.

Aspect 34. The powder container according to any one of Aspects 31 to 33, wherein the nozzle receiver further includes a powder receiving opening formed thereon and to rotate so that the powder receiving opening passes over the nozzle opening, the lifting portion is disposed at a periphery of the nozzle receiver, and the periphery configured to be disposed at more upstream side of the nozzle receiver than the powder receiving opening in a rotational direction of the nozzle receiver.

Aspect 35. The powder container according to Aspect 34, wherein the lifting portion is configured to have a base making an obtuse angle with respect to a tangential direction at an upstream side edge of the powder receiving opening in the rotational direction of the nozzle receiver.

Aspect 36. The powder container according to Aspect 35, wherein the lifting portion is configured to extend from the periphery of the nozzle receiver that is adjacent to an edge of the powder receiving opening.

Aspect 37. The powder container according to Aspect 35 or 36, wherein the accumulating portion includes an inclined surface made by the lifting portion with respect to the powder receiving opening when the powder receiving opening of the nozzle receiver and the nozzle opening of the conveying nozzle are communicated in the direction of rotation.

Aspect 38. The powder container according to Aspect 35 or 36, wherein the accumulating portion includes a concave portion which is formed to be bent at the portion between the base and the end of the lifting portion.

Aspect 39. The powder container according to Aspect 35 or 36, wherein the accumulating portion includes a concave portion which is formed to be curved at the portion between the base and the end of the lifting portion.

Aspect 40. The powder container according to Aspect 38, wherein the concave portion which is formed to be bent in a same direction at a plurality of positions between the base and the end of the lifting portion.

Aspect 41. The powder container according to any one of Aspects 31 to 40, wherein the nozzle receiver is connected to the conveyor.

Aspect 42. The powder container according to Aspect 41, wherein the conveyor is connected to one end of the nozzle receiver via a torque limiter.

Aspect 43. The powder container according to Aspect 42, further comprising a container body configured to contain a powder for image formation, the powder being to be supplied to the powder replenishing device, wherein torque setting of the torque limiter is done in such a way that the torque limiter restricts a drive transmission when the container body is sufficiently filled with the powder, and the torque limiter performs the drive transmission when the powder gets consumed thereby resulting in a decrease in an amount of powder.

Aspect 44. The powder container according to any one of Aspects 20 to 40, further comprising a container body configured to contain a powder for image formation, the powder being to be supplied to the powder replenishing device, wherein the conveyor is a spiral rib formed on an inner side wall surface of the container body.

Aspect 45. The powder container according to Aspect 44, wherein the gear is disposed on the container body, the powder present inside the container body is conveyed, by rotation of the container body, from one end in a direction of a rotational axis of the container body to the other end at which the container opening is formed, and a part of the spiral rib that is formed on the inner side wall surface near the opening of the container body includes a pitch parallel to the rotational axis.

Aspect 46. The powder container according to Aspect 44, wherein the gear is disposed on the container body, the powder present inside the container body is conveyed, by rotation of the container body, from one end in a direction of a rotational axis of the container body to the other end at which the container opening is formed, and a part of the spiral rib that is formed on the inner side wall surface near the opening of the container body includes a pitch greater than a pitch of the spiral rib formed on the inner side wall surface at the one end of the container body.

Aspect 47. The powder container according to Aspect 44, wherein the gear is disposed on the container body, the powder present inside the container body is conveyed, by rotation of the container body, from one end in a direction of a rotational axis of the container body to the other end at which the container opening is formed, and a part of the spiral rib that is formed on the inner side wall surface near the opening of the container body includes a portion to be perpendicular to the rotational axis.

Aspect 48. The powder container according to Aspect 43, wherein the conveyor is an agitating conveyor configured to rotate in the container body.

Aspect 49. The powder container according to any one of Aspects 20 to 42, further comprising a container body configured to contain a powder for image formation, the powder being to be supplied to the powder replenishing device, wherein the conveyor is an agitating conveyor configured to rotate in the container body.

Aspect 50. The powder container according to any one of Aspects 20 to 42, further comprising a container body configured to contain a powder for image formation, the powder being to be supplied to the powder replenishing device, wherein the gear is provided as a separate member different from the container body.

Aspect 51. The powder container according to Aspect 50, wherein an inner surface of the gear and an outer surface of the nozzle receiver have screws formed thereon for mutual screwing.

Aspect 52. The powder container according to any one of Aspects 43 to 48, wherein the gear is provided as a separate member different from the container body.

Aspect 53. The powder container according to Aspect 52, wherein an inner surface of the gear and an outer surface of the nozzle receiver have screws formed thereon for mutual screwing.

Aspect 54. The powder container according to any one of Aspects 31 to 42, further comprising a container body configured to contain a powder for image formation, the powder being to be supplied to the powder replenishing device, wherein the lifting portion includes a conveying vane which extends from the nozzle receiver to an inner surface of the container body.

Aspect 55. The powder container according to any one of Aspects 43 to 48 and 52 to 53, wherein the nozzle receiver includes a lifting portion configured to lift the powder by rotation of the nozzle receiver to convey the powder to the nozzle opening of the conveying nozzle, and the lifting portion includes a conveying vane which extends from the nozzle receiver to an inner surface of the container body.

Aspect 56. The powder container according to Aspect 20, further comprising:

a container body configured to contain a powder for image formation and the conveyor, the powder being to be supplied to the powder replenishing device;

a second container cover which is rotatable with respect to the container body, the second container cover being provided on the other end of the container body; and a lifting portion configured to lift the powder by rotation of the second container cover to convey the powder to the nozzle opening of the conveying nozzle, wherein the lifting portion is configured to extend from an inner surface of the second container cover toward an inside of the second container cover.

Aspect 57. The powder container according to Aspect 56, wherein the container engaged portion includes a sliding portion configured to cause the replenishing device engaging member to slide.

Aspect 58. The powder container according to Aspects 56 or 57, further comprising a container cover configured to cover the gear and include the container engaged portion.

Aspect 59. The powder container according to Aspect 58, wherein the container cover includes a gear exposing hole for partially exposing a gear tooth.

Aspect 60. The powder container according to any one of Aspects 56 to 59, wherein the engaged hole includes a through hole.

Aspect 61. The powder container according to any one of Aspects 56 to 60, wherein the accumulating portion includes a concave portion in the lifting portion, wherein the concave portion includes an extending portion which is configured to extend from an inner surface of the second container cover toward an outer surface of the nozzle receiver, and a bent portion which is formed to be bent along the outer surface of the nozzle receiver in a rotational direction downstream side.

Aspect 62. The powder container according to Aspect 61, wherein the bent portion is shorter than the extending portion.

Aspect 63. The powder container according to any one of Aspects 56 to 62, wherein the accumulating portion is the lifting portion that is extended along an upward position than the center of rotation of the second cover, when the lifting portion is substantially horizontal.

Aspect 64. The powder container according to any one of Aspects 56 to 62, wherein the accumulating portion is the lifting portion such that a base of the lifting portion is positioned more on an upstream side in the rotational direction of the second container cover than an end portion of the lifting portion on a side opposite to the nozzle receiver.

Aspect 65. The powder container according to any one of Aspects 52 to 64, wherein a gap between an end portion of the lifting portion and an outer surface of the nozzle receiver is 2 mm or smaller.

Aspect 66. The powder container according to any one of Aspects 56 to 65, wherein the conveyor is an agitating conveyor configured to rotate in the container body.

Aspect 67. The powder container according to any one of Aspects 20 to 66, wherein the nozzle receiver further includes a nozzle receiving opening configured to receive the conveying nozzle, a container shutter configured to open or shut the nozzle receiving opening, and a biasing member configured to bias the container shutter toward the position of shutting the nozzle receiving opening.

Aspect 68. A powder container attachable to a powder replenishing device in a longitudinal direction, the powder replenishing device including a conveying nozzle for conveying a powder, a nozzle opening formed on the conveying nozzle to receive the powder from the powder container, and a replenishing device engaging member for holding the powder container by laterally biasing the powder container, the powder container comprising:

a conveyor configured to convey the powder from one end in the longitudinal direction to the other end at which a container opening is formed;

a gear configured to rotate the conveyor with an external driving force;

a nozzle receiver provided on the container opening, and configured to receive the conveying nozzle insertable; and a container engaged portion is provided outer than the tooth of the gear in a radial direction and includes an engaged hole with which the replenishing device engaging member engages, wherein an outer surface of the nozzle receiver and an inner surface of the container opening have screws formed thereon for mutual screwing.

Aspect 69. A powder container attachable to a powder replenishing device in a longitudinal direction, the powder replenishing device including a conveying nozzle for conveying a powder, a nozzle opening formed on the conveying nozzle to receive the powder from the powder container, and a replenishing device engaging member for holding the powder container by laterally biasing the powder container, the powder container comprising:

a conveyor configured to convey the powder from one end in the longitudinal direction to the other end at which a container opening is formed;

a gear configured to rotate the conveyor with an external driving force;

a nozzle receiver provided on the container opening, and configured to receive the conveying nozzle insertable; and a container engaged portion is provided outer than the tooth of the gear in a radial direction and includes an engaged hole with which the replenishing device engaging member engages, wherein the nozzle receiver includes a lifting portion configured to lift the powder by rotation of the nozzle receiver to convey the powder to the nozzle opening of the conveying nozzle.

Aspect 70. The powder container according to Aspects 68 or 69, wherein the container engaged portion configured to cross the gear in the longitudinal direction of the powder container.

Aspect 71. The powder container according to any one of Aspects 68 to 70, wherein the engaged hole is arranged at a position beyond the gear when viewed from the container opening in the longitudinal direction of the powder container.

Aspect 72. The powder container according to any one of Aspects 68 to 71, wherein the container engaged portion includes a sliding portion configured to cause the replenishing device engaging member to slide.

Aspect 73. The powder container according to any one of Aspects 68 to 72, further comprising a container cover configured to cover the gear and include the container engaged portion.

Aspect 74. The powder container according to Aspect 73, wherein the container cover includes a gear exposing hole for partially exposing a gear tooth.

Aspect 75. The powder container according to any one of Aspects 68 to 74, wherein the engaged hole includes a through hole.

Aspect 76. The powder container according to any one of Aspects 68 to 75, further comprising a container body configured to contain a powder for image formation, the powder being to be supplied to the powder replenishing device, wherein the conveyor is a spiral rib formed on an inner side wall surface of the container body.

Aspect 77. The powder container according to any one of Aspects 68 to 76, further comprising a container body configured to contain a powder for image formation, the powder being to be supplied to the powder replenishing device, wherein the conveyor is an agitating conveyor configured to rotate in the container body.

Aspect 78. An image forming apparatus comprising:

an image forming unit configured to perform image formation with a powder for image formation; and the powder replenishing device configured to hold the powder container according to any one of Aspects 20 to 77, wherein the powder replenishing device conveys the powder from the powder container to the image forming unit when the powder container is attached to the powder replenishing device, the powder replenishing device comprising:

a conveying nozzle for conveying a powder, a nozzle opening formed on the conveying nozzle to receive the powder from the powder container, and a replenishing device engaging member for holding the powder container by laterally biasing the powder container.

Aspect 79. The image forming apparatus according to Aspect 78, wherein the powder replenishing device further includes a nozzle shutter for opening or shutting the nozzle opening, a biasing member for biasing the nozzle shutter to shut the nozzle opening, and a butting portion formed on the nozzle shutter to move the nozzle shutter with respect to the conveying nozzle so that the nozzle shutter opens the nozzle opening.

Aspect 80. The image forming apparatus according to Aspect 78 or 79, wherein the powder replenishing device further includes a conveying screw provided on the conveying nozzle to convey the powder received from the nozzle opening, the nozzle opening having a smaller width than a diameter of the conveying screw in a direction orthogonal to a rotational axis of the conveying screw.

EXPLANATIONS OF LETTERS OR NUMERALS

26 feed tray
27 feed roller
28 registration roller pair
29 discharge roller pair
30 stack section
32, 6032, A032, D032, E032, F032 toner container (powder container)
33, 2033, 3033, 4033, 6033, 7033, 8033, 9033, A033, D033, F033 container body (powder storage)
33*a* container opening
34, A034, D034, E034, F034 container front end cover (container cover)
34*a*, A034*a* gear exposing hole
34*b*, A034*b* color-specific rib
41 photoreceptor
42*a* cleaning blade
42 photoreceptor cleaning device
44 charging roller
46Y image forming unit for yellow
46 image forming unit
47 exposing device
48 intermediate transfer belt
49 primary-transfer bias roller
50 developing device
51 developing roller
52 doctor blade
53 first developing particle accommodating portion
54 second developing particle accommodating portion
55 developer conveying screw
56 toner density sensor
60 toner replenishing device (powder replenishing device)
64 toner dropping passage (powder conveying device)
70 container holding section
71 insert hole portion
72 container receiving section
73 container cover receiving section
82 secondary-transfer backup roller
85 intermediate transfer unit
86 fixing device
89 secondary transfer roller
90 controller
91 container driving section
100 printer
200 sheet feeder
301, 6380, A301, F301 container gear (gear)
302 spiral rib
303, A303 gripper (handle)
305, A305 front end opening (opening)
306 cover hooked portion
309, A309 male screw
6315 container flange
330, A330, D330, F330 nozzle receiver (nozzle insertion member)
331, A331, E331, F331 nozzle receiving opening (nozzle insertion opening)
332, A332, E332, F332 container shutter
332*a* shutter hook
332*c* front end cylindrical portion
332*d* sliding section
332*e* guiding rod
332*f* cantilever
333, A333, F333 container seal
335 shutter rear end supporting portion
335*a* shutter side supporting portion
335*b* space between the side supporting portions
336, A336, E336, F336 container shutter spring
337 nozzle receiver fixing portion
337*a* nozzle shutter positioning rib (butted portion)
337*b* seal jam preventing space
3337*c* male screw
338, A392, D392, E392, F392 toner receiving opening
339, A339, F339 container engaged portion
339*a*, A339*a* guiding protrusion
339*b*, A339*b* guiding gutter
339*c*, A339*c* bump
339*d*, A339*d* engaged hole
340 container shutter supporter
341 cover hook
343 holding portion
344 IC tag holder
345 holding structure
347 holder hole
348 holder lower part
349 holder right side part
350 holder upper part
351 inner wall protrusion
352 frame
353 holder protrusion
354 holder lower hook
355 holder upper hook
356 holder right side hook
357 IC tag attaching surface
358 holding base
359*a* upper attached part
359*b* lower attached part
360 side attached part
360*a* inclined surface
361, A361, F361 sliding guide
361*a* sliding gutter
370, 2370, B370 cap
371 cap flange
2372, B372 adsorption material
400 scanner
500 copier (image forming apparatus)
601 container driving gear
602 frame
603 driving motor
604 drive transmitting gear
605 conveying screw gear
607 nozzle holder
608 setting cover
609 replenishing device engaging member (lock lever)
610 nozzle opening
611 conveying nozzle
611*a* front end of the nozzle
611*s* nozzle opening rim
612 nozzle shutter
612*a* nozzle shutter flange (butting portion)
612*b* first inner rib
612*c* second inner rib
612*d* third inner rib
612*e* nozzle shutter tube
612*f* nozzle shutter spring receiving surface
613 nozzle shutter spring (biasing member)
614 conveying screw
615 container setting section

615*a* inner surface of the container setting section
615*b* end surface of the container setting section
6620 guiding pin
700 IC tag (ID tag, ID chip, information storage device)
701 ID tag hole (hole, notch)
702 substrate
703 earth terminal
705 earth terminal projection
710 metallic pad (terminal of the container)
710*a* first metallic pad
710*b* second metallic pad
710*c* third metallic pad
800 connector
801 guiding pin (protrusion)
802 earth terminal of the main body
803 swing preventer
804 terminal of the main body
805 connector body
5304*i* lifting portion (conveying vane)
A306 ring stopper
A307 rear end lid
A307*a* filling hole
A308*a*, F308*a* first container cover (front end lid)
A308*b*, F308*b* second container cover
A311 cap
A330*a* container shutter supporter
A330*b* container spring supporter
A330*c* first outer surface
A330*d* second outer surface
A330*e* inner surface
A330*f* step
A330*g* guiding slit
A334, D334, F334 shaft (spindle)
A340 shutter pin
A380, D380, E380, F380 agitating conveyor
A382, D382, E382, F382 lifting portion (conveying vane)
A390, D390, E390, F390 agitator assembly
A391, F391 key convex
D900 torque limiter
D901 housing
D902 inner ring
D903 flat spring
D904 shielding member
D905 bearing
D912 vane shape conveyor
D913 coil shape conveyor
D914 conveyor holder
D914*a* cam groove
E301 gear portion
S308*b* container cover portion
E330 nozzle receiving portion
E334 shaft portion
F306 holding ring
F380*a* front end portion of conveying agitator
F380*b* screw
F381 prop
F382*a* root portion
F382*b* end portion
F393 concave
F905 rotating sliding portion (bearing)
G developer
L laser light
P recording medium
γ press fitting portion

The invention claimed is:

1. A powder container to contain a powder for image formation, the powder container comprising:

an opening to be inserted into a container setting section disposed around a conveying nozzle;

a conveyor to convey the powder by rotation;

a gear to engage to drive the conveyor; and a container port at a side of the powder container to hold the powder container with respect to an image forming apparatus by engaging with an apparatus engaging element of the image forming apparatus, wherein the gear is disposed between the opening and the container port in a longitudinal direction.

2. The powder container according to claim 1, further comprising:

a container cover that includes the container port.

3. The powder container according to claim 2, wherein the container cover covers at least part of the gear.

4. The powder container according to claim 1, further comprising:

a bump at an opening side of the container port.

5. The powder container according to claim 1, further comprising:

a guiding gutter at an opening side of the container port.

6. The powder container according to claim 1, further comprising:

a guiding gutter; and a bump, wherein the guiding gutter, the bump, and the container port are disposed from an opening side in an order of the guiding gutter, the bump, and the container port.

7. The powder container according to claim 1, further comprising:

a container body to contain the powder, wherein the gear is different from the container body.

8. The powder container according to claim 1, further comprising:

a container body to contain the powder, the container body including a cylindrical shape.

9. The powder container according to claim 1, wherein the opening includes a cylindrical shape and protrudes from an end of the powder container.

10. The powder container according to claim 9, further comprising:

a gripper disposed at an end opposite to an end at which the opening is provided.

11. The powder container according to claim 1, wherein the conveyor includes a spiral rib.

12. An image forming apparatus comprising the powder container according to claim 1.

13. An image forming system, comprising:

an image forming apparatus; and a powder container, the powder container including:

an opening to be inserted into a container setting section disposed around a conveying nozzle of the image forming apparatus;

a conveyor to convey the powder by rotation;

a container gear to engage with a gear of the image forming apparatus to drive the conveyor; and a container port at a side of the powder container to hold the powder container with respect to an image forming apparatus by engaging an apparatus engaging element of the image forming apparatus at a side of the powder container, wherein the container gear is arranged between the opening and the container port in a longitudinal direction.

14. The image forming system according to claim 13, the powder container further comprising:

a container cover that includes the container port.

15. The image forming system according to claim 14, wherein the container cover covers at least part of the container gear.

16. The image forming system according to claim 13, the powder container further comprising:

a bump at an opening side of the container port.

17. The image forming system according to claim 13, the powder container further comprising:

a guiding gutter at an opening side of the container port.

18. The image forming system according to claim 13, the powder container further comprising:

a guiding gutter; and a bump, wherein the guiding gutter, the bump, and the container port are disposed from an opening side in an order of the guiding gutter, the bump, and the container port.

19. The image forming system according to claim 13, the powder container further comprising:

a container body to contain the powder, wherein the container gear is different from the container body.

20. The image forming system according to claim 13, the powder container further comprising:

a container body to contain the powder, the container body including a cylindrical shape.

* * * * *